US009487002B2

(12) United States Patent
Rogers et al.

(10) Patent No.: US 9,487,002 B2
(45) Date of Patent: Nov. 8, 2016

(54) HIGH RESOLUTION ELECTROHYDRODYNAMIC JET PRINTING FOR MANUFACTURING SYSTEMS

(71) Applicant: THE BOARD OF TRUSTEES OF THE UNIVERSITY OF ILLINOIS, Urbana, IL (US)

(72) Inventors: John A Rogers, Champaign, IL (US); Jang-Ung Park, Urbana, IL (US); Placid M. Ferreira, Champaign, IL (US); Deepkishore Mukhopadhyay, Chicago, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 0 days.

(21) Appl. No.: 14/686,304

(22) Filed: Apr. 14, 2015

(65) Prior Publication Data

US 2015/0290938 A1 Oct. 15, 2015

Related U.S. Application Data

(62) Division of application No. 12/669,287, filed as application No. PCT/US2007/077217 on Aug. 30, 2007, now Pat. No. 9,061,494.

(60) Provisional application No. 60/950,679, filed on Jul. 19, 2007.

(51) Int. Cl.
*B41J 2/06* (2006.01)
*B41J 2/09* (2006.01)
(Continued)

(52) U.S. Cl.
CPC .. *B41J 2/06* (2013.01); *B41J 2/09* (2013.01); *B41J 2/14314* (2013.01); *B41J 2/16* (2013.01);
(Continued)

(58) Field of Classification Search
None
See application file for complete search history.

(56) References Cited

U.S. PATENT DOCUMENTS 3,949,410 A 4/1976 Bassous et al.
4,658,269 A 4/1987 Rezanka
(Continued)

FOREIGN PATENT DOCUMENTS

EP 1 477 230 11/2004
WO WO 2009/011709 1/2009

OTHER PUBLICATIONS

Afzali et al. (Web Release Jul. 9, 2002) "High-Performance, Solution-Processes Organic Thin Film Transistors from a Novel Pentacene Precursor," *J. Am. Chem. Soc.* 124(30):8812-8813.
(Continued)

*Primary Examiner* — Jerry Rahll
(74) *Attorney, Agent, or Firm* — Lathrop & Gage LLP

(57) ABSTRACT

Provided are high-resolution electrohydrodynamic inkjet (e-jet) printing systems and related methods for printing functional materials on a substrate surface. In an embodiment, a nozzle with an ejection orifice that dispenses a printing fluid faces a surface that is to be printed. The nozzle is electrically connected to a voltage source that applies an electric charge to the fluid in the nozzle to controllably deposit the printing fluid on the surface. In an aspect, a nozzle that dispenses printing fluid has a small ejection orifice, such as an orifice with an area less than 700 $\mu m^2$ and is capable of printing nanofeatures or microfeatures. In an embodiment the nozzle is an integrated-electrode nozzle system that is directly connected to an electrode and a counter-electrode. The systems and methods provide printing resolutions that can encompass the sub-micron range.

16 Claims, 37 Drawing Sheets

(51) Int. Cl.
*B41J 2/16* (2006.01)
*B41J 2/14* (2006.01)

(52) U.S. Cl.
CPC ..... *B41J2/162* (2013.01); *B41J 2/1628* (2013.01); *B41J 2/1629* (2013.01); *B41J 2/1631* (2013.01); *B41J 2/1632* (2013.01); *B41J 2/1639* (2013.01); *B41J 2/1642* (2013.01); *B41J 2/1645* (2013.01)

(56) References Cited

U.S. PATENT DOCUMENTS

| | | | |
|---|---|---|---|
| 5,790,151 | A | 8/1998 | Mills |
| 5,838,349 | A | 11/1998 | Choi et al. |
| 6,276,775 | B1 | 8/2001 | Schulte |
| 6,451,191 | B1 | 9/2002 | Bentsen et al. |
| 6,742,884 | B2 | 6/2004 | Wong et al. |
| 7,158,277 | B2 | 1/2007 | Berggren et al. |
| 7,641,325 | B2 | 1/2010 | Steiner et al. |
| 9,061,494 | B2 | 6/2015 | Rogers et al. |
| 2006/0102525 | A1 | 5/2006 | Volkel et al. |
| 2007/0064068 | A1 | 3/2007 | Piatt et al. |
| 2011/0170225 | A1 | 7/2011 | Rogers et al. |

OTHER PUBLICATIONS

Ahn et al. (2007) "Iterative Learning Control: Brief Survey and Categorization, Systems, Man, and Cybernetics, Part C: Applications and Reviews," *IEEE Transactions* 37(6):1099-1121.
Anagnostopoulos et al. (2003) "Micro-Jet Nozzle Array for Precise Droplet Metering and Steering Having Increased Droplet Deflection," 12th Int. Conf. on Solid State Sensors, Actuators and Microsystems (Boston, MA) 1:368-371.
Arias et al. (2004) "All Jet-Printed Polymer Thin-Film Transistor Active-Matrix Backplanes," *Appl. Phys. Let.* 85(15):3304-3306.
Arimoto et al. (1984) "Bettering Operation of Robots by Learning," *J. Robotic Syst.* 1(2):123-140.
Babel et al. (Web Release Apr. 27, 2005) "Electrospun Nanofibers of Blends of Conjugated Polymers: Morphology, Optical Properties, and Field-Effect Transistors," *Macromolecules* 38(11):4705-4711.
Barry et al. (Web Release Aug. 27, 2005) "Charging Process and Coulomb-Force-Directed Printing of Nanoparticles with Sub-100-nm Lateral Resolution," *Nano Lett.* 5(10):2078-2084.
Barton et al. (Aug. 2010) "A Desktop Electrohydrodynamic Jet Printing System," *Mechatronics* 20(5):611-616.
Barton K., (Mar. 2010) "Electrohydrodynamic Jet Printing System," Lemelson-Illinois Student Prize Finalist.
Barton et al. (Mar. 2010) "E-Jet Printing," Power Point Presentation, Industry Advisory Board Meeting for Nano-Learning Center.
Bassous et al. (1977) "Ink Jet Printing Nozzle Arrays Etched in Silicon," *Appl. Phys. Lett.* 31(2):135-137.
Bean, K.E. (1978) "Ansiotropic Etching of Silicon," *IEEE Trans. Electron Dev.* 25(10):1185-1193.
Bharathan et al. (1998) "Polymer Electroluminescent Devices Processed by Inkjet Printing: I. Polymer Light-Emitting Logo," *Appl. Phys. Lett.* 72(21):2660-2662.
Bietsch et al. (2004) "Rapid Functionalization of Cantilever Array Sensors by Inkjet Printing," *Nanotechnology* 15:873-880.
Blazdell et al. (1999) "Preparation of Ceramic Inks for Solid Freeforming Using a Continuous Jet Printer," *J. Mater. Syn. Process.* 7(6):349-356.
Blazdell et al. (1995) "The Computer Aided Manufacture of Ceramics Using Multilayer Jet Printing," *J. Mater. Sci. Lett.* 14(22):1562-1565.
Boning et al. (Oct. 1996) "Run by Run Control of Chemical-Mechanical Polishing," *IEEE Trans. Comp. Packag. Manufact. Technol. C* 19(4):307-314.
Bristow et al. (2006) "A High Precision Motion Control System with Application to Microscale Robotic Deposition," *IEEE Trans. Control Systems Technol.* 26(3):96-114.
Bristow et al. (2006) "A Survey of Iterative Learning Control," *Control Systems Magazine*, IEEE 26(3):96-114.
Burns et al. (2003) "Inkjet Printing of Polymer Thin-film Transistor Circuits," *MRS Bulletin*, 28:829-834.
Calvert (2001) "Inkjet Printing for Materials and Devices," *Chem. Mater.* 13(10):3299-3305.
Chabinyc et al. (2005) "Printing Methods and Materials for Large-Area Electronic Devices," *Proceedings of the IEEE* 93(8):1491-1499.
Chang P. C. et al. (2004) "Film morphology and Thin Film Transistor Performance of Solution-Processed Oligothiophenes," *Chem. Mater.* 16:4783-4789.
Chang et al. (2006) "Inkjetted Crystalline Single Monolayer Oligothiphene OTFTs," *IEEE Trans. Electron. DEv.*53(4):594-600.
Chang, S. C. et al. (1999) "Multicolor Organic Light-Emitting Diodes Processed by Hybrid Inkjet Printing," *Adv. Mater.* 11:734-737.
Chang et al. (1998) "Dual-Color Polymer Light-Emitting Pixels Processed by Hybrid Inkjet Printing," *Appl. Phys. Lett.* 73(18):2561-2563.
Chen et al. (2006) "Scaling Law for Pulsed Electrohydrodynamic Drop Formation," *Appl. Phys. Lett.* 89:124103.
Chen et al. (2005) "The Role of Metal- Nanotube Contact in the Performance of Carbon Nanotube Field Effect Transistors," *Nano Lett.* 5:1497-1502.
Chen et al. (1997) "An Iterative Learning Control in Rapid Thermal Processing," In: Proc. The IASTED Int. Conf. on Modeling, Simulation and Optimization (MSO'97), Singapore pp. 189-192.
Chen et al. (Web Release Apr. 13, 2006) "Electrohydrodynamic 'Drop-and-Place' Particle Deployment," *Appl. Phys. Lett.* 88:154104.
Cheng K. et al. (2005) "Inkjet Printing, Self-Assembled Polyelectrolytes, and Electroless Plating: Low Cost Fabrication of Circuits on a Flexible Substrate at Room Temperature," *Macromol. Rapid Commun.* 26:247-264.
Cheung et al. (2002) 2nd Ann. Int. Conf. on Microtechnologies in Medicine and Biology (Madison, WA, USA) pp. 71-75.
Choi et al. (2008) "Scaling Laws for Jet Pulsations Associated with High-Resolution Electrohydrodynamic Printing," *Appl. Phys. Lett.* 92(12):123109.
Cloupeau et al. (Sep. 1994) "Electrohydrodynamic Spraying Functioning Modes: A Critical Review," *J. Aerosol Sci.* 25(6):1021-1036.
Collins et al. (Web Release Dec. 2007) "Electrohydrodynamic Tip Streaming and Emission of Charged Drops from Liquid Cones," *Nat. Phys.* 4:149-154.
Creagh et al. (2003) "Design and Performance of Inkjet Printheads for Non Graphic Arts Applications," *MRS Bulletin* 28:807-811.
Dearden et al. (2005) "A Low Curing Temperature Curing Temperature Silver Ink for Use in Inkjet Printing and Subsequent Production of Conductive Tracks," *Macromol. Rapid Commun.* 26:315-318.
Del Castillo et al. (1997) "Run-to-run Process Control: Literature Review and Extensions," *J. Quality Technol.* 29(2):184-196.
Del Castillo et al. (1998) "An Adaptive Run-to-Run Optimizing Controller for Linear and Nonlinear Semiconductor Process," *IEEE Trans Semiconductor Manufacturing* 11(2):285-295.
Duke et al. (Mar. 10, 2002) "The Surface Science of Xerography," *Surf. Sci.* 500:1005-1023.
Farooqui et al. (1992) "Microfabrication of Submicron Nozzles in Silicon Nitride," *J. Microelectromech. Syst.* 1(2):86-88.
Forrest S. R. (2004) "The Path to Ubiquitous and Low-Cost Organic Electronic Applications on Plastics," *Nature*, 428:911-918.
Gans et al. (2004) "Inkjet Printing of Polymers: State of the Art and Future Development," *Adv. Mater.* 16:203-213.
Genda et al. (2004) "Micro-Patterned Electret for High Power Electrostatic Motor," 17$^{th}$ IEEE International Conference on Micro Electro Mechanical Systems, pp. 470-473.
Gomez et al. (1994) "Charge and Fission of Droplets in Electrostatic Sprays," *Phys. Fluids* 6(1):404-414.
Graham-Rowe, D. (Sep. 13, 2007) "Nanoscale Inkjet Printing," Technology Review published by MIT, http://technologyreview.com/computing/19373/page1/.

(56) References Cited

OTHER PUBLICATIONS

Han et al. (May 2002) "Tool Path-Based Deposition Planning in Fused Deposition Process," *J. Manuf. Sci. Eng.* 124(2):462-472.
Hayati et al. (Jan. 2, 1986) "Mechanism of Stable Jet Formation in Electrohydrodynamic Atomization," *Nature* 319:41-42.
Hayati et al. (1987) "Investigations Into Mechanisms of Electrohydrodynamic Spraying of Liquids," *J. Colloid Interf. Sci.* 117:205-221.
Hayes et al. (1998) "Micro-Jet Printing of Polymers and Solder for Electronics Manufacturing," *J. Electron. Manufac.* 8:209-216.
Hebner et al. (1998) "Local Tuning of Organic Light-Emitting Diode Color by Dye Droplet Application," *Appl. Phys. Lett.* 73:1775-1777.
Heller M. J. (2002) "DNA Microarray Technology: Devices, Systems, and Applications," *Ann. Rev. Biomed. Eng.* 4:129-153.
Hiller et al. (2002) "Reversibly Erasable Nanoporous Anti-Reflection Coatings from Polyelectrolyte Multilayers," *Nature Mater.* 1:59-63.
Huang et al. (Web Release Dec. 11, 2006) "Organic Field-Effect Inversion-Mode Transistors and Single-Component Complementary Inverters on Charges Electrets," *J. Appl. Phys.* 100:114512.
Huang et al. (Jan. 2007) "Organic Field-Effect Transistors and Unipolar Logic Gates on Charged Electrets from Spin-On Organosilsesquioxane," *Adv. Funct. Mater.* 17(1):142-153.
International Search Report and Written Opinion, Corresponding to International Application No. PCT/US07/77217, Mailed Jun. 3, 2008.
Jacobs et al. (2001) "Submicrometer Patterning of Charge in Thin-Film Electrets," *Science* 291:1763-1766.
Jacobs et al. (Web Release Nov. 4, 2002) "Approaching Nanozerography: The Use of Electrostatic Forces to Position Nanoparticles with 100nm Scale Resolution," *Adv. Mater.* 149(21):1553-1557.
Jaworek et al. (Oct. 1996) "Forms of the Multijet Mode of Electrrohydrodynamic Spraying," *J. Aerosol Sci.* 27(7):979-986.
Jayasinghe et al. (2004) "Electric-Field Driven Jetting from Dielectric Liquids," *Appl. Phys. Lett.* 85 :4243-4245.
Jayasinghe et al. (2006) "Electrohydrodynamic Jet Processing: An Advanced Electric Field-Driven Jetting Phenomenon for Processing Living Cells," *Small* 2:216-219.
Jayasinghe (2006) "Stable Electric-Field Driven Cone-Jetting of Concentrated Biosuspensions," *Lab Chip.* 6:1086-1090.
Jung et al. (2000) Fabrication of a Nanosize Metal Aperture for a Near Field Scanning Optical Microspray Sensor Using Photoresist Removal and Sputtering Techniques, *J. Vac. Sci. Technol. A* 18:1333-1337.
Juraschek et al. (Aug. 3, 1998) "Pulsation Phenomena During Electrospray Ionization," *Int. J. Mass Spectrom.* 177(1):1-15.
Kang et al. (Apr. 2007) "High Performance Electronics Using Dense, Perfectly Aligned Arrays of Single Walled Carbon Nanotubes," *Nature Nanotech.* 2:230-236.
Kawamoto et al. (2005) "Fundamental Investigation on Electrostatic Ink Jet Phenomena in Pin-to-Plate Discharge System," *J. Imaging Sci. Technol.* 49:19-27.
Khatavkar et al. (2005) "Diffuse Interface Modeling of Droplet Impact on a Pre-Patterned Solid Surface," *Macromol. Rapid Commun.* 26(4):298-303.
Kim et al. (Sep. 2008) "Electrohydrodynamic Drop-On-Demand Patterning in Pulsed Cone-Jet Mode at Various Frequencies," *J. Aerosol Sci.* 39(9):819-825.
Kim W. et al. (2005) "Electrical Contacts to Carbon Nanotubes Down to 1nm in Diameter," *Appl. Phys. Lett.* 87:173101.
Kim et al. (2009) "On Demand Electrohydrodynamic Jetting with Meniscus Control by a Piezoelectric Actuator for Ultra-Fine Patterns," *J. Micromech. Microeng.* 19:107001.
Kobayashi et al. (Jun. 1, 2000) "A Novel RGB Multicolor Light-Emitting Polymer Display," *Synthetic Metals* 111:125-128.
Kocabas et al. (2006) "Spatially Selective Guided Growth of High-Coverage Arrays and Random Networks of Single-Walled Carbon Nanotubes and their Integration into Electronic Devices," *JACS* 128:4540-4541.
Korkut et al. (Jan. 25, 2008) "Enhanced Stability of Electrohydrodynamic Jets Through Gas Ionization," *Phys. Rev. Lett.* 100(3):034503.
Kuoni et al. (2003) "A Modular High Density Multichannel Dispenser for Microarray Printing," 12th Int. Conf. on Solid State Sensors, Actuators and Microsystems (Boston, MA) 1:372-375.
Le, H. P. (1998) "Progress and Trends in Ink-Jet Printing Technology," *J. Imag. Sci. Technol.* 42:49-62.
Lee et al. (2007) "Electrohydrodynamic Printing of Silver Nanoparticles by Using Focused Nanocolloid Jet," *Appl. Phys. Lett.* 90:0819051-0819053.
Lee et al. (2008) Structuring of Conductive Silver Line by Electrohydrodynamic Jet Printing and Its Electrical Characterization, *J. Phys.* 142(1):012039.
Lee et al. (2005) "A Printable Form of Single-Crystalline Gallium Nitride for Flexible Optoelectronic Systems," *Small* 1:1164-1168.
Lemmo et al. (1998) "Inkjet Dispensing Technology: Application in Drug Discovery," *Curr. Opin. Biotechol.* 9:615-617.
Lenggoro et al. (Nov. 1, 2006) "Nanoparticle Assembly on Patterned 'Plus/Minus' Surfaces from Electrospray of Colloidal Dispersion," *J. Colloid Interface Sci.* 303(1):124-130.
Lewis et al. (2004) "Direct Writing in Three Dimensions," *Mater. Today* 7:32-39.
Li et al. (May 2006) "Aspirin Particle Formation by Electric-Field-Assisted Release of Droplets," *Chem. Eng. Sci.* 61:3091-3097.
Li et al. (Web Release Aug. 2, 2004) "Electrospinning of Nanofibers: Reinventing the Wheel," *Adv. Mater.* 16(14):1151-1170.
Ling et al. (2004) "Thin Film Deposition, Patterning, and Printing in Organic Thin Film Transistors," *Chem. Mater.* 16:4824-4840.
Liu et al. (Dec. 2005) "Low-Voltage All-Polymer Field Effect Transistor Fabricated Using an Inkjet Printing Technique," *Macromol. Rapid Commun.* 26(24):1955-1959.
MacDonald N C (Sep. 1996) "SCREAM MicroElectroMechanical Systems," *Microelectron. Eng.* 32:49-73.
Marginean et al. (Web Release Mar. 3, 2006) "Charge Reduction in Electrosprays: Slender Nanojets as Intermediates," *J. Phys. Chem. B* 110(12):6397-6404.
Marginean et al. (Aug. 9, 2006) "Order-Chaos-Order Transitions in Electrosprays: The Electrified Dripping Faucet," *Phys. Rev. Lett.* 97(6):064502.
Marginean et al. (2004) "Flexing the Electrified Meniscus: The Birth of a Jet in Electrosprays," *Anal. Chem.* 76:4202-4207.
McCarty et al. (Mar. 7, 2008) "Electrostatic Charging Due to Separation of Ions at Interfaces: Contact Electrification of Ionic Electrets," *Angew Chem. Int. Ed.*47(12):2188-2207.
Menard et al. (2004) "A Printable Form of Silicon for High Performance Thin Film Transistors on Plastic Substrates," *Appl. Phys. Lett.* 84(26):5398-5400.
Menard et al. (Apr. 2007) "Micro and Nanopatterning Techniques for Organic Electronic and Optoelectronic Systems," *Chem. Rev.* 107(4):1117-1160.
Mesquida et al. (Web Release Sep. 5, 2001) "Attaching Silica Nanoparticles from Suspension onto Surface Charge Patters Generated by a Conductive Atomic Force Microscope Tip," *Adv. Mater.* 13(18):1395-1398.
Mishra et al. (Aug. 2010) "High Speed Drop-on-Demand Printing with a Pulsed Electrohydrodynamic Jet." *J. Micromech. Microeng.* 20:095026:1-8.
Mishra et al. (2007) "Precision Positioning of Wafer Scanners: An Application of Segmented Iterative Learning Control," *Control Systems Magazine* 27(4):20-25.
Mishra et al. (2010) "Control of High-Resolution Electrohydrodynamic Jet Printing," *American Control Conference*, Baltimore, MD, Jun. 30, 2010-Jul. 2, 2010, pp. 6537-6542.
Mishra et al. (Apr. 2010) "A Desktop Electrohydrodynamic Jet Printing System with Integrated High-Resolution Sensing and Control," Presented at the 2010 ASPE Control Precision Systems Conference, Apr. 11-13, 2010, Cambridge MA.

(56) References Cited

OTHER PUBLICATIONS

Molesa et al.(2004) Technical Digest—International Electron Devices Meeting p. 1072-1074.
Moon et al. (Apr. 2002) "Ink-Jet Printing of Binders for Ceramic Components," *J. Am. Ceramic Soc.* 85(4):755-762.
Moore et al. (1988) "Learning Control for Robotics," In: Proceedings of 1988 International Conference on Communications and Control, Baton Rouge, Louisiana pp. 240-251.
Morris et al. (Sep. 18, 2000) "Microfabrication of a Metal Fuel Injector Nozzle Array," *Proc. SPIE* 4174:58-65.
Mukhopadhyay et al. (Apr. 4, 2007) "Exploiting Differential Etch Rates to Fabricate Large-Scale Nozzle Arrays with Protudent Geometry," *J. Micromech. Microeng.* 17(5):923-930.
Murata et al. (2005)." Super-fine ink-jet printing: toward the minimal manufacturing system" *Microsystem Technologies* 12:2-7.
Nallani et al. (2005) "Wafer Level Optoelectronic Device Packaging Using MEMS," *Proceedings of SPIE : Smart Sensors, Actuators, and MEMS II*, 5836, 116-127 (2005.
Nguyen et al. (Web Release May 1, 2009) "Mechanism of Electrohydrodynamic Printing Based on AC Voltage without a Nozzle Electrode," *Appl. Phys. Lett.* 94(17):173509.
Office Action corresponding to U.S. Appl. No. 12/947,120, dated May 8, 2012.
Okamoto et al. (2000) "Microarray Fabrication with Covalent Attachment of DNA Using Bubble Jet Technology," *Nat. Biotechnol.* 18:438-441.
Okazaki et al. (2004) "Microfactory—Concept, History, and Developments," *J. Manuf. Sci. Eng.* 126:837-844.
Olthuis et al. (1992) "On the Charge Storage and Decay Mechanism in Silicon Dioxide Electrets," *IEEE Trans Electr. Insul.* 27(4):691-697.
Pai et al. (1993) "Physics of Electrophotography," *Rev. Mod. Phys.* 65(1):163-211.
Parashkov et al. (2005) "Large Area Electronics Using Printing Method," *Proc. IEEE* 93:1321-1329.
Park et al. (2008) "Nanoscale Patterns of Oligonucleotides Formed by Electrohydrodynamic Jet Printing with Applications in Biosensing and Nanomaterials Assembly," *Nano Lett* 8(12):4210-4216.
Park et al. (2006) "In Situ Deposition and Patterning of Single Walled Carbon Nanotubes by Laminar Flow and Controlled Flocculation in Microfluidic Channels," *Angew. Chem. Int. Ed.* 45:581-585.
Park et al. (Web Release Jan. 12, 2010) "Nanoscale, Electrified Liquid Jets for High-Resolution Printing of Charge," *Nano Letters* 10:584-591.
Park et al. (Web Release Aug. 5, 2007) "High-Resolution Electrohydrodynamic Jet Printing," *Nature Materials* 6:782-789.
Park et al. (2007) "High Resolution Electrohydrodynamic Jet Printing for Printed Electronics," *Nano-CEMMS Industry Advisory Meeting*, University of Illinois at Urbana Champaign.
Paul et al. (2003) "Additive Jet Printing of Polymer Thin-Film Transistors," *Appl. Phys. Lett.* 83(10):2070-2072.
Payne et al. ( Web Release Apr. 10, 2004) "Robust, Soluble Pentacene Ethers," *Organic Letters* 6(10):1609-1612.
Pingree et al. (Web Release Dec. 4, 2009) "Electrical Scanning Probe Microscopy o Active Organic Electronic Devices," *Adv. Mater.* 21(1):19-28.
Preisler et al. (Web Release May 26, 2005) "Ultrathin Epitaxial Germanium on Crystalline Oxide Metal-Oxide-Semiconductor-Field-Effect Transistors," *Appl. Phys. Lett.* 86(22):223504.
Qin et al. (2003) "Adaptive Run-to-Run Control and Monitoring for a Rapid Thermal Processor," *J. Vacuum Sci. Technol. B Microelectronics Nanometer Struct.* 21(1):301-310.
Rayleigh L. (1879) "On the Capillary Phenomena of Jets," *Proc. R. Soc. Lond.* 29:71-97.
Redinger et al. (2004) "An Ink-Jet-Deposited Passive Component Process for RFID" *IEEE Trans. Electron Dev.* 51(12):1978-1973.
Ressier et al. (2008) "Electrostatic Nanopatterning of PMMA by AFM Charge Writing for Directed Nano-Assembly," *Nanotechnology* 19:135301.
Salata O. V. (2005) "Tools of Nanotechnology: Electrospray," *Curr. Nanosci.* 1:25-33.
Samarasinghe et al. (2006) "Printing Gold Nanoparticles with an Electrohydrodynamic Direct-Write Device," *Gold Bulletin* 39:48-53.
Sanaur et al. (2006) "Jet-Printed Electrodes and Semiconducting Oligomers for Elaboration of Organic Thin-Film Transistors," *Organic Electronics* 7:423-427.
Savill, D. (Jan. 1997) "Electrohydrodynamics: The Taylor-Melcher Leaky Dielectric Model," *Ann. Rev. Fluid Mech.* 29:27-64.
Scharnberg et al. (Web Release Jan 2, 2007) "Tuning the Threshold Voltage of Organic Field-Effect Transistors by an Electret Encapsulating Layer," *Appl. Phys. Lett.* 90:013501.
Schonenberger et al. (Feb. 15, 1992) "Charge Flow During Metal Insulator Contact," *Phys. Rev. B* 45(7):3861-3864.
Seemann et al. (Web Release Sep. 11, 2007) "Local Surface Changes Direct the Deposition of Carbon Nanotubes and Fullerenes into Nanoscale Patterns," *Nano Lett.* 7(10):3007-3012.
Sekitani et al. (Apr. 1, 2008) "Organic Transistors Manufactured Using Inkjet Technology with Subfemtoliter Accuracy," *Proc. Nat. Acad. Sci. USA* 105(13):4976-4980.
Sele et al. (2005) "Lithography-Free, Self-Aligned Inkjet Printing with Sub-Hundred Nanometer Resolution," *Adv. Mater.* 17:997-1001.
Shimoda et al. (2003) "Inkjet Printing of Light-Emitting Polymer Displays," *MRS Bulletin* 28:821-827.
Shimoda et al. (2006) "Solution-Processed Silicon Films and Transistors," *Nature* 440:783-786.
Shtein et al. (2004) "Direct Mask-Free Patterning of Molecular Organic Semiconductors Using Organic Vapor Jet Printing," *J. Appl. Phys.* 96(8):4500-5407.
Sigmund P. (1987) "Mechanisms and Theory of Physical Sputtering by Particle Impact," *Nuc. Instrum. Methods Phys. Res.* 27:1-20.
Sirringhaus et al. (2000) "High-Resolution Inkjet Printing of All-Polymer Transistor Circuits," *Science* 290:2123-2126.
Smith et al. (2005) "Observation of Strong Direct-Like Oscillator Strength in the Photoluminescence of Si Nanoparticles," *Phys. Rev. B*72:205307.
Smith et al. (Web Release Jul. 11, 2002) "Spreading Diagrams for the Optimization of Quill Pin Printed Microarray Density," *Langmuir* 18(16):6289-6293.
Smith et al. (1993) "Continuous Ink-Jet Print Head Utilizing Silicon Micromachined Nozzles," *Sensors Actuators A* 43:311-316.
Son et al. (2005) "Formation of Pb/63Sn Solder Bumps Using a Solder Droplet Jetting Method," *IEEE Trans. Electron. Packag. Manufact.* 28(3):274-281.
Stachewicz et al. (Web Release Jan. 21, 2009) "Relaxation Times in Single Event Electrospraying Controlled by Nozzle Front Surface Modification," *Langmuir* 25(4):2540-2549.
Stachewicz et al. (Web Release Dec. 3, 2009) "Stability Regime of Pulse Frequency for Single Event Electrospraying," *Appl. Phys. Lett.* 95(22):224105.
Sturm et al. (Jul. 1998) "Patterning Approaches and System Power Efficiency Considerations for Organic LED Displays," SPIE Conference on Organic Light-Emitting Materials and Devices II, San Diego, California *Proceedings of SPIE* vol. 3476, p. 208-216.
Stutzmann et al. (2003) "Self-Aligned, Vertical Channel, Polymer Field Effect Transistors," *Science* 299:1881-1885.
Subramanian et al. (Dec. 2005) "Printed Organic Transistors for Ultra-Low-Cost RFID Applications," *IEEE Trans. Components Packag. Technol.* 28(4):742-747.
Sullivan et al. (2007) "Development of a Direct Three-Dimensional Biomicrofabrication Concept Based on Electrospraying a Custom Made Siloxane Sol," *Biomicrofluidics* 1:0341031-03410310.
Sun et al. (Web Release May 29, 2002) "Large-Scale Synthesis of Uniform Nanowires Through a Soft, Self-Seeding, Polyol Process," *Adv. Mater.* 14(11):833-837.
Sun et al. (Web Release Mar. 3, 2004) "Mechanistic Study on the Replacement Reaction Between Silver Nanostructures and Chloroauric Acid in Aqueous Medium," *J. Am. Chem. Soc.* 126(12):3892-3901.

(56) References Cited

OTHER PUBLICATIONS

Sun et al. (Dec. 5, 2006) "Controlled Buckling of Semiconductor Nanoribbons for Stretchable Electronics," *Nat. Nanotechnol*. 1:201-207.
Suryavanshi et al. (Web Release Feb. 21, 2006) "Probe-Based Electrochemical Fabrication of Freestanding Cu Nanowire Array," *Appl. Phys. Lett*. 88:083103.
Szczech et al. (2002) "Fine-Line Conductor Manufacturing Using Drop-On-Demand pzt Printing Technology," *IEEE Trans. Electron. Packaging Manufacturing* 25(1):26-33.
Tang et al. (Web Release Mar. 7, 2001) "Generation of Multiple Electrosprays Using Microfabricated Emitter Arrays for Improved Mass Spectrometric Sensitivity," *Anal. Chem*. 73(8):1658-1663.
Taylor G. (1969) "Electrically Driven jets," *Proc. Roy. Soc. Lond: Ser. A, Math Phys. Sci*. 313(1515):453-475.
Tseng et al. (2002) "A High-Resolution High-Frequency Monolithic Top-Shooting Microinjector Free of Satellite Drops—Part II: Fabrication, Implementation, and Characterization," *J. Microelectromechanical Syst*. 11(5):437-447.
Tseng et al. (2002) "A High-Resolution High-Frequency Monolithic Top-Shooting Microinjector Free of Satellite Drops—Part I: Concept, Design, and Model," *J. Microelectromechanical Syst*. 11(5):427-436.
Tzeng et al. (Web Release Apr. 24, 2006) "Templated Self-Assembly of Colloidal Nanoparticles Controlled by Electrostatic Nanopatterning on a $Si_3N_4/SiO_2/Si$ Electret," *Adv. Mater*. 18(9):1147-1151.
Uchiyama (1978) "Formulation of High-Speed Motion Pattern of a Mechanical Arm by Trial," *Trans. SICE* (*Soc. Instrum. Contr. Eng.*) 14 (6) (1978) 706-712 (in Japanese, English Abstract).
Volkman et al. (2003) Materials Research Society Symposium Proceedings; Warrendale, PA, p. 391.
Wang et al. (2006) "Solid Freeform Fabrication of Thin-Walled Ceramic Structures Using an Electrohydrodynamic Jet," *J Am Ceram Soc* 89(5):1727-1729.
Wang et al. (2006) "Low-Cost Fabrication of Submicron All Polymer Field Effect Transistors," *Appl. Phys. Lett*. 88:133502/1-133502/3.
Wang et al. (Web Release Apr. 25, 2005) "Polymeric Nanonozzle Array Fabricated by Sacrificial Template Imprinting," *Adv. Mater*. 17(9)1182-1186.
Wang et al. (Feb. 8,2004) "Dewetting of Conducting Polymer Inkjet Droplets on Patterned Surfaces," *Nature Materials* 3:171-176.
Wang et al. (2009) "Fully Voltage-Controlled Electrohydrodynamic Jet Printing of Conductive Silver Tracks with a Sub 100 μm Linewidth," *J. Appl. Phys*. 106:0249071-0249074.
Wang et al. (2005) "High Resolution Print-Patterning of a Nano-Suspension," *J. Nanoparticle Res*. 7:301-306.
Wickware et al. (2001) "Mass Spectroscopy: Mix and Match," *Nature* 413:869.
Williams et al. (1996) "Etch Rates for Micromachining Processing," *J. Microelectromech. Syst*. 5(4):256-269.
Williams et al. (2003) "Etch Rates for Micromachining Processing—Part II," *J. Microelectromech. Syst*. 12(6):761-778.
Wong et al. (2003) "Hydrogenated Amorphous Silicon Thin-Film Transistor Arrays Fabricated by Digital Lithography," *IEEE Electron Dev. Lett*. 24:577-579.
Wong et al. (2002) "Amorphous Silicon Thin-Film Transistors and Arrays Fabricated by Jet Printing," *Appl. Phys. Lett*.80(4):610-612.
Youn et al. (2009) "Electrohydrodynamic Micropatterning of Silver Ink Using Near Field Electrohydrodynamic Jet Printing with Tilted-Outlet Nozzle," *Appl. Phys. A* 96:933-938.
Yuan et al. (Apr. 2003) "MEMS-Based Piezoelectric Array," *Micoelectron. Eng*. 66:767-772.

Initial substrate level
Initial nozzle membrane profile
t * sec(e)
$h_o$
$h_n$
Final substrate level
a
e
t * cosec(e)
t
Nozzle membrane

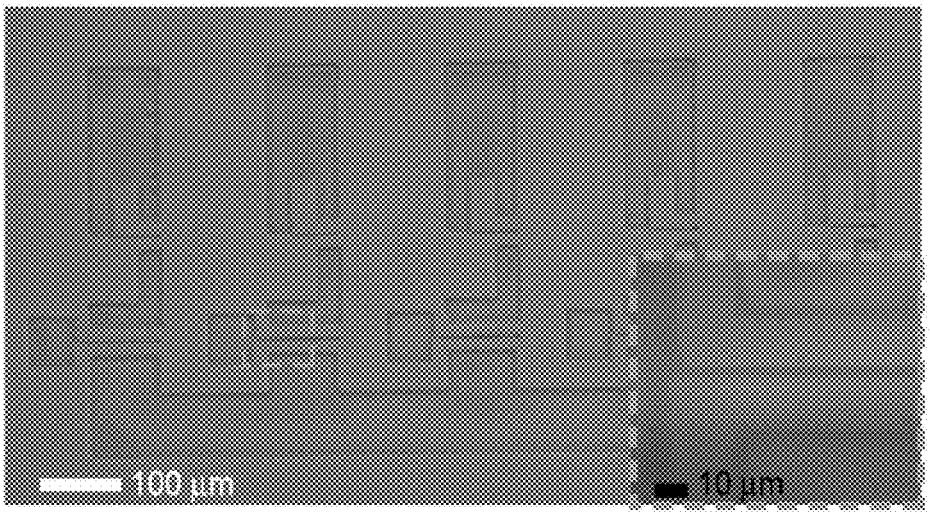
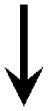
etching & stripping
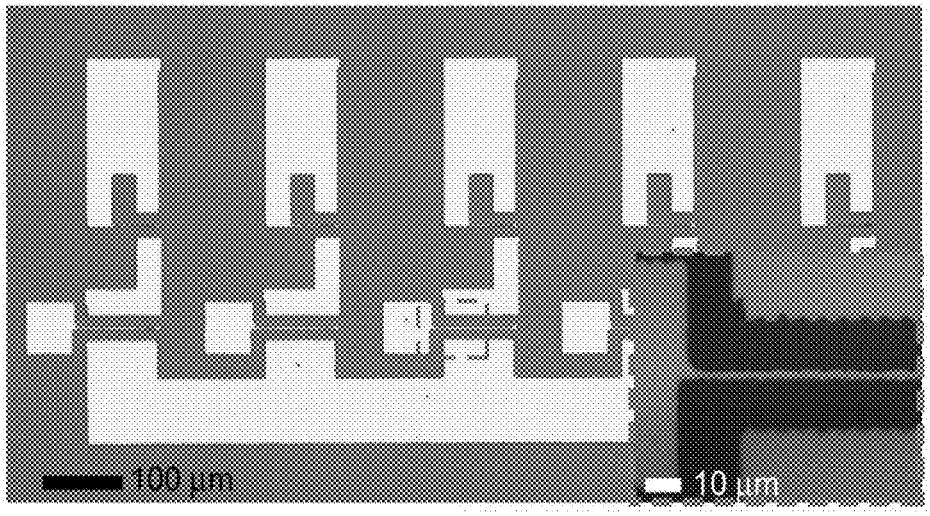
FIG. 25

C.

A.
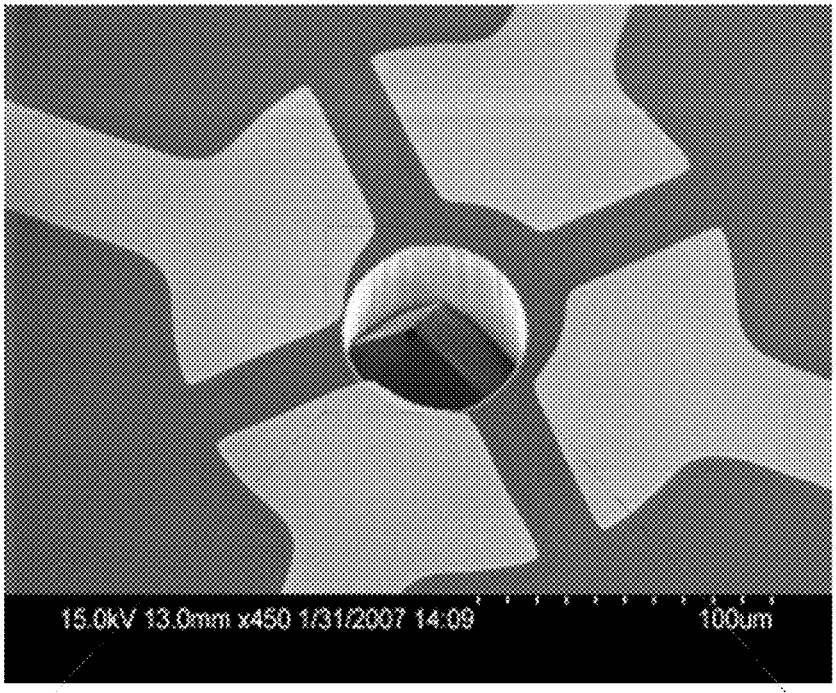
B.
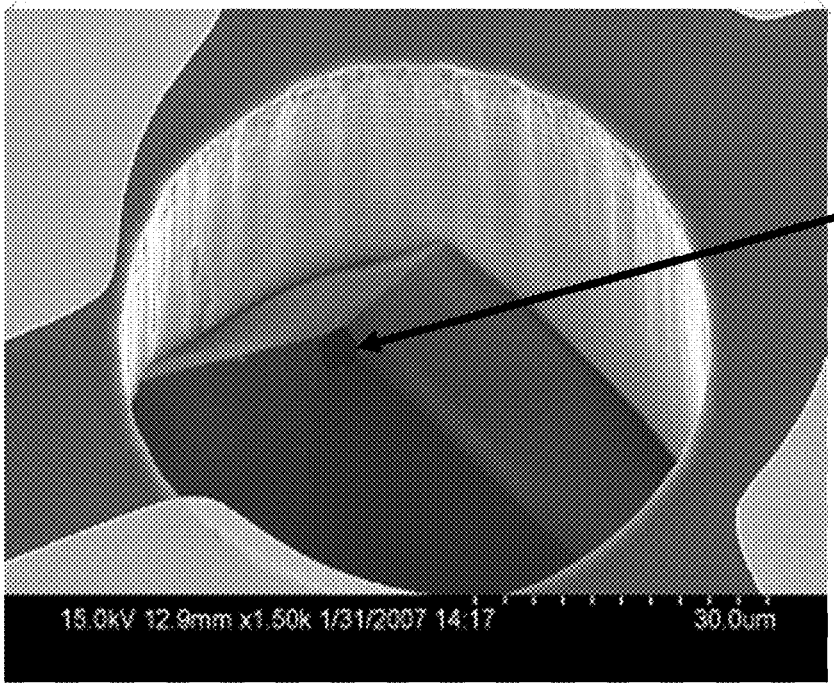
Nozzle orifice
FIG. 35

HIGH RESOLUTION ELECTROHYDRODYNAMIC JET PRINTING FOR MANUFACTURING SYSTEMS

CROSS-REFERENCE TO RELATED APPLICATIONS

This application is a divisional of U.S. application Ser. No. 12/669,287 filed Jan. 15, 2010, now U.S. Pat. No. 9,061,494, which is a national stage application of PCT App. No. PCT/US2007/077217 filed Aug. 30, 2007, which claims benefit of U.S. Provisional Patent Application 60/950,679 filed Jul. 19, 2007, each of which is individually incorporated by reference.

BACKGROUND OF THE INVENTION

Inkjet printing technology is well known for use in printing images onto paper. Inkjet technology is also used in the fabrication of printed circuits by directly printing circuit components onto circuit substrates. Inkjet printing-based approaches for high resolution manufacturing have inherent advantages and are of interest for a number of reasons. First, functional inks are deposited only where needed, and different functional inks are readily printed to a single substrate. Second, inkjet printing provides the ability to directly pattern wide classes of materials, ranging from fragile organics or biological materials that are incompatible with other established patterning methods such as photolithography. Third, inkjet printing is extremely flexible and versatile in that structure design changes are easily accommodated through software-based printing control systems. Fourth, inkjet printing is compatible with printing on large area substrates. Finally, inkjet systems are relatively low cost and have low operating cost. Such advantages are one reason why inkjet printing technology is used in a number of applications in electronics, information display, drug discovery, micromechanical devices and other areas.

Two common methods for jetting fluid from printheads are drop-on-demand and continuous inkjet. Two types of drop-on-demand ink jet printers that are commercially successful use thermal or piezoelectric means for ink printing. In both types, the liquid ink is transferred from a reservoir to paper substrate by applying a pressure to the reservoir, and printing occurs in an all-or-none fashion. In other words, they either print a dot at a fixed size when the reservoir pressure is above a threshold level, or do not print at all when the reservoir pressure is below a threshold level. The functional resolution of these conventional systems is limited to about 20 μm to 30 μm. A third class of inkjet printing systems is known as electrohydrodynamic printing.

Electrohydrodynamic jet (e-jet) printing is different from the inkjet printers that rely on thermal or piezoelectric pressure generating means. E-jet printing uses electric fields, rather than the traditional thermal or acoustic-based ink jet systems, to create fluid flows to deliver ink to a substrate (e.g., see U.S. Pat. Nos. 5,838,349; 5,790,151). E-jet systems known in the art are generally limited to providing droplets having diameter greater than 15 μm using nozzle diameters that are greater than 50 μm. The general set-up for e-jet printing involves establishing an electric field between a nozzle containing ink and the paper to which the ink is transferred. This can be accomplished by connecting each of a platen and the nozzle to a voltage power supply, and resting electrically conductive paper against the platen. A voltage pulse is created between the platen and the nozzle, creating a distribution of electrical charge on the ink. At a voltage pulse that exceeds a threshold voltage, the electric field causes a jet of ink to flow from the nozzle onto the paper, either in the form of a continuous ink stream or a sequence of discrete droplets.

E-jet processes are generally linear, unlike the thermal or piezoelectric processes, in that the amount of ink transferred is proportional to the amplitude and duration of the voltage difference. Accordingly, e-jet printing offers the capability of modulating the size of individual dots or pixels to generate high-quality images of comparable quality to expensive dye diffusion printers. U.S. Pat. No. 5,838,349 recognizes the difficulty of e-jet printing onto insulating materials and multiple color printing onto a single surface by improper registration (caused by charge retainment of printed ink affecting nearby subsequent printing), and proposes overcoming registration issues by providing a means to ensure uniform charge on the substrate surface to be printed. In that system, the printing nozzle is about 0.5 to 1.0 mm from the platen with an inside nozzle diameter ranging from 0.1 mm to 0.3 mm.

Typically, in the graphical arts applications e-jet printing involves printing inks that are pigments from a nozzle having a diameter of about 40 μm or greater to generate a printed dot diameter that is at best, about 20 μm or greater. Typically, the voltage is about 1.5 kV at a stand-off distance of about 500 μm. In manufacturing applications, inks are often metal and $SiO_2$ nanoparticles, cells, CNTs (carbon nanotubes), etc that are printed from a nozzle having a diameter about 50 μm or greater, generating a printed line having a width that is at best about 20 μm or greater. Similarly, the voltage is about 1.5 kV with a stand-off distance of about 300 μm or greater. See, e.g., Appl Phys Lett. 90 081905 (2007), 88, 154104 (2006); Lab Chip. 6, 1086 (2006); Chem. Eng. Sci. 61, 3091 (2006); Guld Bull. 39, 48 (2006); J. Nano. Res. 7, 301 (2005); J. Imaging Sci. 49, 19 (2005); IS&Ts NIP. 15, 319 (1999) and 14, 36 (1998); Recent Progress in Inkjet II. 286 (1999); IBM Report. RJ8311, 75672 (1991). Because of potential adverse effects such as nozzle clogging, it is believed that there are disadvantages to decreasing nozzle diameter less than about 30 μm. For example, in many ink jet printing applications using electrohydrodynamic-generated printing, the nozzle diameter from which ink is ejected is on the order of 0.0065 inches (165 μm) (See, e.g., U.S. Pat. No. 5,790,151)

In a number of applications, lines or smallest gaps that can be reliably created is about 20 to 30 μm. This resolution limit is due to the combined effects of droplet diameters that are usually no smaller than about 10 to 20 μm (corresponding to 2-10 pL) and placement errors that are typically plus or minus about 10 μm at standoff distances of about 1 mm. Through the use of separate patterning systems and processing steps, the resolution may be decreased to the sub-micron level. For example, lithographic processing of the substrate surface that is to be printed may assist in localizing features into certain preferred locations. The ink that is being printed may be surface functionalized prior to printing. The substrate may be processed in patterns of hydrophobicity or wettability, or have relief features for confining and guiding the flow of droplets as they land on the substrate surface. Accordingly, printed features may achieve, when combined with one or more of such processing features, sub-micron resolution. Those additional steps, however, do not provide a general approach to achieving high resolution in that they must be tailored for each printing system. Furthermore, they require separate patterning systems and processing systems adding to manufacturing expense and time.

Accordingly, there is a need in the art for e-jet systems capable of providing high-resolution patterning and for fabricating devices in a range of applications (e.g., electronics) by using functional or sacrificial inks.

SUMMARY OF THE INVENTION

Traditional ink jet printing methods are inherently limited with respect to applications requiring high resolution. For example, additional processing steps are required to obtain high-resolution printing (e.g., less than 20 μm resolution). In particular, the substrate to be printed may be subjected to pre-processing, such as by photolithography-based pre-patterning to assist placement, guiding and confining of ink placement. Embodiments of the systems and methods disclosed herein provide for direct high-resolution printing (e.g., better than 20 μm), without a need for such substrate surface processing. Methods and systems disclosed herein are further capable of providing resolution in the sub-micron range by electrohydrodynamic inkjet (e-jet) printing. The methods and systems are compatible with a wide range of printing fluids including functional inks, fluid suspensions containing a functional material, and a wide range of organic and inorganic materials, with printing in any desired geometry or pattern. Furthermore, manufacture of printed electrodes for functional transistors and circuits demonstrate the methods and systems are particularly useful in manufacture of electronics, electronic devices and electronic device components. The methods and devices are optionally used in the manufacture of other device and device components, including biological or chemical sensors or assay devices.

The devices and methods disclosed herein recognize that by maintaining a smaller nozzle size, the electric field can be better confined to printing placement and access smaller droplet sizes. Accordingly, in an aspect of the invention, the ejection orifices from which printing fluid is ejected are of a smaller dimension than the dimensions in conventional inkjet printing. In an aspect the orifice may be substantially circular, and have a diameter that is less than 30 μm, less than 20 μm, less than 10 μm, less than 5 μm, or less than less than 1 μm. Any of these ranges are optionally constrained by a lower limit that is functionally achievable, such as a minimum dimension that does not result in excessive clogging, for example, a lower limit that is greater than 100 nm, 300 nm, or 500 nm. Other orifice cross-section shapes may be used as disclosed herein, with characteristic dimensions equivalent to the diameter ranges described. Not only do these small nozzle diameters provide the capability of accessing ejected and printed smaller droplet diameters, but they also provide for electric field confinement that provides improved placement accuracy compared to conventional inkjet printing. The combination of a small orifice dimension and related highly-confined electric field provides high-resolution printing.

In an embodiment, the electrohydrodynamic printing system has a nozzle with an ejection orifice for dispensing a printing fluid onto a substrate having a surface facing the nozzle. A voltage source is electrically connected to the nozzle so that an electric charge may be controllably applied to the nozzle to cause the printing fluid to be correspondingly controllably deposited on the substrate surface. Because an important feature in this system is the small dimension of the ejection orifice, the orifice is optionally further described in terms of an ejection area corresponding to the cross-sectional area of the nozzle outlet. In an embodiment, the ejection area is selected from a range that is less than 700 $\mu m^2$, or between 0.07 $\mu m^2$-0.12 $\mu m^2$ and 700 $\mu m^2$. Accordingly, if the ejection orifice is circular, this corresponds to a diameter range that is between about 0.4 μm and 30 μm. If the orifice is substantially square, each side of the square is between about 0.35 μm and 26.5 μm. In an aspect, the system provides the capability of printing features, such as single ion and/or quantum dot (e.g., having a size as small as about 5 nm).

In an embodiment, any of the systems are further described in terms of a printing resolution. The printing resolution is high-resolution, e.g., a resolution that is not possible with conventional inkjet printing known in the art without substantial pre-processing steps. In an embodiment, the resolution is better than 20 μm, better than 10 μm, better than 5 μm, better than 1 μm, between about 5 nm and 10 μm, between 100 nm and 10 μm or between 300 nm and 5 μm. In an embodiment, the orifice area and/or stand-off distance are selected to provide nanometer resolution, including resolution as fine as 5 nm for printing single ion or quantum dots having a printed size of about 5 nm, such as an orifice size that is smaller than 0.15 $\mu m^2$.

The smaller nozzle ejection orifice diameters facilitate the systems and methods of the present invention to have smaller stand-off distances (e.g., the distance between the nozzle and the substrate surface) which lead to higher accuracy of droplet placement for nozzle-based solution printing systems such as inkjet printing and e-jet printing. However, an ink meniscus at a nozzle tip that directly bridges onto a substrate or a drop volume that is simultaneously too close to both the nozzle and substrate can provide a short-circuit path of the applied electric charge between the nozzle and substrate. This liquid bridge phenomena can occur when the stand-off-distance becomes smaller than two times of the orifice diameter. Accordingly, in an aspect the stand-off distance is selected from the range larger than two times the average orifice diameter. In another aspect, the stand off distance has a maximum separation distance of 100 μm The nozzle is made of any material that is compatible with the systems and methods provided herein. For example, the nozzle is preferably a substantially non-conducting material so that the electric field is confined in the orifice region. In addition, the material should be capable of being formed into a nozzle geometry having a small dimension ejection orifice. In an embodiment, the nozzle is tapered toward the ejection orifice. One example of a compatible nozzle material is microcapillary glass. Another example is a nozzle-shaped passage within a solid substrate, whose surface is coated with a membrane, such as silicon nitride or silicon dioxide.

Irrespective of the nozzle material, a means for establishing an electric charge to the printing fluid within the nozzle, such as fluid at the nozzle orifice or a drop extending therefrom, is required. In an embodiment, a voltage source is in electrical contact with a conducting material that at least partially coats the nozzle. The conducting material may be a conducting metal, e.g., gold, that has been sputter-coated around the ejection orifice. Alternatively, the conductor may be a non-conducting material doped with a conductor, such as an electroconductive polymer (e.g., metal-doped polymer), or a conductive plastic. In another aspect, electric charge to the printing fluid is provided by an electrode having an end that is in electrical communication with the printing fluid in the nozzle.

In another embodiment, the substrate having a surface to-be-printed rests on a support. Additional electrodes may be electrically connected to the support to provide further localized control of the electric field generated by supplying a charge to the nozzle, such as for example a plurality of independently addressable electrodes in electrical communication with the substrate surface. The support may be electrically conductive, and the voltage source provided in electrical contact with the support, so that a uniform and highly-confined electric field is established between the nozzle and the substrate surface. In an aspect, the electric potential provided to the support is less than the electric potential of the printing fluid. In an aspect, the support is electrically grounded.

The voltage source provides a means for controlling the electric field, and therefore, control of printing parameters such as droplet size and rate of printing fluid application. In an embodiment, the electric field is established intermittently by intermittently supplying an electric charge to the nozzle. In an aspect of this embodiment, the intermittent electric field has a frequency that is selected from a range that is between 4 kHz and 60 kHz. Furthermore, the system optionally provides spatial oscillation of the electric field. In this manner, the amount of printing fluid can be varied depending on the surface position of the nozzle. The electric field (and frequency thereof) may be configured to generate any number or printing modes, such as stable jet or pulsating mode printing. For example, the electric field may have a field strength selected from a range that is between 8 V/μm and 10 V/μm, wherein the ejection orifice and the substrate surface are separated by a separation distance selected from a range that is between about 10 μm and 100 μm.

Conventional e-jet printers deposit printed ink having a charge on a substrate. This charge can be problematic in a number of applications due to the charge having an unwanted influence on the physical properties (e.g., electrical, mechanical) of the structures or devices that are printed or later made on the substrate. In addition, the printed inks can affect the deposition of subsequently printed droplets due to electrostatic repulsion or attraction. This can be particularly problematic in high-resolution printing applications. To minimize charged droplet deposition, the potential or biasing of the system is optionally rapidly reversed such as, for example, changing the voltage applied to the nozzle from positive to negative during printing so that the net charge of printed material is zero or substantially less than the charge of a printed droplet printed without this reversal.

Any of the devices and methods described herein optionally provides a printing speed. In an embodiment, the nozzle is stationary and the substrate moves. In an embodiment, the substrate is stationary and the nozzle moves. Alternatively, both the substrate and nozzle are capable of independent movement including, but not limited to, the substrate moving in one direction and the nozzle moving in a second direction that is orthogonal to the substrate. In an embodiment the support is operationally connected to a movable stage, so that movement of the stage provides a corresponding movement to the support and substrate. In an aspect, the stage is capable of translating, such as at a printing velocity selected from a range that is between 10 μm/s and 1000 μm/s.

In an embodiment, the substrate comprises a plurality of layers. For example, a layer of $SiO_2$ and a layer of Si. In an embodiment, the surface to be printed comprises a functional device layer. In this embodiment, a resist layer may be patterned by the e-jet printing system on the device layer or a metal layer that coats the device layer, thereby protecting the underlying patterned layer from subsequent etching steps. Subsequent etching or processing provides a pattern of functional features (e.g., interconnects, electrodes, contact pads, etc.) on a device layer substrate. Alternatively, in an embodiment, Si wafers without an $SiO_2$ layer, or a variety of metals are the substrates, where these substrates also function as the bottom conducting support. Any dielectric material may be used as the substrate, such as a variety of plastics, glasses, etc., as those dielectrics may be positioned on the top surface of a conducting support (e.g., a metal-coated layer).

Different classes of printing fluids are compatible with the devices and systems disclosed herein. For example, the printing fluid may comprise insulating and conducting polymers, a solution suspension of micro and/or nanoscale particles (e.g., microparticles, nanoparticles), rods, or single walled carbon nanotubes, conducting carbon, sacrificial ink, organic functional ink, or inorganic functional ink. The printing fluid, in an embodiment, has an electrical conductivity selected from a range that is between $10^{-13}$ S/m and $10^{-3}$ S/m. In an embodiment, the functional ink comprises a suspension of Si nanoparticles, single crystal Si rods in 1-octanol or ferritin nanoparticles. The functional ink may alternatively comprise a polymerizable precursor comprising a solution of a conducting polymer and a photocurable prepolymer such as a solution of PEDOT/PSS (poly(3,4-ethylenedioxythiophene) and poly(styrenesulfonate)) and polyurethane. Examples of useful printing fluids are those that either contain, or are capable of transforming into upon surface deposition, a feature. In an aspect the feature is selected from the group consisting of a nanostructure, a microstructure, an electrode, a circuit, a biological material, a resist material and an electric device component. In an embodiment, the biologic material is one or more of a cell, protein, enzyme, DNA, RNA, etc. Controlled patterning of such materials are useful in any of a number of devices such as DNA, RNA or protein chips, lateral flow assays or other assays for detecting an analyte of interest. Any of the devices or methods disclosed herein may use a printing fluid containing any combination of the fluids and inks disclosed herein.

Further printing resolution and reliability is provided by a hydrophobic coating that at least partially coats the nozzle. Changing selected surface properties of the nozzle, such as generating an island of hydrophilicity by providing a hydrophobic coating around the exterior of the ejection orifice, prevents wicking of fluid around the nozzle orifice exterior.

In an embodiment, any of the systems may have a plurality of nozzles. In one aspect, the plurality of nozzles is at least partially disposed in a substrate, such as for an ejection orifice that at least partially protrudes from the substrate. A nozzle disposed in a substrate includes a hole that traverses from one substrate face to the opposing substrate face. This nozzle hole can be coated with a silicon dioxide or silicon nitride material to facilitate controlled printing. Each of the nozzles is optionally individually addressable. In an embodiment, each of the nozzle has access to a separate reservoir of printing fluid, so that different printing fluids may be printed simultaneously, such as by a microfluidic channel that transports the printing fluid from the reservoir to the nozzle. The microfluidic channel may be disposed within a polymeric material, and connected to the fluid reservoir at a fluid supply inlet port. The nozzle may be operationally combined with the polymeric-containing microfluidic channel in an integrated printhead.

In another embodiment of the invention, an electrohydrodynamic ink jet head having a plurality of physically spaced nozzles is provided. An electrically nonconductive substrate having an ink entry surface and an ink exit surface with a plurality of physically spaced nozzle holes extending through the ink exit surface. A voltage generating power supply is electrically connected with the nozzle. The nozzle holes have an ejection orifice to provide high-resolution printing. Such as orifices with an ejection area range selected from between 0.12 $\mu m^2$ and 700 $\mu m^2$, or a dimension between about 100 nm and 30 μm. An electrical conductor at least partially coats the nozzle to provide means for generating an electric charge at the ejection orifice. Any number of nozzles, having a nozzle density, may be provided. In an embodiment, the ink jet head has nozzle array with any number of nozzles, for example a total number of nozzles selected from between 100 and 1,000 nozzles. In an embodiment, the nozzles have a center to center separation distance selected from between 300 μm and 700 μm. In an embodiment, the nozzles are in a substrate having an ink exit surface area that is about 1 $inch^2$. Any of the multiple nozzle arrays optionally have a print resolution better than 20 μm, 10 or 100 nm. Any of the print resolutions are optionally defined by a lower print resolution such as 1 nm, 10 nm or 100 nm. In an embodiment, the print resolution selected from a range that is between 10 nm and 10 μm, 100 nm and 10 μm, or 250 nm and 10 μm.

In an embodiment, provided are various methods including methods related to the devices of disclosed herein. In an embodiment, any of the systems disclosed herein are used to deposit a feature onto a substrate surface by providing printing fluid to the nozzle and applying an electrical charge to the printing fluid in the nozzle. This charge generates an electrostatic force in the fluid that is capable of ejecting the printing fluid from said nozzle onto the surface to generate a feature (or a feature-precursor) on the substrate. A "feature precursor" refers to a printed substance that is subject to subsequent processing to obtain the desired functionality (e.g., a pre-polymer that polymerizes under applied ultraviolet irradiation).

In another embodiment, the invention provides a method of depositing a printing fluid onto a substrate surface by providing a nozzle containing printing fluid. Optionally, the nozzle has an ejection orifice area selected from a range that is less than 700 $\mu m^2$, between 0.07 $\mu m^2$ and 500 $\mu m^2$, or between 0.1 $\mu m^2$ and 700 $\mu m^2$. Optionally, the nozzle has a characteristic dimension that is less than 20 μm, less than 10 μm, less than 1 μm, or between 100 nm and 20 μm. A substrate surface to be printed is provided, placed in fluid communication with the nozzle and separated from each other by a separation distance. Fluid communication refers to that when an electric charge is applied to dispense fluid out of the nozzle orifice, the fluid subsequently contacts the substrate surface in a controlled manner. Optionally, the electric charge is applied intermittently. In an embodiment the electric charge is applied to provide a selected printing mode, such as a printing mode that is a pre-jet mode.

To provide improved printing capability, in an embodiment, a surfactant is added to the printing fluid to decrease evaporation when the fluid is electrostatically-expelled from the orifice. In another embodiment, at least a portion of the ejection orifice outer edge is coated with a hydrophobic material to prevent wicking of printing material to the nozzle outer surface. In an aspect, any of the devices disclosed herein may have a print resolution that is selected from a range that is between 100 nm and 10 μm. Any of the printed fluid on the substrate may be used in a device, such as an electronic or biological device.

In another embodiment, improved printing capability is achieved by providing a substrate assist feature on the surface to be printed, thereby improving placement accuracy and fidelity. Generally, substrate assist feature refers to any process or material connected to the substrate surface that affects printing fluid placement. The assist feature accordingly can itself be a feature, such as a channel that physically restricts location of a printed fluid, or a property, such as surface regions having a changed physical parameter (e.g., hydrophobicity, hydrophilicity). Alternatively, assist feature may itself not be directly connected to the surface to-be-printed, but may involve a change in an underlying physical parameter, such as electrodes connected to a support that in turn provides surface charge pattern on the substrate surface to be printed. Pattern of charge may optionally be provided by injected charge in a dielectric or semiconductor, etc. material in electrical communication with the surface to-be-printed. In an embodiment, any of these assist features are provided in a pattern on the substrate surface to printed, corresponding to at least a portion of the desired printed fluid pattern.

An alternative embodiment of this invention relates to an integrated-electrode nozzle where both an electrode and counter-electrode are connected to the nozzle. In this configuration, a separate electrode to the substrate or substrate support is not required. Normal electrojet systems require a conducting substrate which is problematic as it is often desired to print on dielectrics. Accordingly, it would be advantageous to integrate all electrode elements into a single print head. Such electrode-integrated nozzles provides a mechanism to address individual nozzles and an opportunity for fine control of deposition position not available in conventional systems. In an aspect, the integrated-electrode nozzle is made on a substrate wafer, such as a wafer that is silicon {100}. The nozzle may have a first electrode as described herein. The counter-electrode may be provided on a nozzle surface opposite (e.g., the outer surface that faces the substrate) the nozzle surface on which the first electrode is coated (e.g., inner surface that faces the printing fluid volume). In an embodiment the counter-electrode is a single electrode in a ring configuration through which printing fluid is ejected. Alternatively, the counter-electrode comprises a plurality of individually addressable electrodes capable of controlling the direction of the ejected fluid, thereby providing additional feature placement control. In an embodiment, the plurality of counter-electrodes together form a ring structure. In an embodiment, the number of counter electrodes is between 2 to 10, or is 2, 3, 4, or 5.

An alternative embodiment of the invention is a method of making an electrohydrodynamic ink jet having a plurality of ink jet nozzles in a substrate wafer, such as a wafer that is silicon {100}. The wafer may be coated with a coating layer, such as a silicon nitride layer, and further coated with a resist layer. Pre-etching the nozzle substrate wafer exposes the crystal plane orientation to provide improved nozzle placement. A mask having a nozzle array pattern is aligned with crystal plane orientation and the underlying wafer exposed in a pattern corresponding to the nozzle array pattern. This pattern is etched to generate an array relief features in the wafer corresponding to the desired nozzle array. The relief features are coated with a membrane, such as a silicon nitride or silicon dioxide layer, thereby forming a nozzle having a membrane coating. The side of the wafer opposite to the etched relief features is exposed and etched to expose a plurality of nozzle ejection orifices.

Providing a membrane coating with a lower etch rate than the wafer etch rate, provides the capability of generating ejection orifice that protrude from the substrate wafer. Any number of nozzles or nozzle density may be generated in this method. In an embodiment, the number of nozzles is between 100 and 1000. This procedure provides an ability to manufacture nozzles having very small ejection orifices, such as an ejection orifice with a dimension selected from between 100 nm and 10 μm.

The devices and methods disclosed herein provide the capacity of printing features, including nanofeatures or microfeatures, by e-jet printing with an extremely high placement accuracy, such as in the sub-micron range, without the need for surface pre-treatment processing.

DESCRIPTION OF THE DRAWINGS

FIG. 16 2500 nozzle array die with 500 nm nozzle opening capable of printing different inks simultaneously through individually addressable nozzles.

FIG. 25 is similar to FIG. 9 and emphasizes that the e-jet printing systems are capable of patterning a high-resolution polymer etch resist, and subsequent etching and stripping reveals a pattern of electrodes, such as a pattern for a 5-ring oscillator shown in the bottom panel.

FIG. 35 is a Scanning Electron Microscope (SEM) image of the fabricated nozzle with the embedded electrode and the counter-electrode is shown. A shows a four-electrode counter electrode configured in a ring geometry, with each electrode independently addressable. B is a close-up view of the central portion of the nozzle, showing the nozzle orifice as indicated.

DETAILED DESCRIPTION OF THE INVENTION

Figure 1:
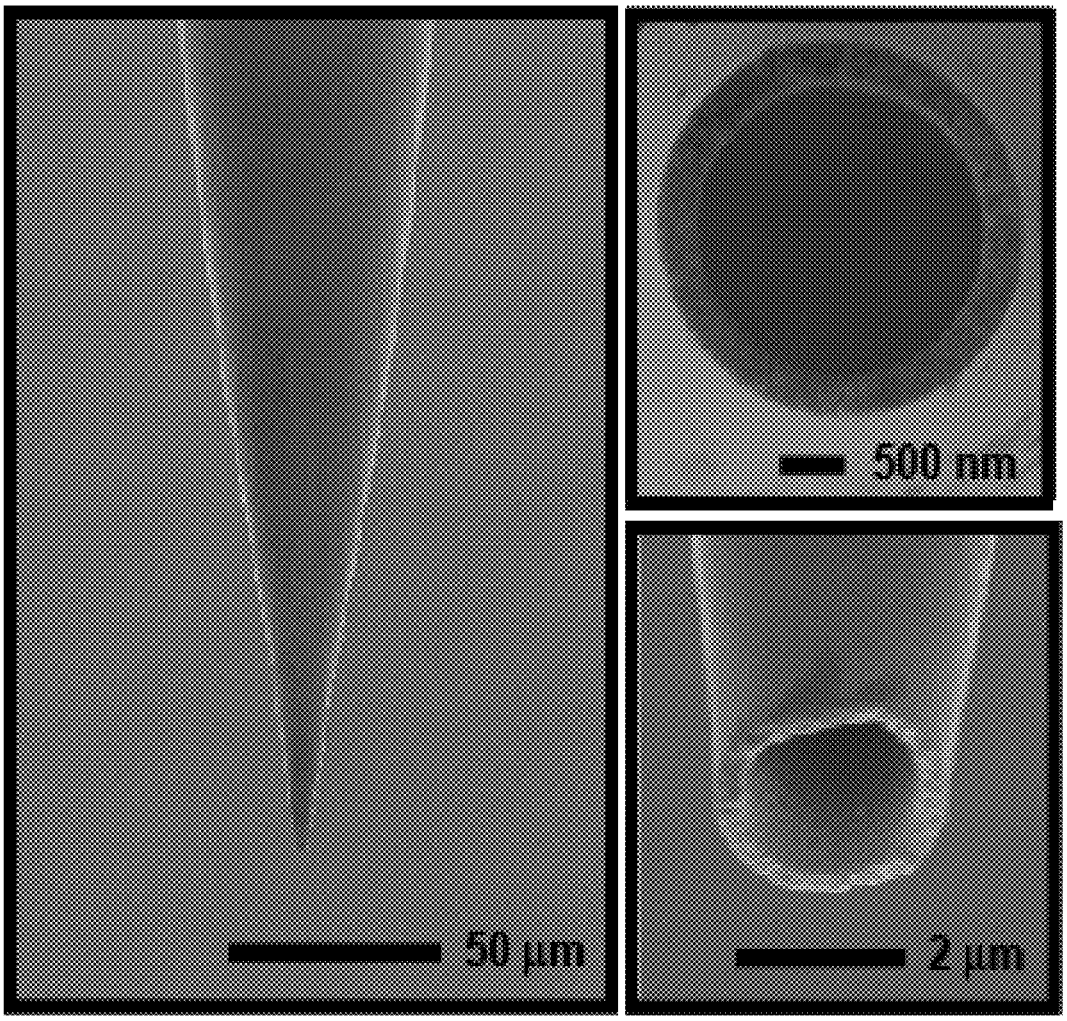
FIG. 1 SEM images of a gold-coated glass micro-capillary nozzle (2 μm ID) useful in a high resolution electrohydrodynamic jet (e-jet) printer. A thin film of surface functionalized Au coats the entire outer surface of the nozzle as well as interior near the tip. (A) is a side view, with the scale bar representing 50 μm. (B) and (C) are close-up views of the tip region from a cross-section and perspective view, respectively. In this example, the ejection orifice cross-section is circular with a diameter of about 2 μm.

"Electrohydrodynamic" refers to printing systems that eject printing fluid under an electric charge applied to the orifice region of the printing nozzle. When the electrostatic force is sufficiently large to overcome the surface tension of the printing fluid at the nozzle, printing fluid is ejected from the nozzle, thereby printing a surface.

"Ejection orifice" refers to the region of the nozzle from which the ink is capable of being ejected under an electric charge. The "ejection area" of the ejection orifice refers to the effective area of the nozzle facing the substrate surface to be printed and from which ink is ejected. In an embodiment, the ejection area corresponds to a circle, so that the diameter of the ejection orifice (D) is calculated from the ejection area (A) by: $D=4A/\pi$. A "substantially circular" orifice refers to an orifice having a generally smooth-shaped circumference (e.g., no distinct, sharp corners), where the minimum length across the orifice is at least 80% of the corresponding maximum length across the orifice (such as an ellipse whose major and minor diameters are within 20% of each other). "Average diameter" is calculated as the average of the minimum and maximum dimension. Similarly, other shapes are characterized as substantially shaped, such as a square, rectangle, triangle, where the corners may be curved and the lines may be substantially straight. In an aspect, substantially straight refers to a line having a maximum deflection position that is less than 10% of the line length.

"Printing fluid" or "ink" is used broadly to refer to a material that is ejected from the printing nozzle and having at least one feature or feature precursor that is to be printed on a surface. Different types of ink may be used, including liquid ink, hot-melt ink, ink comprising a suspension of a material in a volatile fluid. The ink may be an organic ink or an inorganic ink. An organic ink includes, for example, biological material suspended in a fluid, such as DNA, RNA, protein, peptides or fragments thereof, antibodies, and cells, or non-biological material such as carbon nanotube suspensions, conducting carbon (see, e.g., SPI Supplies® Conductive Carbon Paint, Structure Probe, Inc., West Chester, Pa.), or conducting polymers such as PEDOT/PSS. Inorganic ink, in contrast, refers to ink containing suspensions of inorganic materials such as fine particulates comprising metals, plastics, or adhesives, or solution suspensions of micro or nanoscale solid objects. A "functional ink" refers to an ink that when printed provides functionality to the surface. Functionality is used broadly herein that is compatible with any one or more of a wide range of applications including surface activation, surface inactivation, surface properties such as electrical conductivity or insulation, surface masking, surface etching, etc. For ink having a volatile fluid component, the volatile fluid assists in conveying material suspended in the fluid to the substrate surface, but the volatile fluid evaporates during flight from the nozzle to the substrate surface or soon thereafter.

The particular ink and ink composition used in a system depends on certain system parameters. For example, depending on the substrate surface that is printed, e.g., whether the substrate is a dielectric or itself is a charged or a conducting material, influences the optimum electric properties of the fluid. Of course, the printing application restrains the type of ink system, for example, in biological or organic printing, the bulk fluid must be compatible with the biologic or organic component. Similarly, the printing speed and evaporation rate of the ink is another factor in selecting appropriate inks and fluids. Other hydrodynamic considerations involve typical flow parameters such as flow-rate, effective nozzle cross-sectional areas, viscosity, and pressure drop. For example, the effective viscosity of the ink cannot be so high that prohibitively high pressures are required to drive the flow.

Inks optionally are doped with an additive, such as an additive that is a surfactant. These surfactants assist in preventing evaporation to decrease clogging. Especially in systems with relatively small nozzle size, high volatility is associated with clogging. Surfactants assist in lowering overall volatility.

One important ink property is that the ink must be electrically conductive. For example, the ink should be of high-conductivity (e.g., between $10^{-13}$ and $10^{-3}$ S/m). Examples of suitable ink properties for continuous jetting are provided in U.S. Pat. No. 5,838,349 (e.g., electric resistivity between 106-1011 Ωcm; dielectric constant between 2-3; surface tension between 24-40 dyne/cm; viscosity between 0.4-15 cP; specific density between 0.65-1.2).

"Controllably deposited" refers to deposition of printing fluid in a pattern that is controlled by the user with well-defined placement accuracy. For example, the pattern may be a spatial-pattern and/or a magnitude pattern having a placement accuracy that is at least about 1 μm, or in the sub-micron range.

"Electric charge" refers to the voltage supply generated potential difference between the printing fluid within the nozzle (e.g., the fluid in the vicinity of the ejection orifice) and the substrate surface. This electric charge may be generated by providing a bias or electric potential to one electrode compared to a counter electrode. An electric charge establishes an electric field that results in controllable printing on a substrate surface. In an aspect, the electric charge is applied intermittently at a frequency. The pulsed voltage or electric charge may be a square wave, sawtooth, sinusoidal, or combinations thereof. Dot-size modulation is provided by varying one or more of the intensity electric charge and/or the duration of the pulse. As known in the art, the various system parameters are adjusted to ensure the desired printing mode as well as to avoid short-circuiting between the nozzle and substrate. The various printing modes include drop-on-demand printing, continuous jet mode printing, stable jet, pulsating mode, and pre-jet. Different printing modes are accessed by different applied electric field. If there is an imbalance between the electric-driven output flow and pressure-driven input flow, the printing mode is pulsating jet. If those two forces are balanced, the printing mode is by continuously ejected stable jet. In an embodiment, either of the pulsating or the stable jet modes are used in printing. In an embodiment, the printing is by pulsating jet mode as the stable jet mode may be difficult to precisely control to obtain higher printing resolutions, as small variations in applied field can cause significant affect on printing (e.g., too high causes "spraying", too low causes pulsation). In an embodiment, the electric field is pulsed, such as by using pulsed on/off voltage signals, thereby controlling the ejection period of droplets and obtaining drop-on-demand printing capability. In an embodiment, these pulses oscillate rapidly from positive to negative during printing in a manner that provides a zero net charge of printed material. In addition, in the embodiment where there is a plurality of counter-electrodes, the electric field may oscillate by applying electric charge to different electrodes in the plurality of electrodes along the direction of printing in a spatial and/or time-dependent manner.

"Printing resolution" refers to the smallest printed size or printed spacing that can be reliably reproduced. For example, resolution may refer to the distance between printed features such as lines, the dimension of a feature such as droplet diameter or a line width.

"Stand-off distance" refers to the minimum distance between the nozzle and the substrate surface.

"Electrical contact" refers to one element that is capable of effecting change in the electric potential of a second element. Accordingly, an electrode connected to a voltage source by a conducting material is said to be in electrical contact with the voltage source. "Electrical communication" refers to one element that is capable of affecting a physical force on a second element. For example, a charged electrode in electrical communication with a printing fluid that is electrically conductive, exerts an electrostatic force on that portion of the fluid that is in electrical communication. This force may be sufficient to overcome surface tension within the fluid that is at the ejection orifice, thereby ejecting fluid from the nozzle. Similarly, an electrode in electrical contact with a support is itself in electrical communication with a substrate surface not contacting the electrode when the electrode is capable of affecting a change in printed droplet position.

A substrate surface with a "controllable electric charge distribution" refers to a printing system that is capable of undergoing controllable spatial variation in the electric field strength on the surface of the substrate surface. Such control is a means of further improving charged droplet deposition. This distribution can be by controlling a plurality of independently-chargeable electrodes that are in electrical contact with the conductive support or electrical communication with the substrate surface.

In addition to the electric field or electric charge oscillating in a time-dependent manner, the electric field or charge may oscillate in a spatial-dependent manner. "Spatial oscillation" refers to the frequency of the field changing in a manner that is dependent on the geographical location of the printhead nozzle ejection orifice over the substrate surface. For example, in certain substrate locations it may be desirable to print larger-sized features, whereas in other locations it may be desirable to have smaller or no features. For example, the field may be oscillated spatially in the axis of patterning. Alternatively, or in combination, the printing speed may be manipulated to change the amount of fluid printed to an surface region.

The electrohydrodynamic printing systems are capable of printing features onto a substrate surface. As used herein, "feature" is used broadly to refer to a structure on, or an integral part of, a substrate surface. "Feature" also refers to the pattern generated on a substrate surface, wherein the geometry of the pattern of features is influenced by the deposition of the printing fluid. The term feature encompasses a material that is itself capable of subsequently undergoing a physical change, or causing a change to the substrate when combined with subsequent processing steps. For example, the patterned feature may be a mask useful in subsequent surface processing steps. Alternatively, the patterned feature may be an adhesive, or adhesive precursor useful in subsequent manufacturing processes. Patterned features may also be useful in patterning regions to generate relatively active and/or inactive surface areas. In addition, functional features (e.g. biologics, materials useful in electronics) may be patterned in a useful manner to provide the basis for devices such as sensors or electronics. Some features useful in the present invention are micro-sized structures (e.g., "microfeature" ranging from the order of microns to about a millimeter) or nano-sized structures (e.g., "nanostructure" ranging from on the order of nanometers to about a micron). The term feature, as used herein, also refers to a pattern or an array of structures, and encompasses patterns of nanostructures, patterns of microstructures or a pattern of microstructures and nanostructures. In an embodiment, a feature comprises a functional device component or functional device. Useful formation of patterns include patterns of functional materials such as relief structures, adhesives, electrodes, biological arrays (e.g., DNA, RNA, protein chips). The structure can be a three-dimensional pattern, having a pattern on a surface with a depth and/or height to the pattern. Accordingly, the term structure encompasses geometrical features including, but not limited to, any two-dimensional pattern or shape (circle, triangle, rectangle, square), three-dimensional volume (any two-dimensional pattern or shape having a height/depth), as well as systems of interconnected etched "channels" or deposited "walls." In an embodiment, the structures formed are "nanostructures." As used herein, "nanostructures" refer to structures having at least one dimension that is on the order of nanometers to about a micron. Similarly, "microstructure" refers to structures having at least one dimension that is on the order of microns, between 1 μm and 30 μm, between 1 μm and 20 μm, or between 1 μm and 10 μm. The systems provide printing resolutions and/or "placement accuracy" not currently practicable with existing systems without extensive additional surface pre-processing procedures. For example, the width of the line can be on the order of 100's of nm and the length can be on the order of microns to 1000's of microns. In an embodiment the nanostructure has one or more features that range from an order of hundreds of nm.

"Hydrophobic coating" refers to a material that coats a nozzle to change the surface-wetting properties of the nozzle, thereby decreasing wicking of printing fluid to the outer nozzle surface. For example, coating the outer surface of the ejection orifice provides an island of hydrophobicity that surrounds the pre-jetted droplet and decreases the meniscus size of the droplet by restricting liquid to an inner annular rim space. Accordingly, the printed droplet can be further reduced in size, thereby increasing printer resolution. Further optimization of the on/off rate of the electric field can provide droplets in the 100 nm diameter range.

In systems having a plurality of nozzles, one or more, or each of the nozzles may be "individually addressable." "Individually addressable" refers to the electric charge to that nozzle is independently controllable, thereby providing independent printing capability for the nozzle compared to other nozzles. Each of the nozzles may be connected to a source of printing fluid by a microfluidic channel. "Microfluidic channel" refers to a passage having at least one micron-sized cross-section dimension.

"Printing direction" refers to the path the printing fluid makes between the nozzle and the substrate on which the printing fluid is deposited. In an embodiment, direction is controlled by manipulating the electric field, such as by varying the potential to the counter-electrode. Good directional printing is achieved by employing a plurality of individually-addressable counter-electrodes, such as a plurality of electrodes arranged to provide a boundary shape, with the ejected printing fluid transiting through an inner region defined by the boundary. Energizing selected regions of the boundary provides a capability to precisely control the printing direction.

A substrate in "fluid communication" with a nozzle refers to the printing fluid within the nozzle being capable of being controllably transferred from the nozzle to the substrate surface under an applied electric charge to the region of the nozzle ejection orifice.

All references cited throughout this application, for example patent documents including issued or granted patents or equivalents; patent application publications; and non-patent literature documents or other source material are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

Every formulation or combination of components described or exemplified herein can be used to practice the invention, unless otherwise stated.

Whenever a range is given in the specification, for example, a temperature range, a size range, frequency range, field strength range, printing velocity range, a conductivity range, a time range, or a composition or concentration range, all intermediate ranges and subranges, as well as all individual values included in the ranges given are intended to be included in the disclosure. It will be understood that any subranges or individual values in a range or subrange that are included in the description herein can be excluded from the claims herein.

All patents and publications mentioned in the specification are indicative of the levels of skill of those skilled in the art to which the invention pertains. References cited herein are incorporated by reference herein in their entirety to indicate the state of the art as of their publication or filing date and it is intended that this information can be employed herein, if needed, to exclude specific embodiments that are in the prior art.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms. The invention illustratively described herein suitably may be practiced in the absence of any element or elements, limitation or limitations which is not specifically disclosed herein.

One of ordinary skill in the art will appreciate that starting materials, materials, reagents, synthetic methods, purification methods, analytical methods, assay methods, and methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

Methods and devices useful for the present methods can include a large number of optional device elements and components including, additional substrate layers, surface layers, coatings, glass layers, ceramic layers, metal layers, microfluidic channels and elements, motors or drives, actuators such as rolled printers and flexographic printers, handle elements, temperature controllers, and/or temperature sensors.

Example 1

High Resolution E-Jet System and Process Overview

Efforts to adapt and extend graphic arts printing techniques for demanding device applications in electronics, biotechnology and microelectromechanical systems have grown rapidly in recent years. This example describes the use of electrohydrodynamically-induced fluid flows through fine microcapillary nozzles for jet printing of patterns and functional devices with sub-micron resolution. Key aspects of the physics of this approach, which has some features in common with related but comparatively low-resolution techniques for graphic arts, are revealed through direct high speed imaging of the droplet formation processes. Printing of complex patterns of inks, ranging from insulating and conducting polymers, to solution suspensions of silicon nanoparticles and rods, to single walled carbon nanotubes, using integrated, computer-controlled printer systems illustrates some of the capabilities. High resolution, printed metal interconnects, electrodes and probing pads for representative circuit patterns and functional transistors with critical dimensions as small as 1 μm demonstrate applications in printed electronics.

Printing approaches used in the graphic arts, particularly those based on inkjet techniques, are of interest for applications in high resolution manufacturing due to attractive features that include (i) the possibility for purely additive operation, in which functional inks are deposited only where they are needed, (ii) the ability to pattern directly classes of materials such as fragile organics or biological materials that are incompatible with established patterning methods such as photolithography, (iii) the flexibility in choice of structure designs, where changes can be made rapidly through software based printer control systems, (iv) compatibility with large area substrates and (v) the potential for low cost operation. Conventional devices for inkjet printing rely on thermal or acoustic formation and ejection of liquid droplets through nozzle apertures. A growing number of reports describe adaptations of these devices with specialized materials in ink formats for applications in electronics, information display, drug discovery, micromechanical devices and other areas. The functional resolution in these applications, as defined by the narrowest continuous lines or smallest gaps that can be created reliably, is ~20-30 μm. This, somewhat coarse, resolution results from the combined effects of droplet diameters that are usually no smaller than ~10-20 μm (2~10 pL volumes) and placement errors that are typically ±10 μm at standoff distances of ~1 mm. Clever methods can avoid these limitations, for certain classes of features. For example, lithographically predefined assist features or surface functionalization of pre-printed inks in the form of patterns of wettability or surface relief can confine and guide the flow of the droplets as they land on the substrate. In this manner, gaps between printed droplets, for example, can be controlled at the sub-micron level. This capability is important for applications in electronics when such gaps define transistor channel lengths. These methods do not, however, offer a general approach to high resolution. In addition, they require separate patterning systems and processing steps to define the assist features.

Electrohydrodynamic jet (e-jet) printing is a technique that uses electric fields, rather than thermal or acoustic energy, to create the fluid flows necessary for delivering inks to a substrate. This approach has been explored for modest resolution applications (dot diameters ≥20 μm using nozzle diameters ≥50 μm) in the graphic arts. To our knowledge, it is unexamined for its potential to provide high resolution (i.e. <10 μm) patterning or to fabricate devices in electronics or other areas of technology by use of functional or sacrificial inks. This example introduces methods and materials for e-jet printing with resolution in the sub-micron range. Patterning of wide ranging classes of inks in diverse geometries illustrates some of the capabilities. Printed electrodes for functional transistors and representative circuit designs demonstrate applications in electronics. These results define some advantages and drawbacks of this approach, in its current form, compared to other ink printing techniques.

Figure 2:
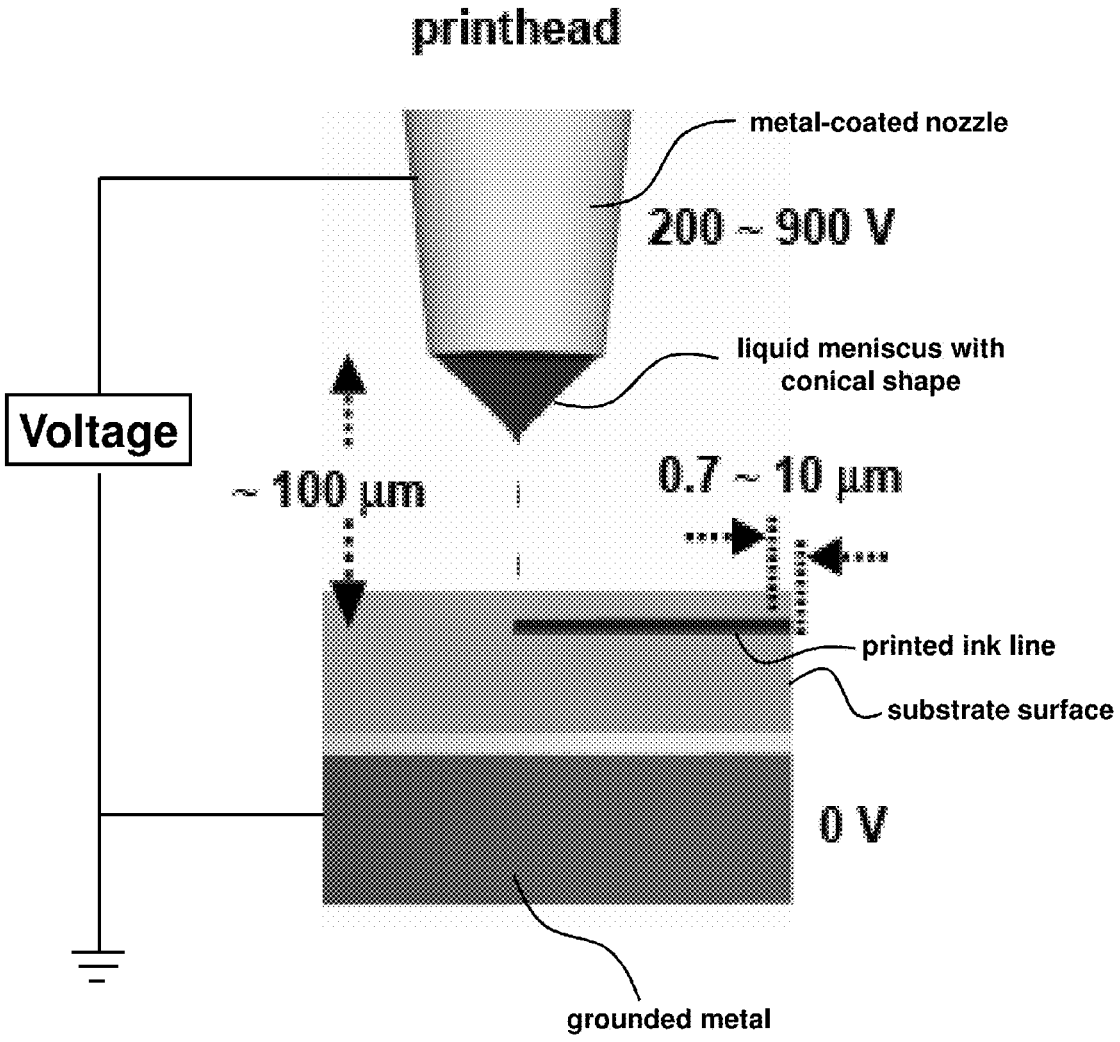
FIG. 2 is a schematic illustration of a nozzle and substrate configuration for printing. Ink ejects from the apex of the conical ink meniscus that forms at the tip of the nozzle due to the action of a voltage applied between the tip and ink, and the underlying substrate. These droplets eject onto a moving substrate to produce printed patterns. For this illustration, the substrate motion is to the right. Printed lines with widths as small as 700 nm can be achieved in this fashion.
Figure 3:
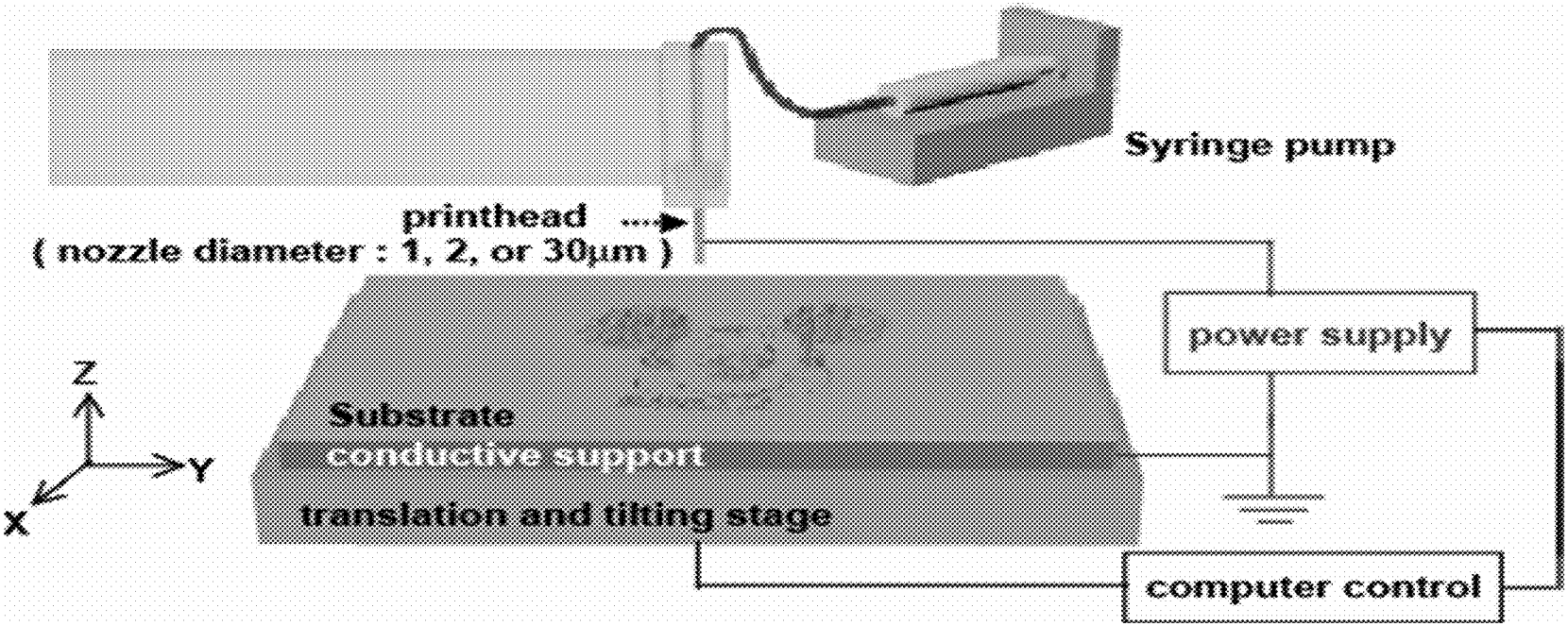
FIG. 3 Printer setup. A gold-coated nozzle (ID: 1, 2 or 30 μm) is positioned above a substrate that rests on a grounded electrode with a separation (H) of ~100 μm. A power supply is electrically connected to the nozzle and the electrode under the substrate. The substrate/electrode combination mounts on a 5-axis (X, Y, Z-axis and two tilting axis in X-Y plane) stage for printing.

FIG. 3 provides a schematic illustration of an embodiment of an e-jet printing system. A syringe pump connected to a glass microcapillary (see FIG. 1) (internal diameter (ID) between 0.5 and 30 μm and outer diameter (OD) between 1 and 45 μm) delivers fluid inks at low flow rates (<~30 pL/s) to the cleaved end of the capillary, which serves as a nozzle having an ejection orifice (see FIGS. 1 and 2). The details of the nozzle fabrication process are described in the Methods section. FIG. 1 shows scanning electron microscope (SEM) images of the nozzle and the nozzle opening ejection orifice. In this example, the ejection orifice is circular in cross-section (see FIG. 1 top right). A thin film of sputter deposited gold coats the entire outside of the microcapillary as well as the area around the nozzle and the inner surfaces near the tip. A hydrophobic self-assembled monolayer (1H,1H,2H,2H-perfluorodecane-1-thiol) formed on the gold limits the extent to which the inks wet the regions near the nozzle, thereby minimizing the probability for clogging and/or erratic printing behavior (see TABLE 1). We refer to this functionalized, gold coated microcapillary, mounted on a mechanical support fixture and connected to the syringe pump, as the e-jet printhead. The nozzles employed in these printheads have IDs that are much smaller than those used in previous work on e-jet printing 26-29, where the focus was on relatively low resolution applications in graphic arts. The small nozzle dimensions are critically important to achieving high resolution performance for device fabrication, for reasons described subsequently.

TABLE 1

Contact angles of various solutions on (a) gold surfaces and (b) 1H, 1H, 2H, 2H-perfluorodecane-1-thiol self-assembled monolayer formed gold surfaces.

| | Inks | |
|---|---|---|
| | (a) | (b) |
| $H_2O$ | 73° | 110° |
| 1-Octanol | 27° | 68° |
| aqueous SWNT solution (2 wt. % Triton X-405 is included) | 33° | 94° |
| UV-curable polyurethane precursor | 10° | 89° |
| diethylene glycol | 67° | 100° |

A voltage applied between the nozzle and a conducting support substrate creates electrohydrodynamic phenomena that drive flow of fluid inks out of the nozzle and onto a target substrate. This substrate rests on a metal plate that provides an electrically grounded conducting support. The plate, in turn, rests on a plastic vacuum chuck that connects to a computer-controlled, x, y and z axis translation stage. A 2-axis tilting mount on top of the translation stage provides adjustments to ensure that motion in x and y direction does not change the separation or stand-off distance (H, typically ~100 μm) between the nozzle tip and the target substrate. A DC voltage (V) applied between the nozzle and the metal plate with a computer controlled power supply generates an electric field that causes mobile ions in the ink to accumulate near the surface of the pendent meniscus at the nozzle. The mutual Coulombic repulsion between these ions induces a tangential stress on the liquid surface, thereby deforming the meniscus into a conical shape, known as Taylor cone[30] (see FIG. 4). At sufficiently high electric fields, this electrostatic (Maxwell) stress overcomes the capillary tension at the apex of the liquid cone; droplets eject from the apex to expel some portion of the surface charge (Rayleigh limit). Even very small ion concentrations are sufficient to enable this ejection process. For example, in uncontrolled spray modes, ejection is possible with liquids that have electrical conductivities that span ten decades[31], from $10^{-13}$ to $10^{-3}$ S $m^{-1}$. Coordinating the operation of the power supply with the system of translation stages enables direct write, e-jet printing of inks in arbitrary geometries (see FIGS. 2 and 3).

Figure 4:
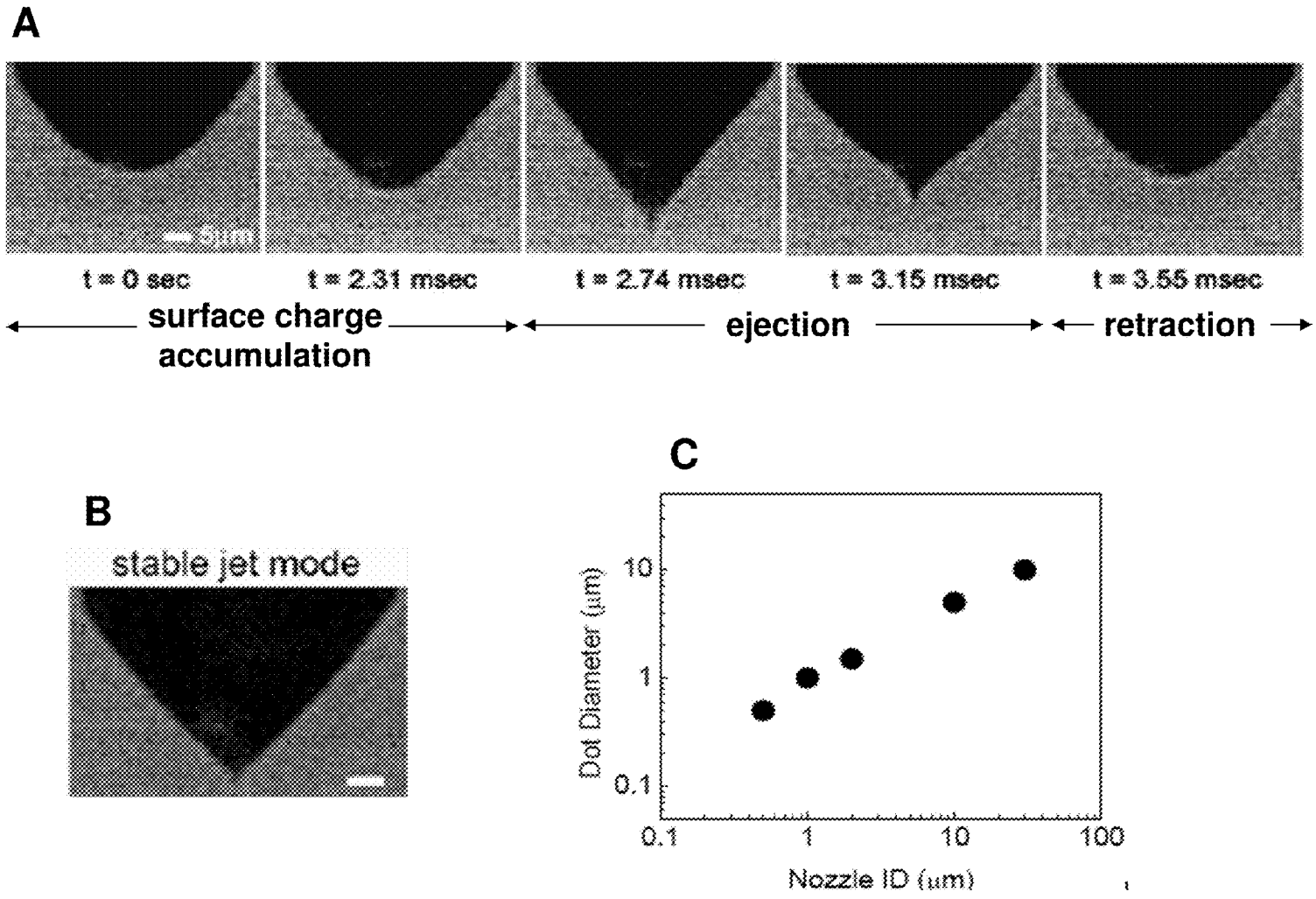
FIG. 4: Panel A shows time-lapse images (at t=0, 2.31, 2.74, 3.15, 3.55) of the pulsating liquid meniscus in one cycle at the condition of V/H=3.5 V/μm, where V is the applied voltage between the nozzle and substrate and H is the distance between the nozzle tip and substrate. Panel B is an image corresponding to the stable jet mode, which is achieved at V/H~9 V/μm for this system. These images were captured at a frame rate of 66,000 fps and exposure time of 11 μs, using a high-speed camera. The reference time (t=0) corresponds to the time at which the meniscus first reaches its fully retracted state. Scale bars correspond to 5 μm. Panel C is a plot of dot diameter as a function of nozzle inner diameter.

To understand the fundamental dynamics of this electric-field driven jetting behavior, a high speed camera (Phantom 630, 66000 fps) is used to image the process of Taylor cone deformation and droplet ejection directly at the nozzle. For these experiments, an aqueous ink of the blend of poly(3, 4-ethylenedioxythiophene) and poly(styrenesulfonate) (PEDOT/PSS) is used. The images, presented in FIG. 4, show that the meniscus at the nozzle orifice expands and contracts periodically due to the electric field. A complete cycle, which occurs in roughly 3-10 ms for this example, consists of stages of liquid accumulation, cone formation, droplet ejection, and relaxation[32]. The initial spherical meniscus at the nozzle tip changes gradually into a conical form due to the accumulation of surface charges. The radius of curvature at the apex of the cone decreases until the Maxwell stress matches the maximum capillary stress, resulting in charged fluid jet ejection. This ejection decreases the cone volume and charges, thereby reducing the electrostatic stress to values less than the capillary tension. The ejection then stops and the meniscus retracts to its original spherical shape. The apex of the cone can oscillate, leading to the ejection of multiple droplets in short bursts. The frequency of this oscillation, which is in kHz frequency range, increases in a nonlinear fashion with the electric field[33, 34]. After a period of ejection in the form of multiple pulsations similar to the cycle illustrated in FIG. 4A, the retracted spherical meniscus remains stable and largely unperturbed until the next period of ejection. This accumulation time depends on flow rate imposed by the syringe pump and on electrical charging times associated with the resistance and capacitance of the system.[33, 34]

Figure 5:
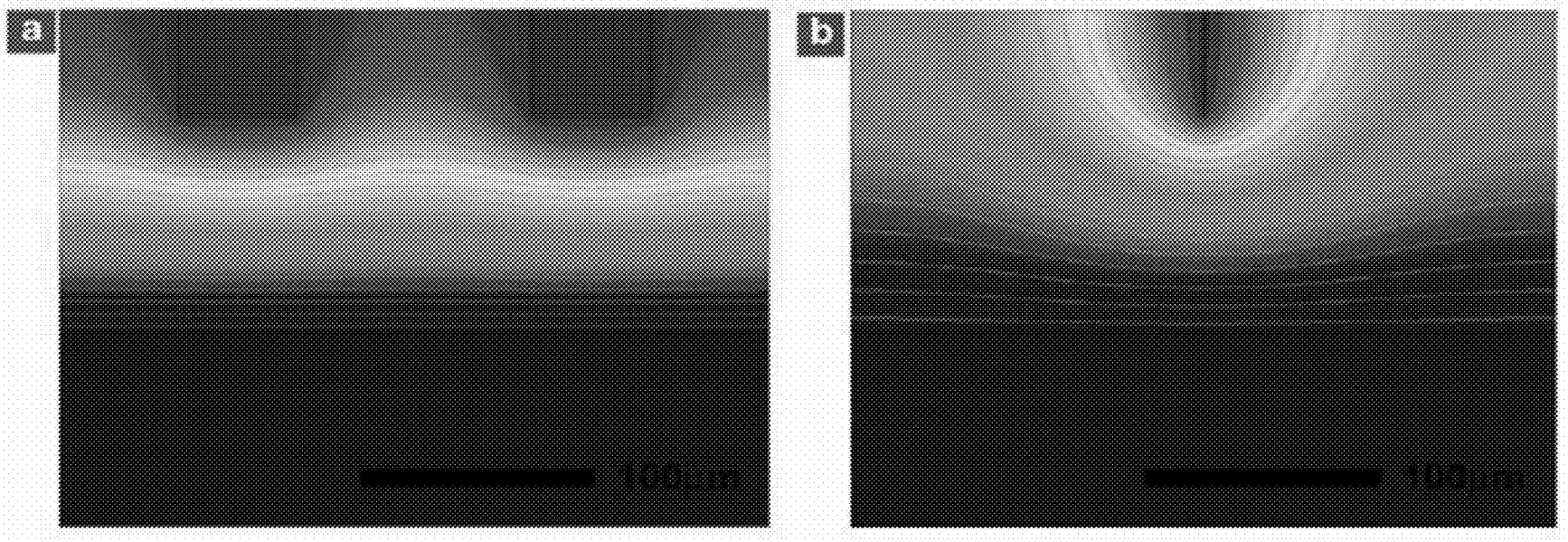
FIG. 5 Computation of electric potential and equipotential lines for a: (a) broad nozzle (ID: 100 μm, OD: 200 μm); and (b) fine nozzle (ID: 2 μm, OD: 3 μm). Color contour plots show the electric potential, and local electric field direction is normal to equipotential lines. The substrates are grounded, and the nozzles are biased with the same voltage.

At sufficiently high fields, a stable jet mode (as opposed to the pulsating mode described above) can be achieved. In this situation, a continuous stream of liquid emerges from the nozzle, as shown in FIG. 4B. At even higher fields, multiple jets can form, culminating ultimately in atomization mode (e-spray mode) of the type used in mass spectroscopy and other well established fields of application35, 36. For controlled, high resolution printing of the type introduced here, this mode is avoided. Either the stable jet or the pulsating modes can be used. The sensitivity of the stable jet mode to applied fields (too high results in uncontrolled spray, and too low results in pulsation) favors, in a practical sense, the pulsating operation. A key to achieving high resolution, from the standpoint of printhead design, is the use of fine nozzles with sharp tips. Such nozzles lead directly to small droplets/streams. The effect of nozzle ejection orifice diameter on printed dot diameter is shown in FIG. 4C. In addition, the low V and H values that result from electric field line focusing at the sharp tips of such nozzles and the distribution of the electric field lines themselves combine to minimize lateral variations in the placement of the droplets/streams on the printed substrate (FIG. 5).

A wide range of functional organic and inorganic inks, including suspensions of solid objects, can be printed using this approach, with resolutions extending to the sub-micron range. FIGS. 6*a* and 6*b* show dot matrix text patterns formed using a solution ink of a conducting polymer PEDOT/PSS and a photocurable polyurethane prepolymer (NOA 74, Norland Products) printed onto a SiO2 (300 nm)/Si substrate. FIGS. 6*c* and 6*d* show examples of printed inks that consist of suspensions of Si nanoparticles (average diameter: 3 nm)37 and single crystal Si rods (length: 50 μm, width: 2 μm, and thickness: 3 μm)38 dispersed in 1-octanol. The Si nanoparticles emit fluorescent light at 680 nm wavelength, as shown in FIG. 6*c*. Suspensions of ferritin nanoparticles can also be printed and then used as catalytic seeds for the chemical vapor deposition growth of single walled carbon nanotubes (SWNTs). FIG. 6*e* shows the results, in which the printing and growth occurred on an annealed ST-cut quartz substrate39, to yield well aligned individual SWNTs. For the structures printed onto SiO2/Si, the silicon formed the conducting support for printing. In the case of quartz, a metal supporting plate is used. Computer coordinated control of the power supply and the stages enables printing of complex patterns, such as digitized graphic images or circuit layouts. FIG. 6*f* shows a printed image of a cartoon character formed with an ink consisting of surfactant-stabilized SWNTs in water.40 From the point of uniformity in sizes of the printed dots, 97% of the total, even over the relatively large areas shown in this example (2.4×1.5 mm), have diameters between 8 and 14 μm (FIG. 7). For the results of FIGS. 6*a-f*, the nozzle ID is 30 μm and the substrates moved at speeds of ~100 μm s-1 (1 mm s-1 for FIGS. 6*a* and 6*b*). These conditions yield dot matrix versions of the images with ~10 μm in dot diameters. These dots are associated with the accumulation of multiple micro/nanodroplets ejected at the kHz level frequency in the pulsating mode; the separation between these dots corresponds to the accumulation time mentioned previously. For FIG. 6*d*, due to the low concentration of Si rods (~5 rods/nL), a relatively large drop diameter of ~100 μm is selected by applying the voltage for 100 ms with the nozzle held fixed.

Figure 6:
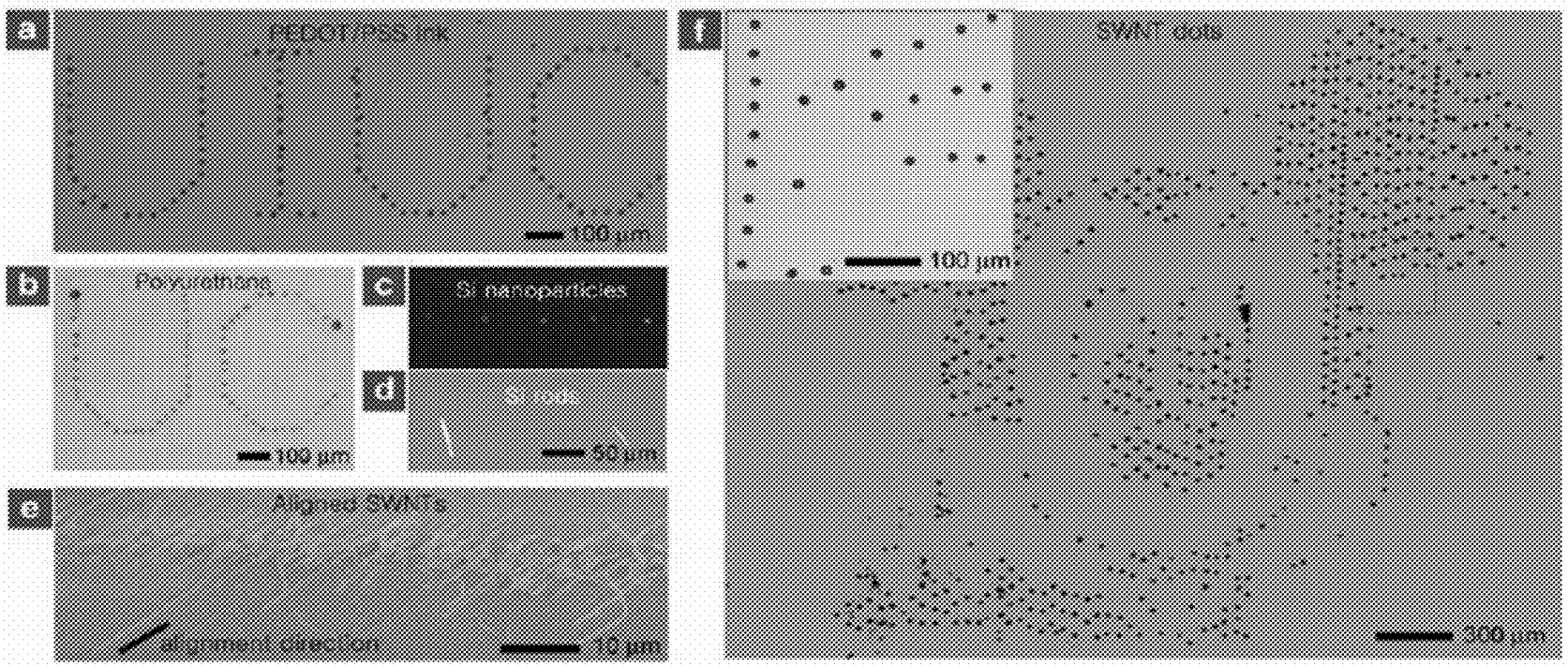
FIG. 6 are optical micrographs and SEM images of various images formed with different inks; (a) Letters printed with the conducting polymer PEDOT/PSS. The average dot diameter is 10 μm. (b) Letters printed with a photocurable polyurethane polymer with dot diameters of 10 μm. (c) Fluorescence optical micrograph (emission at 680 nm) of Si nanoparticles (average diameter of 3 nm) printed from a suspension in 1-octanol. The diameter of the printed dots is 4 μm. (d) Optical micrograph of single crystal Si rods (thickness: 3 μm, length: 50 μm, and width: 2 μm) printed from a suspension in 1-octanol. (e) SEM image of aligned SWNTs grown by CVD on quartz using printed patterns of ferritin as a catalyst. (f) Cartoon character image formed with printed dots (~11 μm diameters) of SWNTs from an aqueous solution. In all cases, nozzle ID is 30 μm.
Figure 7:
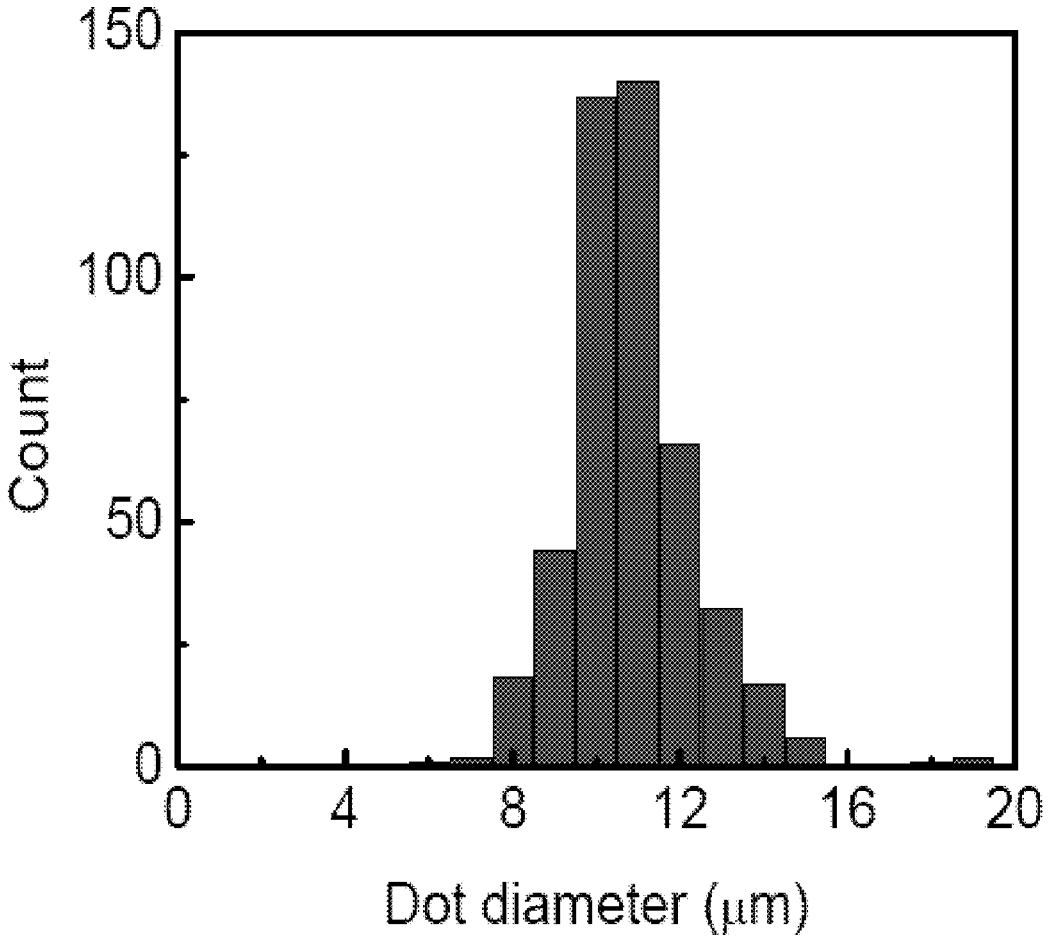
FIG. 7 is a plot of dot diameter distribution from the generated image of FIG. 4*f*. A total of 466 dots over the broad area (2.4×1.5 mm) shown in FIG. 6*f* are measured. Average dot diameter and standard deviation are 10.9 and 1.57 μm, respectively. 97% of the total has deviation range less than ±3 μm in diameter.
Figure 8:
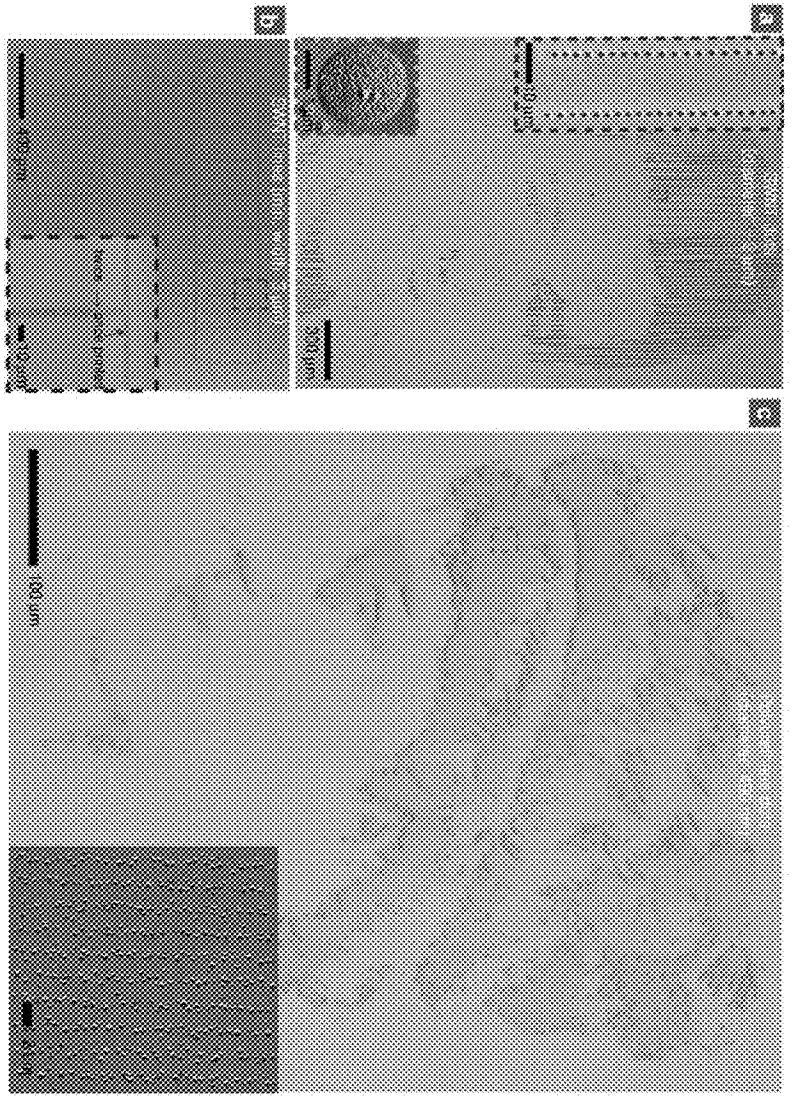
FIG. 8 High-resolution e-jet printing using nozzles with IDs of 2 μm (a-b) and 500 nm (c); (a) Optical micrograph of a portrait printed using a SWNT solution as the ink. The diameters of the dots are ~2 μm. The left-top inset in (a) is an SEM image of the printed dots from within the indicated area. The left-bottom inset in (a) is an AFM image of the printed SWNTs after removing the surfactant by heating at 500° C. for 30 min in Ar. (b) Continuous lines printed using the SWNT ink. The horizontal lines (widths: ~3 μm) are printed in a single pass, while the vertical lines (width: ~5 μm) are formed by printing in two passes. (c) Optical micrograph of a Hypatia portrait using a polyurethane. The right-bottom inset is an AFM image of the printed dots. Average dot diameter is 490 nm.

Although the ~10 μm feature sizes illustrated in FIG. 6 are suitable for various applications, the resolution can be improved by use of smaller nozzles. FIG. 8*a* presents a portrait image composed of 2 μm dots printed with a 2 μm ID nozzle and printing speed of 20 μm s-1. The inset in the upper left shows an SEM image of the printed SWNT ink. Removing the surfactant residue by heating at 500° C. in Ar for 5 hrs, left random networks of bare SWNTs, as shown in atomic force microscope (AFM) image in the left-bottom inset. Patterns of continuous lines and other shapes can be achieved by printing at stage translation speeds that allow the dots to merge. FIG. 8*b* presents patterns of lines printed onto a SiO2/Si substrate using the 2 μm ID nozzle and a printing speed of 10 μm s-1; the line widths, for single pass printing, are ~3 μm. The printing resolution can be enhanced further up to sub-micron scale dot diameters. FIG. 8*c* shows the e-jet printed portrait of Hypatia, an ancient philosopher from Alexandria, with average dot diameters as small as 490±220 nm using 500 nm ID nozzle. These results represent resolution that significantly exceeds conventional, unassisted thermal or piezoelectric type inkjet systems. The slight 'waviness' in the position of the sub-micron dots in FIG. 8*c* (inset) is due to the combined effects of mechanical instabilities in the long microcapillary used in the printhead and slight fluctuations associated with the e-jet process.

Forrest S. R. The path to ubiquitous and low-cost organic electronic applications on plastics, *Nature,* 428, 911-918 (2004).

Gans B. J., Duineveld P. C., & Schubert U. S. Inkjet printing of polymers: state of the art and future development. *Adv. Mater.* 16, 203-213 (2004).

Parashkov R., Becker E., Riedl T., Johannes H., & Kowalsky W. Large area electronics using printing method. *Proceedings of the IEEE,* 93, 1321-1329 (2005).

Chang P. C. et al. Film morphology and thin film transistor performance of solution-processed oligothiophenes. *Chem. Mater.* 16, 4783-4789 (2004).

Sirringhaus H. et al. High-resolution inkjet printing of all-polymer transistor circuits. *Science,* 290, 2123-2126 (2000).

Shimoda T. et al. Solution-processed silicon films and transistors. *Nature,* 440, 783-786 (2006).

Burns S. E., Cain P., Mills J., Wang J., & Sirringhaus H. Inkjet printing of polymer thin-film transistor circuits. *MRS Bulletin,* 28, 829-834 (2003).

Wong, W. S., Ready, S. E., Lu, J. P., & Street, R. A. Hydrogenated amorphous silicon thin-film transistor arrays fabricated by digital lithography. *IEEE Electron Device Letters,* 24, 577-579 (2003).

Szczech J. B., Megaridis C. M., Gamota D. R., & Zhang J. Fine-line conductor manufacturing using drop-on-demand PZT printing technology. *IEEE Transactions on Electronics Packaging Manufacturing,* 25, 26-33 (2002).

Shimoda T., Morii K., Seki S., & Kiguchi H., Inkjet printing of light-emitting polymer displays, *MRS Bulletin,* 28, 821-827 (2003).

Chang, S. C. et al. Multicolor organic light-emitting diodes processed by hybrid inkjet printing. *Adv. Mater.* 11, 734 (1999).

Hebner T. R., & Sturm J. C. Local tuning of organic light-emitting diode color by dye droplet application, *Appl. Phys. Lett.,* 73, 1775-1777 (1998).

Lemmo A. V., Rose D. J., & Tisone T. C. Inkjet dispensing technology: application in drug discovery, *Curr. Opin. Biotechol.* 9, 615-617 (1998)

Heller M. J. DNA microarray technology: devices, systems, and applications, *Annu. Rev. Biomed. Eng.* 4, 129-153 (2002).

Nallani A., Chen T., Lee J. B., Hayes D., & Wallace D. Wafer level optoelectronic device packaging using MEMS, *Proceedings of SPIE: Smart Sensors, Actuators, and MEMS II,* 5836, 116-127 (2005).

Bietsch A., Zhang J., Hegner M., Lang H. P., & Gerber C. Rapid functionalization of cantilever array sensors by inkjet printing, *Nanotechnology.* 15, 873-880 (2004).

Hiller J., Mendelsohn J. D., & Rubner M. F. Reversibly erasable nanoporous anti-reflection coatings from polyelectrolyte multilayers, *Nature Mater.* 1, 59-63 (2002).

Ling M. M., & Bao Z. Thin film deposition, patterning, and printing in organic thin film transistors. *Chem. Mater.* 16, 4824-4840 (2004).

Calvert P. Inkjet printing for materials and devices. *Chem. Mater.* 13, 3299-3305 (2001).

Sanaur S., Whalley A., Alameddine B., Carnes M., & Nuckolls C. Jet-printed electrodes and semiconducting oligomers for elaboration of organic thin-film transistors. *Organic Electronics,* 7, 423-427 (2006).

Cheng K. et al. Inkjet printing, self-assembled polyelectrolytes, and electroless plating: low cost fabrication of circuits on a flexible substrate at room temperature. *Macromol. Rapid Commun.* 26, 247-264 (2005).

Creagh L. T., & McDonald M. Design and performance of inkjet printheads for non graphic arts applications. *MRS Bulletin,* 28, 807 (2003).

Wang J. Z., Gu J., Zenhausern F., & Sirringhaus H. Low-cost fabrication of submicron all polymer field effect transistors, *Appl. Phys. Lett.* 88, 133502/1-133502/3 (2006).

Stutzmann N., Friend R. H., & Sirringhaus H. Self-aligned, vertical channel, polymer field effect transistors, *science,* 299, 1881-1885 (2003).

Sele C. W., Werne T., Friend R. H., & Sirringhaus H. Lithography-free, self-aligned inkjet printing with sub-hundred nanometer resolution, *Adv. Mater.* 17, 997-1001 (2005).

Mills R. S. ESIJET™ Printing Technology. *Recent Progress in Ink Jet Technologies II,* 286-290 (1999).

Nakao H., Murakami T., Hirahara S., Nagato H., Nomura Y. Head Design for Novel Ink-Jet Printing using Electrostatic Force, IS&Ts NIP15: 1999 International Conference on Digital Printing Technologies, 319-322 (1999).

Choi D. H., Lee F. C. Continuous-Tone Color Prints by the Electrohydrodynamic Ink-Jet Method, *Proc. Of IS&T's Ninth International Congress on Advances in Non-Impact Printing Technoloies*., Yokohama, Japan, October 4-8 (1993).

Kawamoto H., Umezu S., Koizumi R. Fundamental Investigation on Electrostatic Ink Jet Phenomena in Pin-to-Plate Discharge System, *J. imaging Sci. Technol.,* 49, 19-27 (2005).

Rayleigh L., On the Capillary Phenomena of Jets, *Proc. R. Soc. Lond.* 29, 71-97 (1879).

Jayasinghe S. N. & Edirisinghe M. J. Electric-field driven jetting from dielectric liquids, *Appl. Phys. Lett.* 85, 4243 (2004).

Marginean I., Parvin L., Heffernan L. & Vertes A. Flexing the electrified meniscus: the birth of a jet in electrosprays. *Anal. Chem.* 76, 4202-4207 (2004).

Chen C. H., Saville D. A., & Aksay I. A. Scaling law for pulsed electrohydrodynamic drop formation. *Appl. Phys. Lett.* 89, 124103 (2006)

Hayati I., Bailey A. I., & Tadros T. F. Investigations into mechanisms of electrohydrodynamic spraying of liquids. *J. Colloid Interf. Sci.* 117, 205-221 (1987)

Wickware P., & Smaglik P. Mass spectroscopy: mix and match. *Nature,* 413, 869 (2001).

Salata O. V. Tools of nanotechnology: electrospray. *Curr. Nanosci.* 1, 25-33 (2005).

Smith A. et al. Observation of strong direct-like oscillator strength in the photoluminescence of Si nanoparticles, *Phys. Rev. B* 72, 205307 (2005).

Menard E., Lee K. J., Khang D. Y., Nuzzo R. G., Rogers J. A. A printable form of silicon for high performance thin film transistors on plastic substrates, *Appl. Phys. Lett.* 84, 5398 (2004)

Kocabas C., Shim M., & Rogers J. A. Spatially selective guided growth of high-coverage arrays and random networks of single-walled carbon nanotubes and their integration into electronic devices, *JACS,* 128, 4540-4541 (2006).

Park J. U. et al. In situ deposition and patterning of single walled carbon nanotubes by laminar flow and controlled flocculation in microfluidic channels, *Angew. Chem. Int. Ed.,* 45, 581-585 (2006).

Kang S. J. et al. High performance electronics using dense, perfectly aligned arrays of single walled carbon nanotubes, *Nature Nanotech*. accepted in 2007.

Chen Z., Appenzeller J., Knoch J., Lin Y. M., & Avouris P. The role of metal-nanotube contact in the performance of carbon nanotube field effect transistors. *Nano Lett.* 5, 1497-1502 (2005).

Kim W. et al. Electrical contacts to carbon nanotubes down to 1 nm in diameter. *Appl. Phys. Lett.* 87, 173101 (2005).

Lee K. J. et al. A printable form of single-crystalline gallium nitride for flexible optoelectronic systems. *Small,* 1, 1164-1168 (2005).

Example 2

Printed Electronics

Figure 9:
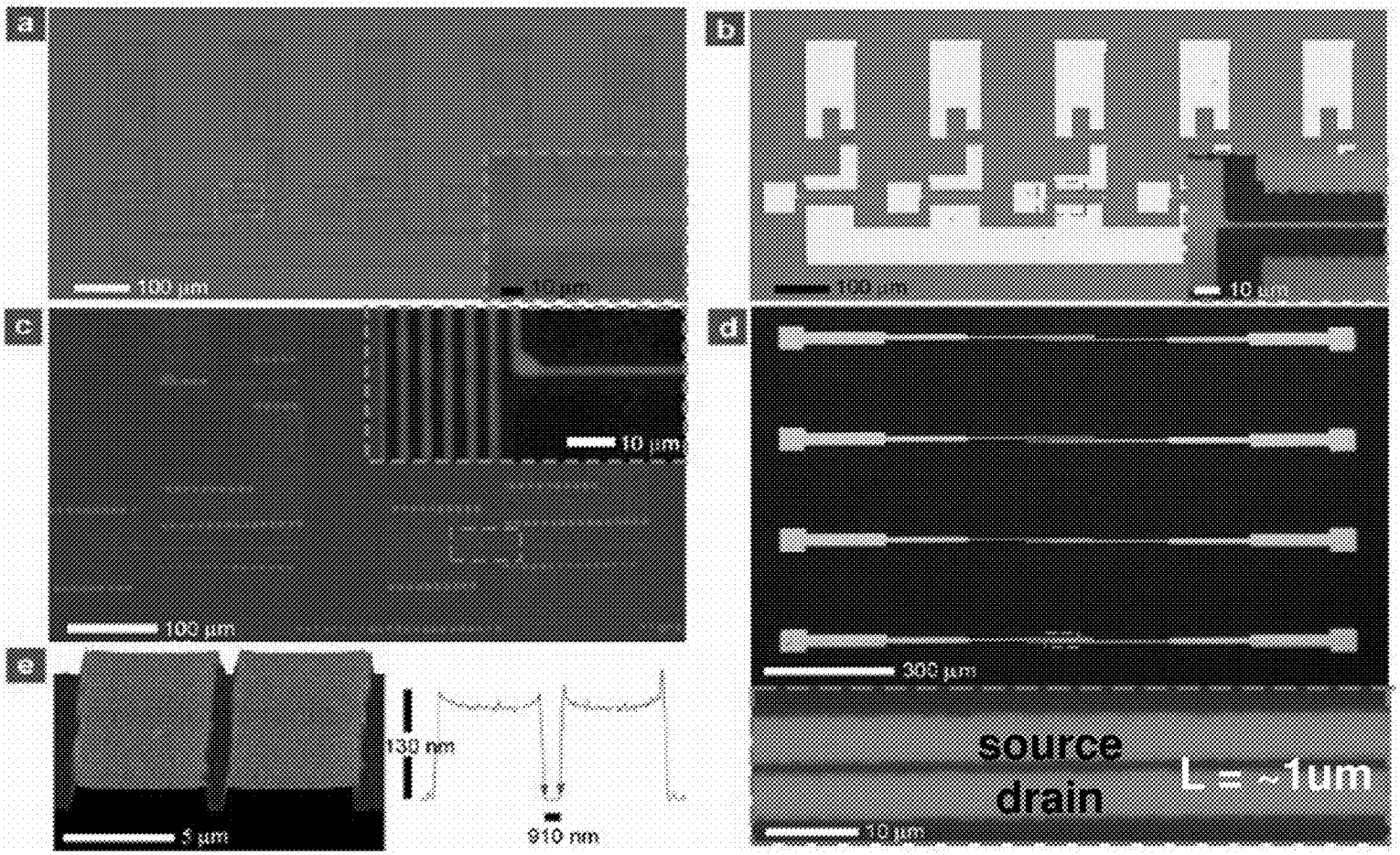
FIG. 9 Patterns of electrodes structures for a ring oscillator and isolated transistors formed by e-jet printing of a photocurable polyurethane ink that acts as an etch resist for a uniform underlying layer of metal (Au/Cr). (a) E-jet printed polyurethane etch resist for a ring oscillator circuit before etching the metal layers. (b) Patterned Au electrode lines with ~2 μm width after etching and stripping the resist shown in (a). The insets at the lower right of each of (a) and (b) show magnified images. (c) Au electrode lines (widths ~2 μm). (d) Array of source/drain electrode pairs formed by e-jet printing of the resist layer, etching of metal and then stripping the resist. The bottom inset shows an electrode pair separated by ~1 μm. (e) AFM image and depth profile of a portion of this pair.

Printed electronics represents an important application area that can take advantage of both the extremely high-resolution capabilities of e-jet as well as its compatibility with a range of functional inks. To demonstrate the suitability of e-jet for fabricating key device elements in printed electronics, we pattern complex electrode geometries for ring oscillators, source/drain electrodes for transistors, and manufacture working transistors. In these examples, a photocurable polyurethane precursor provides a printable resist layer for patterning metal electrodes by chemical etching. The printhead in this case uses a 1 μm ID nozzle; the printing speed is 100 μm $s^{-1}$. The substrate consists of a $SiO_2$ (300 nm)/Si coated uniformly with Au (130 nm) and Cr (2 nm). FIG. 9*a* shows a pattern of printed polyurethane after curing by exposure to ultraviolet light (~1 J $cm^{-2}$). The resolution is 2±0.4 μm, as defined by the minimum line widths. Much larger features, shown here in the form of electrode pads with dimensions up to 1 mm, are possible by overlapping the fine lines. Wet etching the printed substrate (Au etchant:

TFA®, Transene Inc., Cr etchant: Cr mask etchant, Transene Inc.) removed the Au/Cr bilayer in regions not protected by the polyurethane.

Removing the polyurethane by soaking in methylene chloride and, in some cases, by oxygen plasma etching (Plasmatherm reactive ion etch system, 20 sccm $O_2$ flow with chamber base pressure of 150 mTorr, 150 W, and RF power for 5 min), completes the fabrication or prepares the substrate for deposition of the next functional material. FIGS. 9*b-e* show various patterns of Au/Cr electrodes formed in this manner. FIG. 9*d* presents an array of printed source/drain electrodes with different spacings (i.e. channel lengths, L). As shown in the inset of FIG. 9*d*, channel lengths as small as 1±0.2 μm can be achieved with channel widths of up to hundreds of microns (~170 μm in this case). An AFM image of part of the channel area shows sharp, well defined edges (FIG. 9*e*). The ability to print channel lengths with sizes in the micron range in a direct fashion, without the use of substrate wetting or relief assist features, is important due to the key role of this dimension in determining the switching speeds and the output currents of the transistors.

Figure 10:
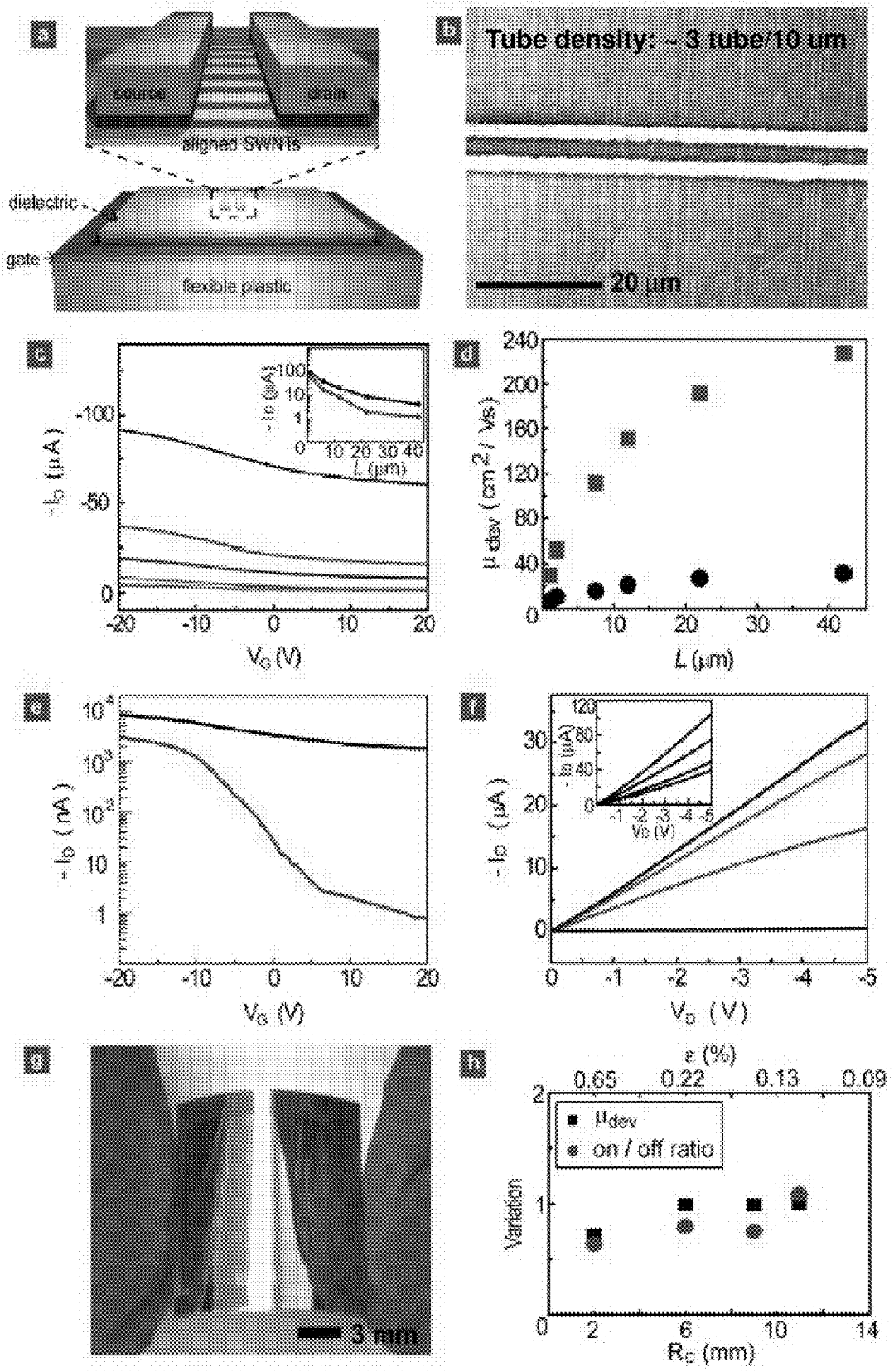
FIG. 10 Fabrication of perfectly aligned SWNT-TFTs on a plastic substrate with e-jet printing for the critical features, i.e. the source and drain electrodes. (a) Schematic illustration of the transistor layout, where the source/drain are patterned by e-jet printing. (b) SEM image of the aligned SWNTs connected by e-jet printed source/drain electrodes. The tube density is ~3 SWNTs/10 μm. (c) Transfer curves measured from transistors with channel lengths, L=1, 6, 12, 22, and 42 μm, from top to bottom, and channel widths, W=80 μm at a source/drain voltage, VD=−0.5 V. The inset shows on and off currents (top and bottom lines, respectively) as a function of L. (d) Linear regime device mobilities (μdev) calculated from the parallel (circles) and rigorous (squares) capacitance models, as a function of L. (e) Transfer curves from a transistor with L=22 μm before (top line) and after (bottom line) an electrical breakdown process. This breakdown reduces the 'off' current to less than ~1 nA, to yield an on/off ratio of ~1,000. (f) Current-voltage characteristics recorded after the electrical breakdown process. The gate voltage varies between −20 and 10 V in steps of −10 V, from top to bottom. The inset shows current-voltage curve before the breakdown with the same gate voltages for the comparison. (g) Photograph of an array of flexible, SWNT-TFTs. (h) Variation of the normalized mobility (squares) and on/off ratio (circles) of a SWNT-TFT transistor as a function of bending induced strain (∈) and the radii to curvature (RC).

As a demonstration of device fabrication by e-jet printing, TFTs that use perfectly aligned arrays of SWNTs as the semiconductor and e-jet printed electrodes for source and drain are fabricated on flexible plastic substrates. The fabrication process begins with e-beam evaporation of a uniform gate electrode (Cr: 2 nm/Au: 70 nm/Ti: 10 nm) onto a sheet of polyimide (thickness: 25 μm). A layer of SiO2 (thickness: 300 nm) deposited by PECVD at 250° C. and a spin cast film of epoxy (SU-8, thickness: 200 nm) forms a bilayer gate dielectric. The epoxy also serves as an adhesive for the dry transfer of SWNT arrays grown by chemical vapor deposition on quartz wafers using patterned stripes of iron catalyst41. Evaporating uniform layers of Cr (2 nm)/Au (100 nm) onto the transferred SWNT arrays, followed by e-jet printing and photocuring of polyurethane and then etching of the exposed parts of the Cr/Au to define source/drain electrodes completes the fabrication of devices with different channel lengths, L. SWNTs outside of the channel areas are removed by reactive ion etching (150 mTorr, 20 sccm O2, 150 W, 30 s) to isolate these devices. FIGS. 10*a* and 10*b* show schematic illustrations of the device layouts and an SEM image of the aligned SWNTs with the e-jet printed source/drain electrodes. The arrays consist of ~3 SWNTs/10 μm. FIG. 10*c* presents typical transfer characteristics that indicate the expected p-channel behavior42. The current outputs increase approximately linearly with 1/L, with ratios of the 'on' to the 'off' currents that are between ~1.5 and ~4.5 (inset of FIG. 10*c*), as expected due to the population of metallic tubes in the arrays.

FIG. 10*d* (circles) shows approximate device mobilities evaluated in the linear regime, calculated from the physical widths of source/drain electrodes (W=80 μm), a parallel plate model for capacitance (C), and the transfer curves, according to $$\mu_{dev} = \frac{L}{WCV_D} \cdot \frac{\partial I_D}{\partial V_G}.$$

These mobilities are between 7 and 42 $cm^2\ V^{-1}\ s^{-1}$ with L in the range of 1~42 μm, and decrease with L due to the contact resistance[41-43]. An accurate model for the capacitance coupling between the tubes and the gate yields mobilities of 30-228 $cm^2\ V^{-1}\ s^{-1}$, as illustrated in FIG. 10*d* (squares). The on/off ratios can be enhanced by an electrical breakdown process[41]. Transfer curves evaluated before and after this process are compared in FIG. 10*e*, for the case of a transistor with L=22 μm. The on/off ratio improves to >1000 without substantial reduction in mobility (28 to 21 $cm^2\ V^{-1}\ s^{-1}$). FIG. 10*f* shows full current-voltage characteristics before (inset) and after breakdown. FIG. 10*g* shows an optical micrograph of a set of devices on a flexible sheet of polyimide, and FIG. 10*h* presents the normalized mobility and on/off ratio as a function of bending induced strain (∈)[44]. No significant change in the mobility or on/off ratio occurs for bending to radii of curvature ($R_C$) as small as 2 mm.

This example presents a high resolution form of electrohydrodynamic jet printing that is suitable for use with wide ranging classes of inks and for device applications in printed electronics and other areas. The advantages over conventional ink jet lie mainly in the high levels of resolution that can be obtained. Further reduction in the nozzle dimensions provides resolution even deeper into the sub-micron regime. For example, estimates of the individual droplet sizes in the high frequency response regime of the pulsating operating mode, even with the nozzles demonstrated here, are in the range of 100 nm.

Example 3

Scanned Nozzles

Printing of active and passive materials using scanned small-diameter nozzles represents an attractive method for organic electronics and optoelectronics, partly because the high level of sophistication of similar systems used in graphic arts. Because of the additive nature of the process, materials utilization can be high. The materials can be deposited either in the vapor or liquid phase using respectively vapor jet printing or inkjet methods. While organic vapor jet printing techniques have been introduced only very recently, inkjet printing techniques are well-established and already have worldwide applications. In 2004, a 40-inch full-color OLED display prototype was fabricated using inkjet printing of light emitting polymers.[317] The following summarize recent developments in inkjet printing techniques applied to the fabrication of organic optoelectronic devices.

Nozzles can be used to print liquids. Beginning shortly after the commercial introduction of inkjet technology in digital-based graphic art printing, there has been interest in developing inkjet printing for manufacturing of physical parts. For example, solders, etch resists, and adhesives are inkjet printed for manufacturing of microelectronics.[321-323] Also, inkjet printing enables rapid prototype production of complex three-dimensional shapes directly from computer software.[324-326] More recent work explores inkjet printing for organic optoelectronics, motivated mainly by attractive features that it has in common with OVJP, such as: (i) purely additive operation, (ii) efficient materials usage, (iii) patterning flexibility, such as registration 'on the fly'; and (iv) scalability to large substrate sizes and continuous processing (e.g. reel to reel). The following discussion introduces three different approaches to inkjet printing (thermal, piezoelectric, or electrohydrodynamic), with some device demonstrations.

Thermal/Piezoelectric Inkjet Printing: Conventional inkjet printers operate either in one of two modes: continuous jetting, in which a continuous stream of drops emerge from the nozzle, or drop-on-demand, in which drops are ejected as they are needed. This latter mode is most wide-spread due to its high placement accuracy, controllability and efficient materials usage. Drop-on-demand uses pulses, generated either thermally or piezoelectrically, to eject solution droplets from a reservoir through a nozzle. In a thermal inkjet printhead device, electrical pulses applied to heaters that reside near the nozzles generate Joule heating to vaporize the ink locally (heating temperature: ~300° C. for aqueous inks). The bubble nucleus forms near the heater, and then expands rapidly (nucleate boiling process). The resulting pressure impulse ejects ink droplets through the nozzle before the bubble collapses. The process of bubble formation and collapse takes place within 10 μsec, typically.[328-330] As a result, the heating often does not degrade noticeably the properties of inks, even those that are temperature sensitive. Thermal inkjet printing of various organic electronic materials, such as PEDOT, PANI, P3HT, conducting nanoparticle solutions, UV-curable adhesives, etc, has been demonstrated for fabrication of electronic circuits.[331] Even biomaterials such as DNA and oligonucleotides for microarray biochips can be printed in this way.[332,333] Piezoelectric inkjet printheads provide drop-on-demand operation through the use of piezoelectric effects in materials such as lead zirconium titanate (PZT)). Here, electrical pulses applied to the piezoelectric element create pressure impulses that rapidly change the volume of the ink chamber to eject droplets. In addition to avoiding the heating associated with thermal printheads, the piezoelectric actuation offers considerable control over the shape of the pressure pulse (e.g. rise and fall time). This control enables optimized, monodisperse single droplet production often using drive schemes that are simpler than those needed for thermal actuation.[335]

The physical properties of the ink are important for high-resolution inkjet printed patterns. First, in order to generate droplets with micron-scale diameters (picoliter-regime volume), sufficiently high kinetic energies (for example, ~20 μJ for HP 51626A)[329,330] and velocities (normally, 1~10 m/sec) are necessary to exceed the interfacial energy that holds them to the liquid meniscus in the nozzle. Printing high viscosity materials is difficult, due to viscous dissipation of energy supplied by the heater or piezoelectric element. Viscosities below 20 cP are typically needed. Second, high evaporation rates in the inks can increase the viscosity, locally at the nozzles, leading, in extreme cases, to clogging. The physics of evaporation and drying also affects the thickness uniformity of the printed patterns. The large surface-to-volume ratio of the micron-scale droplets leads to high evaporation rates. Evaporation from the edges of the droplet is faster than the center, thereby driving flow from the interior to the edge. This flow transports solutes to the edge, thereby causing uneven thicknesses in the dried film. The thickness uniformity can be enhanced by using fast evaporating solvents.[336] Third, surface tension and surface chemistry play important roles because they determine the wetting behavior of the ink in the nozzle and on the surface. When the outer surface of the nozzle is wet with ink, ejected droplets can be deflected and sprayed in ways that are difficult to control. Also, the wetting characteristics of the printed droplet on the substrate can influence the thickness and size of the printed material. A method to avoid the variation of printed droplet sizes associated with such wetting behaviors involves phase-changing inks. For example, an ink of Kemamide wax in the liquid phase (melting temperature: 60~100° C.) can be ejected from a nozzle, after which it freezes rapidly onto a cold substrate before spreading or dewetting. In this case, the printing resolution depends more on cooling rate and less on the wetting properties, and minimum size of ~20 μm was achieved.[337-333] Active matrix-TFT backplanes in a display (e.g. electrophoretic display) can be fabricated, by using the inkjetted wax as an etch resist for patterning of metal electrodes (Cr and Au).[340] Here, poly[5,5'-bis(3-dodecyl-2-thienyl)-2,2'-bithiophene] (PQT-12), which serves as the semiconductor, is printed using piezoelectric inkjet. Those OTFTs show average mobilities of 0.06 $cm^2/V\cdot s$ and $I_{on}/I_{off}$ ratios of $10^6$.[341]

The wetting behavior, together with the volume and positioning accuracy of the ink droplets, influences the resolution. Typical inkjet printheads used with organic electronic materials eject droplets with volumes of 2~10 picoliters and with droplet placement errors of ±10 μm at a 1 mm stand-off-distance (without specially treated substrates)[33,34,342] Spherical droplets with volumes of 2 picoliter have diameters of 16 μm. The diameters of dots formed by printing such droplets are typically two times larger than the droplet diameter, for aqueous inks on metal or glass surfaces. Recent results from an experimental inkjet system show the ability to print dots with 3 μm diameters and lines with 3 μm widths, without any pre-patterning of the substrate, by use of undisclosed approaches. Inks of conducting silver nanoparticle paste (Harima Chemical Inc., particle size: ~5 nm, sintering temperature: about 200° C.) and the conducting polymer, MEH-PPV, were demonstrated using this system.[343,344]

The resolution can be improved through the use of patterned areas of wettability or surface topography on the substrate, formed by photolithographic or other means. This strategy enables inkjet printing of all-polymer TFTs with channel lengths in the micron range. The fabrication in this case begins with photolithography to define hydrophobic polyimide structures on a hydrophilic glass substrate. Piezoelectric inkjet printing of an aqueous hydrophilic ink of PEDOT-PSS conducting polymer defines source and drain electrodes. The patterned surface wettability ensures that the PEDOT-PSS remains only on the hydrophilic regions of substrate.345 Spin-coating uniform layers of the semiconducting polymer (poly(9,9-dioctylfluorene-co-bithiophene (F8T2)) and the insulating polymer (PVP) form the semiconductor and gate dielectric, respectively. Inkjet printing a line of PEDOT-PSS on top of these layers, positioned to overlap the region between the source and drain electrodes defines a top gate. The width of the hydrophobic dewetting pattern (5 μm) defines the channel length. An extension of this approach uses submicron wide hydrophobic mesa structures defined by electron beam lithography. In this case the printed PEDOT-PSS ink splits into two halves with a narrow gap in between, to form channel lengths as small as 500 nm.346 Although these approaches enable high-resolution patterns and narrow channel lengths, they require a separate lithographic step to define the wetting patterns.

Inkjet printing can also be applied to certain organic semiconductors and gate insulators.347-349 Printing of the semiconductor, in particular, can be more challenging than other device layers due to its critical sensitivity to morphology, wetting and other subtle effects that can be difficult to control. In addition, most soluble organic semiconductors that can be inkjetted exhibit low mobilities (10-3~10-1 cm2/V·s) because the solubilizing functional groups often disrupt π-orbital overlap between adjacent molecules and frustrate the level of crystallinity needed for efficient transport. Methods that avoid this problem by use of solution processable precursors that are thermally converted after printing appear promising. For example, a conversion reaction for the case of oligothiophene (IEEE Trans. Electron. Devices 2006, 53, 594; IEEE Trans. Components Packag. Technol. 2005, 28, 742). Low-cost small-molecule OTFTs with mobilities of ~0.1 cm2/V·s and 135 kHz-RFIDs can be fabricated using this approach.350,351 Soluble forms of pentacene-derivatives with N-sulfinyl group352 or alkoxy-substituted silylethynyl group353 can also be synthesized. The former can be inkjet printed and then converted into pentacene by heating at 120~200° C., as provided by Molesa et al. Technical Digest—International Electron Devices Meeting, 2004, p. 1072; Volkman et al. Materials Research Society Symposium Proceedings; Warrendale, Pa. 2003, p. 391. This inkjet-printed pentacene-transistor shows a mobility of 0.17 cm2/V·s and Ion/Ioff ratio of 104.

Inkjet printing can also work well with a range of inorganic inks that are useful for flexible electronics. For example, suspensions of various metal nanoparticles such as Ag, Cu, and Au can be printed to produce continuous electrode lines and interconnects after a post-printing sintering process.356-358 This sintering can be performed at relatively low temperatures (130~300° C.) that are compatible with many plastic substrates, due to melting point depression effects in metal nanoparticles. Inorganic semiconductors such as silicon can be also inkjet printed by using a route similar to the soluble organic precursor method described in the previous section. In particular, a Si-based liquid precursor (cyclopentasilane, Si5H10) can be printed, and then converted to large grain poly-Si by pulsed laser annealing, as illustrated in Shimoda et al. Nature 2006, 440, 783. TFTs formed in this manner exhibit mobilities of ~6.5 cm2/V·s, which exceed those of solution-processed organic TFTs and amorphous-Si TFTs, yet, encouragingly, are still much smaller than values that should be achievable with this type of approach.

Although substantial efforts in inkjet printing focus on transistors, the most well developed systems are OLEDs for displays and other applications. For the fabrication of multicolor OLED displays, inkjet printing can simultaneously pattern sub-pixels using multiple nozzles and inks without any damage on the pre-deposited layer.360-363 For example, OLEDs can be fabricated by inkjet printing of polyvinylcarbazole (PVK) polymer solutions doped with the dyes of Coumarin 47 (blue photoluminescence), Coumarin 6 (green), and Nile red (orange-red) onto a polyester sheet coated with ITO. The printed sub-pixel sizes range from 150 to 200 μm in diameter and from 40 to 70 nm in thickness, with turn-on voltages of 6~8 V.364 OLEDs can be also patterned by inkjet printing of HTLs such as PEDOT, instead of the emitting layers, on ITO before blanket deposition of light-emitting layers by spin-coating. Because the charge injection efficiency of the HTLs is superior to the efficiency of ITO, only the HTL-covered areas emit light.365 Multi-color light-emitting pixels can be fabricated using diffusion of the inkjetted dyes.363 In this case, green-emitting Almq3 (tris(4-methyl-8-quinolinolato)AIIII) and red-emitting 4-(dicyano-methylene)-2-methyl-6-(4-dimethylaminostyryl)-4H-pyran (DCM) dye molecules are inkjetted on a pre-spincoated blue-emission PVK hole transport layer (thickness: ~150 nm), as illustrated in Chang et al. Adv. Mater. 1999, 11, 734. These two dyes diffuse into the PVK buffer layer. In regions where the Almq3 or DCM diffuses into PVK, the pixels show green or red emission, respectively. Otherwise, the device emits blue light. These devices turn on at around 8 V, with the external quantum efficiencies of ~0.05%.

Many of the OLED systems use polymer wells to define sub-pixel sizes on the substrate surface. For example, Shimoda et al. MRS Bull. 2003, 28, 821, shows polyimide wells (diameter: 30 μm, depth: 3 μm) patterned on ITO by photolithography.336 Inks flow directly into these wells, and spread at their bottoms to form R, G, and B sub-pixels. Recently, a 40-inch full-color OLED display was achieved using this inkjet method, as shown in Epson Technology newsroom from (http://www.epson.co.jp/e/newsroom/tech_news/tnl0408single.pdf).

Electrohydrodynamic Inkjet Printing: In thermal and piezoelectric inkjet technology, the size of the nozzle often plays a critical role in determining the resolution. Reducing this size can lead to clogging, especially with inks consisting of suspensions of nanoparticles or micro/nanowires in high concentration. Another limitation of conventional inkjet printing is that the structures (wetting patterns, wells, etc) needed to control flow and droplet movement on the substrate require conventional lithographic processing. Therefore, ink-based printing methods capable of generating small jets from big nozzles and of controlling in a non-lithographic manner the motion of droplets on the substrate might provide important new patterning capabilities and operating modes. A new strategy, aimed at achieving these and other objectives, uses electrohydrodynamic effects to perform the printing. FIGS. 2 and 3 show a schematic illustration of this technique. A conducting metal film coats the nozzle in this system, and the substrate rests on a grounded electrode. When a voltage is applied to an ink solution, by use of the metal-coated nozzle assembly, surface charges accumulate in the liquid meniscus near the end of the nozzle. While surface tension tends to hold the meniscus in a spherical shape, repulsive forces between the induced charges deform the sphere into cone. At sufficiently large electric fields, a jet with diameter smaller than the nozzle size emerges from the apex of this cone (see FIG. 4B). In this situation, the jet diameter and jetting behavior (for example pulsating, stable cone-jet, or multi-jet mode) can be different, depending on the electric field and ink properties.366 By controlling the applied voltage and moving the substrate relative to the nozzle, this jet can be used to write patterns of ink onto the substrate. While this electrohydrodynamic inkjet printing method has been first explored for graphic art printing applications where pigment inks are printed on papers with relatively low printing resolutions (dot diameter ≥~20 μm)367-370, it has been recently demonstrated for high resolution printing of various functional inks for electronic device fabrications. Images of the PEDOT-PSS ink are printed in this manner having a printed dot diameter of about 2 μm). Dot sizes less than 10 μm are possible with a wide range of inks (for example high concentration (>10 wt. %) gold/silver/Si nanoparticle solutions, UV-curable polyurethane precursor, SWNTs, etc), and complex images can be formed. Also, polymer etch resists can be printed onto a flat non-treated gold surface, and electrode lines for electronic devices can be patterned after etching and stripping steps. For example, FIG. 9D shows the array of source and drain patterned in this way. Channel length of ~2 μm is achieved without any substrate pre-treatment.

If the inks have sufficient viscosity or evaporation rates, the jet forms fibers rather than droplets, and the printing technique is known as electrospinning.371,372 Organic semiconducting nanofibers of binary blends of MEH-PPV with regioregular P3HT can be electrospun to fiber diameters of 30~50 nm, and then incorporated into OTFTs.371 Transistors based on networks of such fibers showed mobilities in the range of 10-4~5×10−6 cm2/V·s, dependent on blend composition. The mobility values use the physical width of the transistor channel. Since the fibers occupy only 10% of the channel area, these mobilities are one order of magnitude lower than the mobilities of the individual fibers.

(319) Shtein, M.; Peumans, P.; Benziger, J. B.; Forrest, S. R. *Journal Of Applied Physics* 2004, 96, 4500.
(320) Preisler, E. J.; Guha, S.; Perkins, B. R.; Kazazis, D.; Zaslaysky, A. *Applied Physics Letters* 2005, 86, 223504.
(321) Hayes, D. J.; Cox, W. R.; Grove, M. E. *Journal Of Electronics Manufacturing* 1998, 8, 209.
(322) Son, H. Y.; Nah, J. W.; Paik, K. W. *Ieee Transactions On Electronics Packaging Manufacturing* 2005, 28, 274.
(323) Hayes, D. J.; Cox, W. R.; Grove, M. E. *Display Works*'99 1999, 1.
(324) Moon, J.; Grau, J. E.; Knezevic, V.; Cima, M. J.; Sachs, E. M. *Journal Of The American Ceramic Society* 2002, 85, 755.
(325) Blazdell, P. F.; Evans, J. R. G.; Edirisinghe, M. J.; Shaw, P.; Binstead, M. J. *Journal Of Materials Science Letters* 1995, 14, 1562.
(326) Blazdell, P. F.; Evans, J. R. G. *Journal Of Materials Synthesis And Processing* 1999, 7, 349.
(327) Anagnostopoulos, C. N.; Chwalek, J. M.; Delametter, C. N.; Hawkins, G. A.; Jeanmaire, D. L.; Lebens, J. A.; Lopez, A.; Trauernicht, D. P. 12th Int. Conf. Solid State Sensors, Actuators and Microsystems, Boston, 2003; p 368.
(328) Le, H. P. *Journal Of Imaging Science And Technology* 1998, 42, 49.
(329) Tseng, F. G.; Kim, C. J.; Ho, C. M. *Journal Of Microelectromechanical Systems* 2002, 11, 427.
(330) Tseng, F. G.; Kim, C. J.; Ho, C. M. *Journal Of Microelectromechanical Systems* 2002, 11, 437.
(331) Lindner, T. J. In *Printed Electronics Europe* 2005 available at: idtechex.com/products/en/presentation.asp-?presentationid=209, 2005.
(332) Cooley, P.; Hinson, D.; Trost, H. J.; Antohe, B.; Wallace, D. *Methods in Molecular Biology*; Humana Press: Totowa, 2001.
(333) Okamoto, T.; Suzuki, T.; Yamamoto, N. *Nature Biotechnology* 2000, 18, 438.
(334) Parashkov, R.; Becker, E.; Riedl, T.; Johannes, H. H.; Kowalsky, W. *Proceedings Of The Ieee* 2005, 93, 1321.
(335) Lee, E. R. *Microdrop Generation*; CRC Press: New York, 2003.
(336) Shimoda, T.; Morii, K.; Seki, S.; Kiguchi, H. *Mrs Bulletin* 2003, 28, 821.
(337) Wong, W. S.; Ready, S.; Matusiak, R.; White, S. D.; Lu, J. P.; Ho, J.; Street, R. A. *Applied Physics Letters* 2002, 80, 610.
(338) Wong, W. S.; Ready, S. E.; Lu, J. P.; Street, R. A. *Ieee Electron Device Letters* 2003, 24, 577.
(339) Wong, W. S.; Street, R. A.; White, S. D.; Matusiak, R.; Apte, R. B. USA, 2004.
(340) Chabinyc, M. L.; Wong, W. S.; Arias, A. C.; Ready, S.; Lujan, R. A.; Daniel, J. H.; Krusor, B.; Apte, R. B.; Salleo, A.; Street, R. A. *Proceedings Of The Ieee* 2005, 93, 1491.
(341) Arias, A. C.; Ready, S. E.; Lujan, R.; Wong, W. S.; Paul, K. E.; Salleo, A.; Chabinyc, M. L.; Apte, R.; Street, R. A.; Wu, Y.; Liu, P.; Ong, B. *Applied Physics Letters* 2004, 85, 3304.
(342) Cheng, K.; Yang, M. H.; Chiu, W. W. W.; Huang, C. Y.; Chang, J.; Ying, T. F.;
Yang, Y. *Macromolecular Rapid Communications* 2005, 26, 247.
(343) Murata, K.; Matsumoto, J.; Tezuka, A.; Matsuba, Y.; Yokoyama, H. Microsystem *Technologies-Micro-And Nanosystems-Information Storage And Processing Systems* 2005, 12, 2.
(344) Murata, K. Proceedings for the International Conference on MEMS, NANO and Smart Systems (ICMENS'03), Alberta, Canada, 2003; p 346.
(345) Khatavkar, V. V.; Anderson, P. D.; Duineveld, P. C.; Meijer, H. H. E. *Macromolecular Rapid Communications* 2005, 26, 298.
(346) Wang, J. Z.; Zheng, Z. H.; Li, H. W.; Huck, W. T. S.; Sirringhaus, H. *Nature Materials* 2004, 3, 171.
(347) Paul, K. E.; Wong, W. S.; Ready, S. E.; Street, R. A. *Applied Physics Letters* 2003, 83, 2070.
(348) Liu, Y.; Varahramyan, K.; Cui, T. H. *Macromolecular Rapid Communications* 2005, 26, 1955.
(349) Burns, S. E.; Cain, P.; Mills, J.; Wang, J. Z.; Sirringhaus, H. *Mrs Bulletin* 2003, 28, 829.
(350) Chang, P. C.; Molesa, S. E.; Murphy, A. R.; Frechet, J. M. J.; Subramanian, V. *Ieee Transactions On Electron Devices* 2006, 53, 594.
(351) Subramanian, V.; Chang, P. C.; Lee, J. B.; Molesa, S. E.; Volkman, S. K. *Ieee Transactions On Components And Packaging Technologies* 2005, 28, 742.
(352) Afzali, A.; Dimitrakopoulos, C. D.; Breen, T. L. *Journal Of The American Chemical Society* 2002, 124, 8812.
(353) Payne, M. M.; Delcamp, J. H.; Parkin, S. R.; Anthony, J. E. *Organic Letters* 2004, 6, 1609.
(354) Molesa, S. E.; Volkman, S. K.; Redinger, D. R.; de la Fuente, V. A.; Subramanian, V. Technical Digest—International Electron Devices Meeting, 2004; p 1072.
(355) Volkman, S. K.; Molesa, S. E.; Mattis, B.; Chang, P. C.; Subramanian, V. Materials Research Society Symposium Proceedings, 2003; p 391.
(356) Szczech, J. B.; Megaridis, C. M.; Gamota, D. R.; Zhang, J. *Ieee Transactions On Electronics Packaging Manufacturing* 2002, 25, 26.
(357) Dearden, A. L.; Smith, P. J.; Shin, D. Y.; Reis, N.; Derby, B.; O'Brien, P. *Macromolecular Rapid Communications* 2005, 26, 315.
(358) Redinger, D.; Molesa, S.; Yin, S.; Farschi, R.; Subramanian, V. *Ieee Transactions On Electron Devices* 2004, 51, 1978.
(359) Shimoda, T.; Matsuki, Y.; Furusawa, M.; Aoki, T.; Yudasaka, I.; Tanaka, H.; Iwasawa, H.; Wang, D. H.; Miyasaka, M.; Takeuchi, Y. *Nature* 2006, 440, 783.
(360) Chang, S. C.; Bharathan, J.; Yang, Y.; Helgeson, R.; Wudl, F.; Ramey, M. B.; Reynolds, J. R. *Applied Physics Letters* 1998, 73, 2561.
(361) Kobayashi, H.; Kanbe, S.; Seki, S.; Kigchi, H.; Kimura, M.; Yudasaka, I.; Miyashita, S.; Shimoda, T.; Towns, C. R.; Burroughes, J. H.; Friend, R. H. *Synthetic Metals* 2000, 111, 125.
(362) Funamoto, T.; Mastueda, Y.; Yokoyama, O.; Tsuda, A.; Takeshida, H.; Miyashita, S. Proc. 22nd Int. Display Res. Conf., Boston, 2002; p 1403.
(363) Chang, S. C.; Liu, J.; Bharathan, J.; Yang, Y.; Onohara, J.; Kido, J. *Advanced Materials* 1999, 11, 734.
(364) Sturm, J. C.; Pschenitzka, F.; Hebner, T. R.; Lu, M. H.; Wu, C. C.; Wilson, W. SPIE Conference on Organic Light-Emitting Materials and Devices, 1998; p 208.
(365) Bharathan, J.; Yang, Y. *Applied Physics Letters* 1998, 72, 2660.
(366) Li, D.; Xia, Y. N. *Advanced Materials* 2004, 16, 1151.
(367) Mills, R. S. *Recent Progress in Ink Jet Technologies II* 1999, 286.
(368) Nakao, H.; Murakami, T.; Hirahara, S.; Nagato, H.; Nomura, Y. IS&Ts NIP15: International Conference on Digital Printing Technologies, 1999; p 319.

(369) Choi, D. H.; Lee, F. C. Proc. Of IS&T's Ninth International Congress on Advances in Non-Impact Printing Technologies, Yokohama, Japan, 1993.

(370) Kawamoto, H.; Umezu, S.; Koizumi, R. *J. imaging Sci. Technol.* 2005, 49, 19.

(371) Babel, A.; Li, D.; Xia, Y. N.; Jenekhe, S. A. *Macromolecules* 2005, 38, 4705.

Example 4

Methods

Achieving higher resolution is ongoing. The speeds for printing, using the particular systems described here, are relatively low, although multiple nozzle implementations provided hereinbelow, conceptually similar to those used in conventional ink jet printheads, could eliminate this weakness. A main disadvantage of the e-jet approach is that the printed droplets have substantial charge that might lead to unwanted consequences in resolution and in device performance, particularly when used with electrically important layers such as gate dielectrics and semiconductor films. The effects of this charge may be minimized by using high frequency alternating driving voltages for the e-jet process. These and other process improvements, together with exploration of applications in biotechnology and other areas, represent promising application areas. Various methodologies useful in a number of applications and processes are described:

PREPARATION OF NOZZLES Au/Pd (70 nm thickness) and Au (50 nm) layers are coated onto glass micropipettes with 30 μm or 2 μm or 1 μm tip IDs (World Precision Instruments) using a sputter coater (Denton, Desk II TSC). Dipping the tip of the metal-coated micropipette into 1H,1H, 2H,2H-perfluorodecane-1-thiol (Fluorous Technologies) solution (0.1 wt. % in dimethylformamide) for 10 min, formed a hydrophobic self-assembled layer on the gold surface of the nozzle tip. The capillary is connected to a syringe pump (Harvard Apparatus, Picoplus) through a polyethylene tube (ID: 0.76 mm). Inks are pumped at flow rates of ~30 pl/sec.

SYNTHESIS OF FUNCTIONAL INKS PEDOT/PSS ink: PEDOT/PSS (Baytron P, H. C. Starck) is diluted with $H_2O$ (50 wt %), and mixed with polyethyleneglycol methyl ether (Aldrich, 15 wt %) in order to reduce the surface tension (to lower the voltage needed to initiate printing) and the drying rate at the nozzle.

Single crystal Si rods: Patterning the top Si layer (thickness: ~3 μm) of a silicon on insulator (SOI) wafer by RIE etching, and then etching the underlying $SiO_2$ with an aqueous etchant of HF (49%)[38] with 0.1% of a surfactant (Triton X-100, Aldrich) formed the rods. These rods are suspended in $H_2O$ and then filtered through a filter paper (pore size: 300 nm). The rods are then suspended in 1-octanol. After printing this ink, the surfactant residue is thermally removed by heating to 400° C. in air for 5 hrs.

Ferritin: First, ferritin (Sigma) is diluted in $H_2O$ with volume ratio of 1(ferritin):200(H2O). Then 1 wt % of a surfactant (Triton X-100) was added to this solution to reduce the surface tension (to lower the voltage needed to initiate printing). The surfactant residue is removed at 500° C. before CVD growth of SWNTs.

SWNT solution: Single walled carbon nanotubes produced by the electric arc method (P2-SWNT, Carbon Solution Inc) were suspended in aqueous octyl-phenoxy-polyethoxyethanol (Triton X-405, 2 wt. %). The concentration was ~6.9 mg/L.

PREPARATION OF SUBSTRATES Doped Si wafers with 300 nm thick layers of thermal SiO2 (Process Specialties, Inc) are used as substrates. The underlying Si is electrically grounded during printing. A glass slide (thickness: ~100 μm) is used for fluorescence optical micrograph (FIG. 6*c*), and a ST-cut quartz wafer was used after annealing at 900° C. for guided growth of SWNTs (FIG. 6*e*). Here the glass/quartz substrates are placed on an electrically grounded metal plate during printing. For printing of complex images (FIGS. 6*f* and 8*a*), the $SiO_2$ top surfaces on doped Si wafers are exposed to perfluorosilane vapor before e-jet printing to produce hydrophobic self-assembled monolayer on the $SiO_2$ surface.

Example 5

Exploiting Differential Etch Rates to Fabricate Large-Scale Nozzle Arrays with Protrudent Geometry Nozzles with micro and nanometer scale orifices are playing an increasingly important role in many micro and nano devices, processes and characterization applications such as cell sorters, micro deposition of structures and near-field optical scanning. This example describes a new process capable of generating nozzles in a silicon substrate with nozzle walls of silicon nitride and oxide and with protrudent geometry around the nozzle orifice. The fabrication process exploits a combination of geometry and differences in etching rates to simultaneously open up the nozzle orifice and pattern the geometry around it. The result is an in-parallel, high-throughput process.

Fabrication of nozzle and aperture arrays with micro and nano scale feature sizes is an important enabler in a variety of disciplines. In the field of biological and chemical engineering, such nozzles make it possible to perform patch clamp cell analysis or electroporation [1], microarray printing [2], and toxin detection and analysis by combinatorial chemistry. In material science, they allow researchers to probe material behavior at near atomic scales [3]. In areas of mechanical and electrical engineering, they are used for extremely compact sensors, actuators [4], fuel injectors [5] and electro-hydrodynamic deposition processes [6].

To economically produce micro and nanoscale nozzles, particularly for applications that require arrays of such devices, it is desirable to have a fabrication process that allows for in-parallel manufacturing. Furthermore, the fabrication procedure should allow for flexibility in materials and control over the nozzle orifice dimensions and the geometry that surrounds it to support a range of possible applications. High nozzle densities along with relatively low fabrication cost are also important factors for practical use of a fabrication procedure.

The fabrication of microscale nozzle arrays has received significant research attention. Proposed approaches include anisotropic wet chemical etching of hard materials such as silicon [7]. Uses of dry etching processes [1, 8, 9] have also been reported. In many cases [8-10] the integration of other devices such as heaters and piezoelectric elements along with the nozzle are reported. In all these cases, the external geometry of the nozzle array is essentially planar, i.e., the nozzle orifice is surrounded by a planar surface.

The external nozzle geometry is often important, as in applications such as contact printing and direct-writing of structures. Smith et al [11] report the effect of the tip geometry, clearly indicating that large areas around the exit orifice result in larger printed features for a same water contact angle. The nozzle geometry also plays an important role in the uniformity of material flow through it. A nozzle with a convergent shape produces low viscous losses and consequently has a lower sensitivity of velocity to size variation [7]. Fabrication processes that result in protrudent geometries are reported in [12-14]. The processes reported in [12, 13] use undercutting in an RIE process to create a conical mesa or hill. The process in [12] then uses this mesa as a form for deposition of an oxide or a nitride film. An additional step of spin-coating a polymer around the hills and etching of the exposed tips creates the orifices. Subsequent wet etching from the backside leaves behind a free-standing membrane with a patterned orifice. This process results in a fragile membrane that carries the nozzle. The process reported in [13] uses a boron etch stop on the surface and a subsequent EDP etch to create the nozzle. Lee et al in [14] use a similar strategy of creating a form or mold master with conical hills by etching a optical fiber bundle. This is used to make a water-soluble sacrificial mold through a double replica molding process. Subsequently, the sacrificial mold is spin-coated with PMMA, and the nozzle array released by dissolving the mold in water. In general, these process strategies can be quite complex. Therefore, in this example, we describe a nozzle fabrication procedure that can produce protrudent nozzles in silicon substrates with nozzle walls made of silicon dioxides and nitrides. The process is relatively simple and provides for flexibility in the dimensions of the nozzle orifice and some control over the geometry around it. Since the fabrication procedure is IC compatible, the usual advantages of batch processing, namely low unit cost and integration with active elements, can be realized. Our work is motivated by the use of addressable nozzle arrays for manufacturing micro and nanostructures. Specifically, the nozzles developed by this process are used for electrohydrodynamic printing [6] and direct writing [15].

Figure 11:
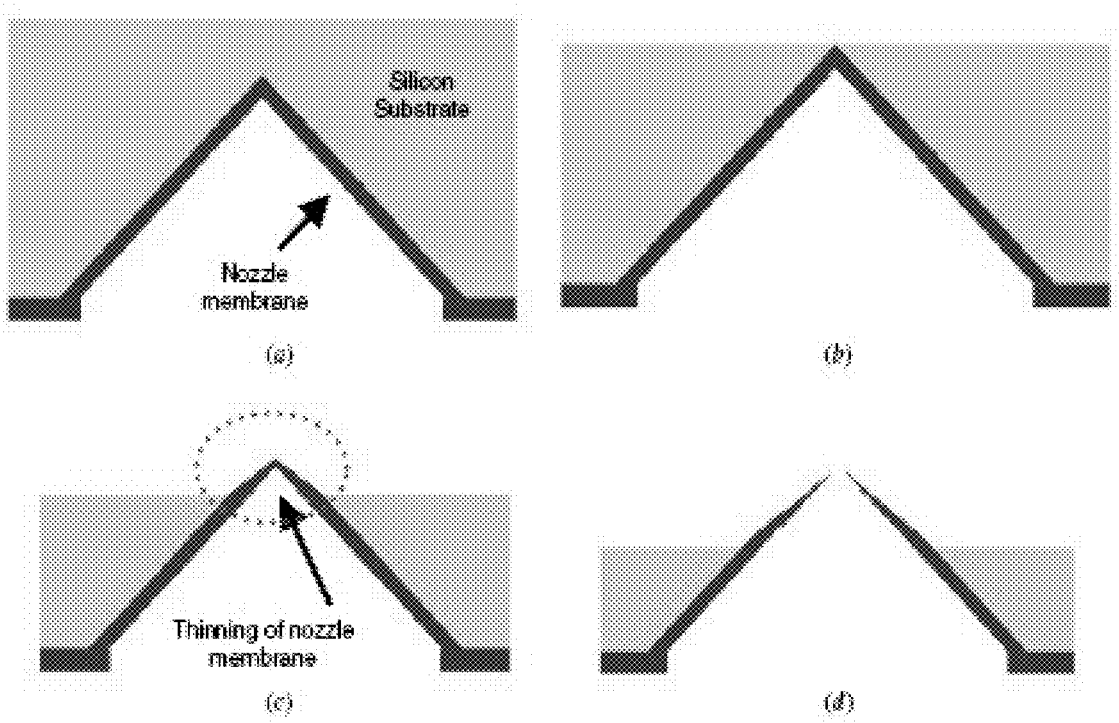
FIG. 11 The process of opening up nozzles by exploiting a combination of geometry and difference in etching rates under dry etching processes. (a) Buried nozzle membrane in the silicon wafer. (b) Plasma from the dry etching process thins down the substrate to level of the nozzle apex. (c) Etching rate differences result in the protrusion and thinning of the membrane from base to apex. (d) An orifice opens up at the nozzle mouth when the membrane thinning equals its thickness.
Figure 12:
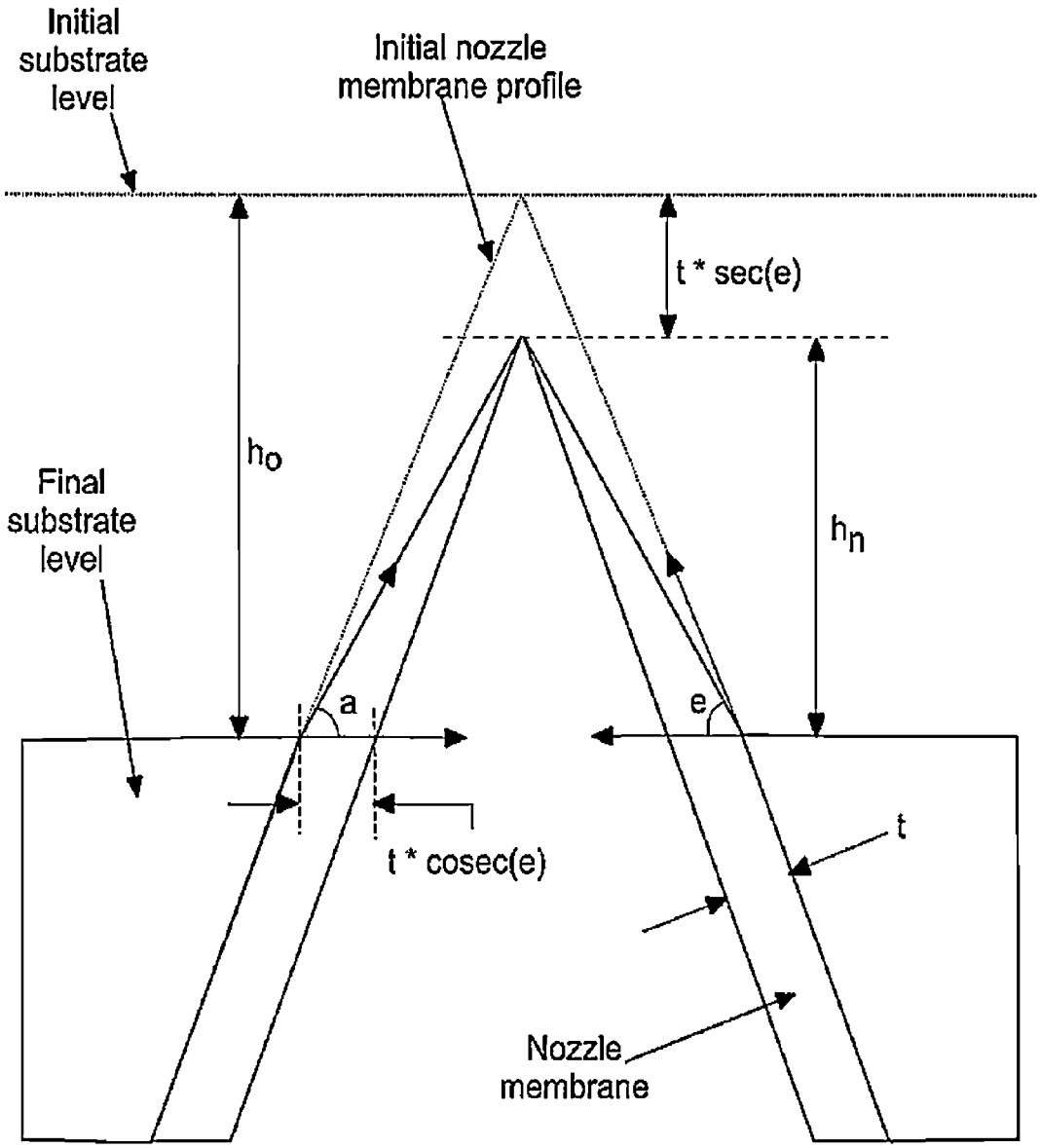
FIG. 12 Dependence of the nozzle profile on material etch rate difference.

Process Schema: Anisotropic wet-chemical etching of {1 0 0} oriented single crystal silicon wafer by potassium hydroxide (KOH) with square mask openings leads to pyramid-shaped pits in the wafer surface [16]. The pits are bounded by four walls in {111} silicon crystal planes that form an angle of 54.74° with {1 0 0} direction. Due to their shape, these pits lend themselves well as molds for tapered, faceted nozzles. The pits are coated with materials such as silicon nitride or silicon dioxide to create a faceted membrane surface out of which the nozzles are created. The surface of the wafer opposite to that containing the pits is then selectively etched to expose the tips of the pyramids/nozzles. To create orifices in these nozzle tips, a variety of techniques such as focused ion beam (FIB) machining or electron beam machining (EBM) can be used. However, these techniques, being essentially serial in nature, do not lend themselves to scaled-up, economical production of nozzle arrays. The process developed here exploits the fact that the etch rates for different materials with both wet and dry etching processes vary considerably [17, 18]. In particular, it concentrates on dry etching processes because of the ease of automation and better process control [19]. During the back surface etch (if the etch rate of the nozzle membrane material is substantially lower than that of the substrate silicon under a dry etch process), etch rate differences can be exploited to expose the pyramidal geometry of the nozzles and also create the nozzle orifice. As the surface of the substrate is etched back, the pyramidal geometry of the nozzles causes the apex to be exposed. Continued etching causes the exposure of the pyramid facets. However, the exposure time of the nozzle membrane to the etch process varies spatially on these facets with the apex receiving maximum exposure and the base of the exposed pyramid receiving the least. The result is a differential thinning of the membrane, leading to the creation of an aperture or orifice at the apex. Using such an approach, arrays of nozzles with pyramidal geometry can be created. By varying the membrane material and gas mixtures, different pyramidal geometries can be obtained. FIG. 11 schematically depicts the above process. The nozzle structure, after coating the pits with the nozzle membrane material, is as shown in FIG. 11*a*. FIG. 11*b* shows the geometry obtained during the back surface etch, just before the exposure of apexes of the pyramids. Continued etching exposes the pyramids as shown in FIG. 11*c* and, as the etching progresses, differential thinning of the nozzle membrane with exposure time becomes apparent, leading to the eventual creation of an aperture at the apex of the pyramid (FIG. 11*d*). This nozzle configuration is referred to as a "partially embedded" nozzle, with a protrudent nozzle tip or ejection orifice.

Etch rate selectivity (s) in an etching process between the substrate and the nozzle membrane material can be defined as the ratio of etch rate of the substrate to that of the nozzle membrane material under the process. To expose the membranes of which the nozzle facets are comprised, the etch rate for the membrane material must be slower than that for the substrate. Hence for discussion here, the etch rate selectivity is always greater than one. We calculate the flank angle of the nozzle for both anisotropic and isotropic dry etching. First if the dry etching process is anisotropic (namely, deep reactive ion etching (DRIE), the process around which this scheme is developed) then the etch rate selectivity can be related to parameters of the starting pyramid geometry by equation (1). Referring to the graphical representation in FIG. 13, we have, $$s = \frac{h_o}{t \times \sec(e)} \tag{1}$$

where $h_o$ is the difference in heights between the original apex of the nozzle membrane and the substrate level when the nozzle orifice is just about to open; t is the starting thickness of the nozzle membrane and e is the KOH etching angle of the {1 0 0} silicon wafer (i.e., 54.74°).

Now $$h_n = h_o - t \times \sec(e) \tag{2}$$

where $h_n$ is the protrusion height of the nozzle from the substrate, when the nozzle orifice is just about to open up. Therefore by replacing the value of $h_o$ from (1) into (2) the value of $h_n$ as obtained is $$h_n = (s-1) \times t \times \sec(e) \tag{3}$$

The angle, a, that the nozzle facet makes with the substrate (called the flank angle) can be obtained as $$\tan(a) = h_n / \{h_n \times \cot(e) + t \times co\sec(e)\} \tag{4}$$

Substituting $h_n$ from (3) into (4) and simplifying yields $$a = \tan^{-1}\left\{\left(\frac{s-1}{s}\right) \times \tan(e)\right\} \tag{5}$$

For an isotropic process (namely vapor etching processes) the etch rate selectivity is $$s=h_o/t \tag{6}$$

$h_n$ and a are given by $$h_n=\{s-\sec(e)\}\times t \tag{7}$$

and $$a=\tan^{-1}\left\{\left(1-\frac{\sec(e)}{s}\right)\times\tan(e)\right\} \tag{8}$$

In this example, two different membrane materials are used, silicon dioxide and silicon nitride. The silicon nitride is deposited by a low pressure chemical vapor deposition (LPCVD) process at a temperature of 825° C. and with gas flows of 71 sccm for dichlorosilane ($SiCl_2H_2$) and 11.8 sccm for ammonia ($NH_3$). The silicon dioxide is deposited by a low temperature oxidation (LTO) process at a temperature of 478° C. and with gas flows of 65 sccm for silane ($SiH_4$) and 130 sccm for oxygen. The etch rates of single crystal silicon, silicon nitride and silicon dioxide in the dry etching deep reactive ion etching (DRIE) process (using the Plasma-Therm SLR-770 equipment) are given in Table 2 (from [18]). These commonly used rates are experimentally verified prior to the fabrication of test nozzles.

TABLE 2

Etch rates of different material under the DRIE process.

| Material | Silicon | LPCVD silicon nitride | LTO |
|---|---|---|---|
| Etch rate (nm $min^{-1}$) | 2400 | 150 | 20 |
| Etch rate selectivity with respect to silicon | 1 | 16 | 120 |

TABLE 3

Predicted values of nozzle protrusion heights and the flank angles for silicon nitride and silicon dioxide nozzles.

| Predictcd values | LPCVD silicon nitride | LTO |
|---|---|---|
| Nozzle height (μm) | 13 | 103 |
| Flank angle (degrees) | 52.98 | 54.51 |

Using (3) and (5) for silicon nitride and silicon dioxide nozzles, assuming a membrane thickness of 500 nm and that the facets are produced with a KOH {1 0 0} etching angle of 54.74°, the predicted nozzle heights and the flank angle are given in TABLE 3.

The size of the aperture or orifice is an important characteristic of any nozzle and, while there is no theoretical minimum orifice size for the process scheme described, practical process and sensing implementations do limit the orifice dimensions. Dry etch processes (namely DRIE) use discrete etch cycles, during which a discrete etch step is obtained. Let the discrete etch step for silicon (the substrate) in each etch cycle be r units (nm, for example) in the dry (anisotropic) etching equipment. This discreteness, coupled with process and material tolerances or uncertainty, gives rise to an inherent uncertainty in the orifice dimension. Consider that, if at the end of a DRIE etch cycle the nozzle membrane has been etched through to an infinitesimal thickness. The next etch cycle etches through a distance r in the substrate material and r/s of the membrane material, where s is the selectivity factor of the membrane material with respect to the substrate material. This then corresponds to an orifice opening (o), $$o=2\times r/(s\times\tan(e)) \tag{9}$$

where e is the KOH etching angle of the {1 0 0} silicon wafer (i.e., 54.74°).

Figure 13:
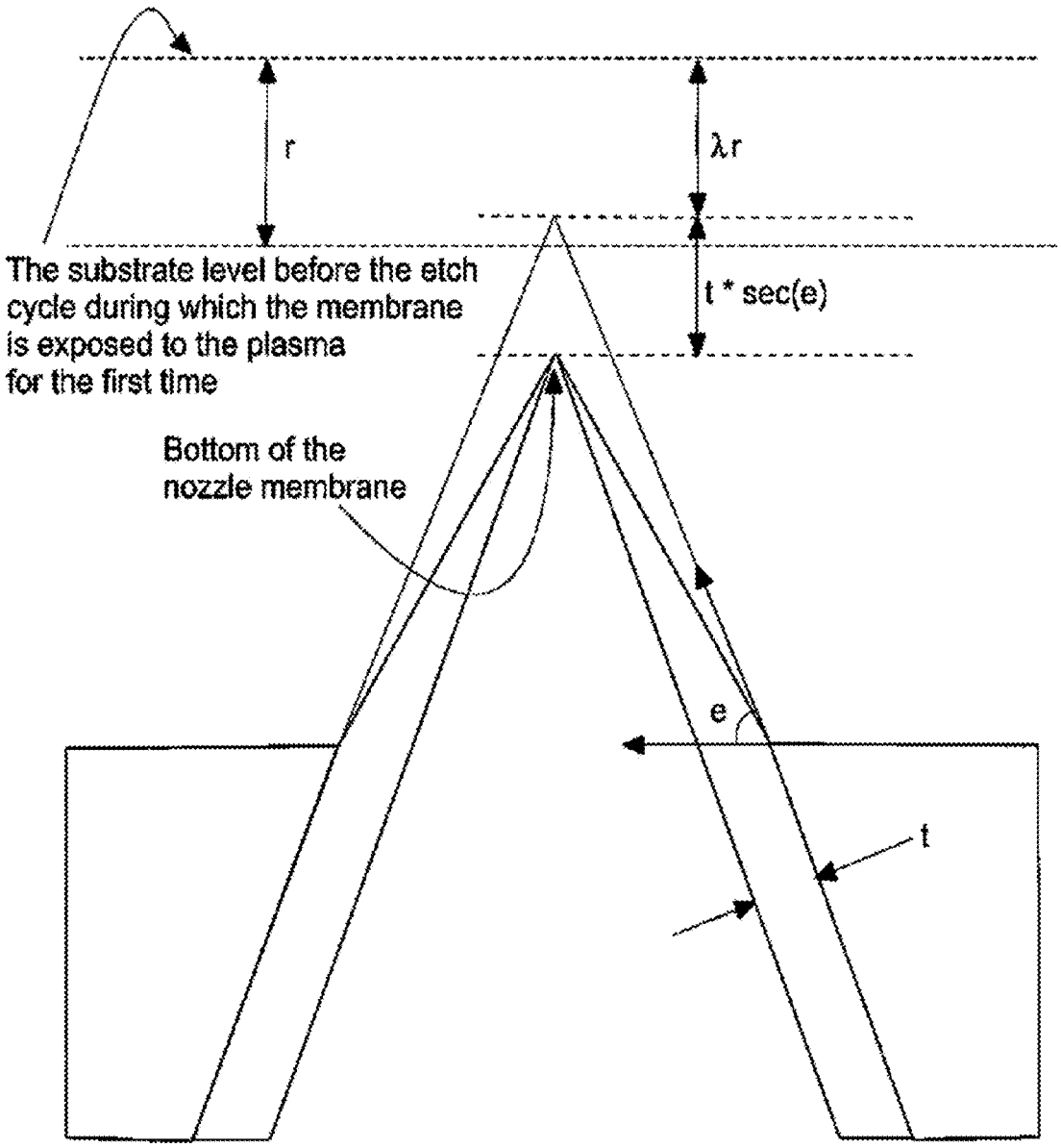
FIG. 13 Process resolution parameters.

In general, as shown in FIG. 13, the tolerances on wafer thickness and variations in etch steps produced by the DRIE cycles leave us with some uncertainty as to the level of the substrate at the end of the etch cycle before the apex of the nozzle membrane is first exposed to the plasma. This uncertainty translates into λ the fraction of the next cycle for which it is exposed. The etching due to this initial fraction of a cycle along with n subsequent cycles may create the situation described above, if $(1-\lambda)\times r/s+n\times(r/s)=t\times\sec(e)$, giving rise to a resolution on orifice dimension, defined by (9).

Using a typical value of r as 0.8 μm per cycle, t as 500 nm, e as 54.74° and s as 16 (if using silicon nitride as the nozzle membrane), the orifice resolution that can be obtained is less than or equal to 70.7 nm. One of the factors that will affect the uniformity of orifice sizes in a nozzle array is the total thickness variation (TTV) of the substrate wafer. The resulting variation in the orifice sizes, Δ, can be given by $$\Delta=2\times TTV/(s\times\tan(e))\times I/d \tag{10}$$

where d and TTV are the diameter and total thickness variation of the substrate wafer respectively and I is the dimension of a side of the nozzle array die. A typical value of TTV for a 100 mm test grade silicon wafer is 20 μm. Using a 5 mm square nozzle array die the variation in orifice sizes across a die due to TTV is 88.4 nm. The non-uniformity of DRIE etching rate across the substrate wafer is another source of nozzle orifice size variation. The typical value of such etch rate non-uniformity is less than 5% on the DRIE equipment used for the nozzle array fabrication process. Consequently, this non-uniformity in the etch rate across a substrate has a less significant effect on the orifice size variation as compared to that of substrate TTV. The non-uniformity of KOH etching rate across a substrate wafer does not play a significant role in determining the nozzle orifice variation as the nozzle pits form a natural etch stop for the KOH etch.

In addition to the uncertainties resulting from the previously mentioned non-uniformities, cycle-to-cycle variation in etch rates of the DRIE, variation in the thickness of the deposited membrane material, variation in the dimension of the pyramidal pits will add additional uncertainty, and hence variations in the orifice dimensions. The practical values for such variations are estimated hereinbelow.

Experiments: This section describes in detail the processes used to fabricate nozzle arrays.

(1) Substrate. The starting substrate is a 500 μm thick N-doped {1 0 0} oriented, test grade, double side polished, single crystal silicon wafer (purchased from Montco Silicon Technologies, Inc.). The wafer is coated with a 500 nm thick low stress LPCVD silicon nitride (FIG. 14A) film with a residual stress of around 50 MPa. The LPCVD process is carried out at a temperature of 825° C. and with gas flows of 71 sccm for dichlorosilane ($SiCl_2H_2$) and 11.8 sccm for ammonia ($NH_3$). The corresponding process pressure is around 250 mTorr.

Figure 15:
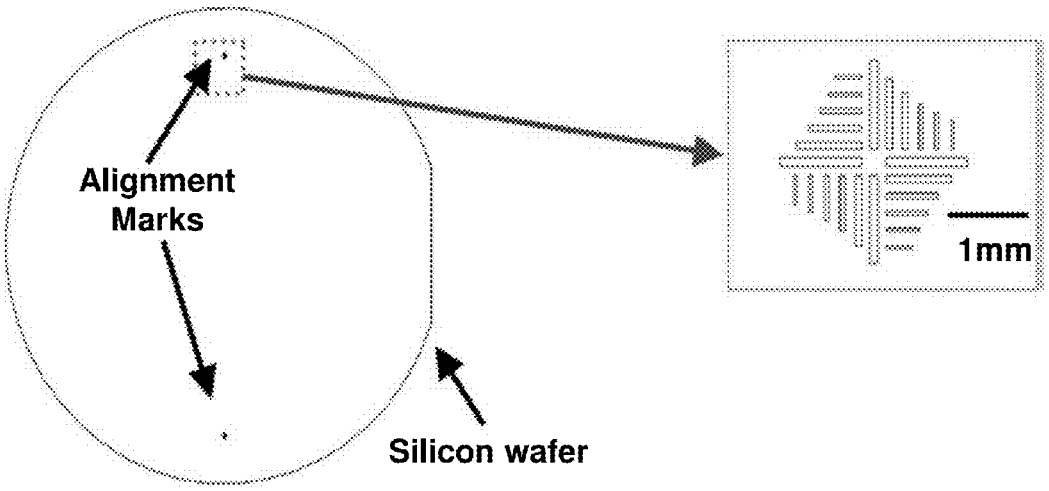
FIG. 15 The pre-etch alignment marks help detect the exact orientation of the silicon wafer crystal planes.

(2) Alignment pre-etch. The nozzle walls are aligned along the silicon {111} crystal planes. Hence, the substrate wafer is patterned and subjected to a short KOH etch to expose the exact orientation of the silicon wafer crystal planes. The pattern used for detecting the silicon crystal planes is shown in FIG. 15. The KOH etch is carried out with a concentration of 35% at 85° C., with a silicon etch rate of around 1.4 μm/min. The expected completion time for this etch is around 25 min.

(3) Lithography patterning. A chrome mask with the nozzle array pattern is made at a resolution of 40 640 DPI by Fineline Imaging. The nozzle array pattern consisted of a 50 by 50 array of 450 μm square apertures. The pitch size between the square apertures is 500 μm. This mask is used to pattern photoresist AZ 4620 (manufactured by Hoechst Celanese Corporation). This photoresist is spun at 3000 rpm to yield a 9 μm thick film. The photoresist is soft baked at 60° C. for 2 min followed by 110° C. bake for 2 min. The chrome mask is aligned to the wafer crystal plane (by using the pre-etch alignment marks) using an Electrons Vision Double Sided Mask Aligner with a dose of 500 mJ $cm^{-2}$. The photoresist is developed in 1:4 diluted AZ 400K solution (manufactured by Clariant Corporation) for 2 min 45 s followed by a 30 s development in 1:10 diluted AZ 400K solution. To remove the residual developer the wafer is soaked in a water bath for 1 min followed by a nitrogen blow dry. The patterned photoresist is hard baked at 160° C. for 15 min to remove the solvents in the photoresist film.

The exposed silicon nitride film is patterned (i.e. removed) (FIG. 14*b*) by using freon ($CF_4$) reactive ion etching (RIE) process with 35 mTorr process pressure at 100 W plasma RF power. The expected etch rate is 37.6 nm $min^{-1}$ for LPCVD silicon nitride. The 500 nm thick nitride film is removed in 13 min and 20 s. The photoresist is removed by using AZ 400T PR stripper (manufactured by Clariant Corporation) at 130° C. for 15 min. To remove the residual PR stripper the patterned substrate is thoroughly cleaned with DI water and is blown dry by nitrogen gun.

Figure 14:
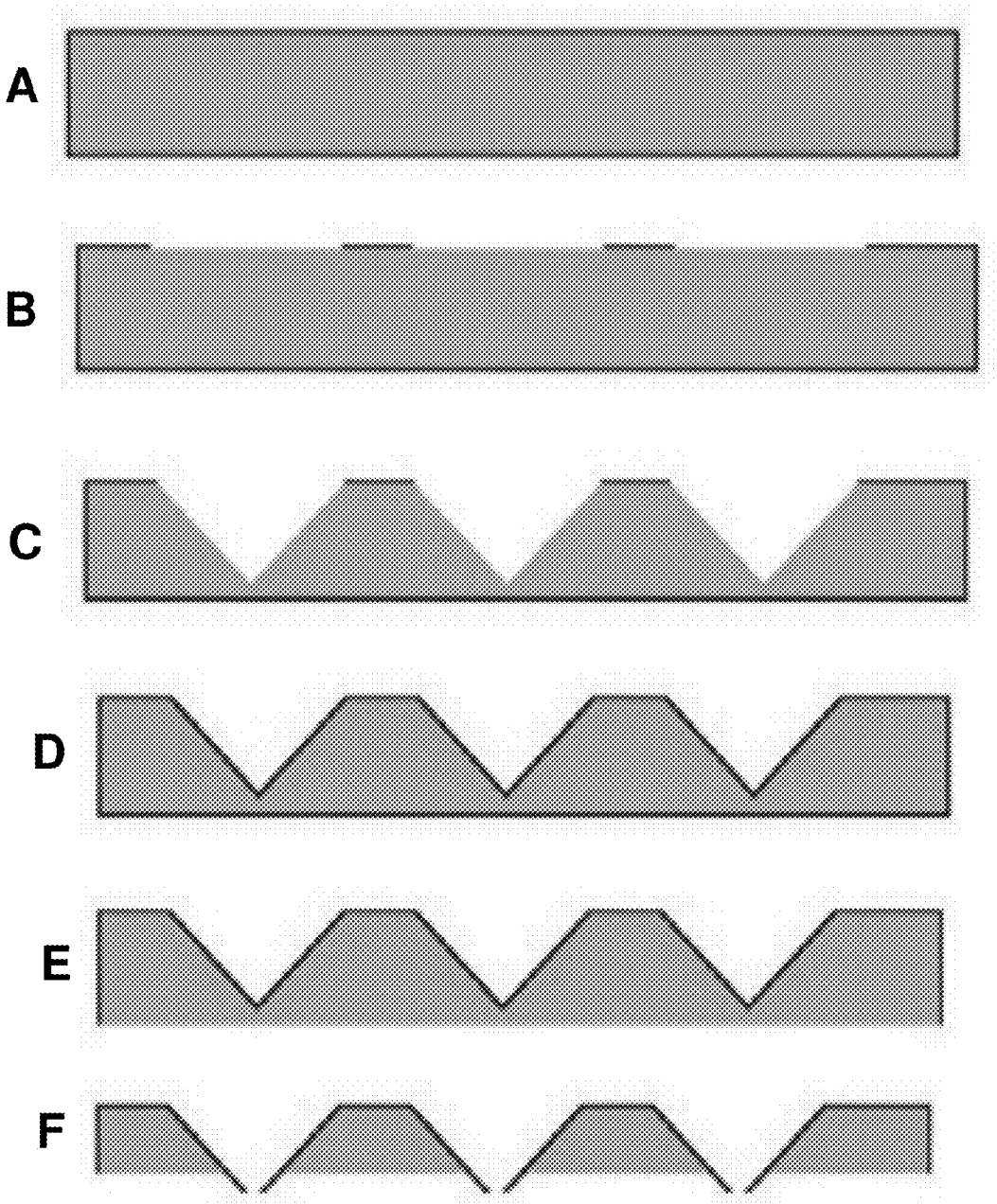
FIG. 14 Steps for nozzle fabrication: A deposit a layer of LPCVD silicon nitride on a silicon wafer. B Pattern the silicon nitride. C KOH etch (on the back side) to form nozzle pits. D Deposit LPCVD silicon nitride to conform to the pits. E RIE to remove silicon nitride (from the front side). F DRIE to form openings in the nozzles.

(4) Etching of pyramidal pits. The substrate with the patterned nitride film is put in a KOH etching solution under the same conditions used to pre-etch the substrate wafer for alignment purposes. This etching is used to form the inverted pyramids that form the shape of the nozzles (FIG. 14*c*). The expected etch time is around 3 h 47 min.

(5) Membrane deposition precise conditions. The inverted pyramids can be coated with either silicon nitride or silicon dioxide to form the nozzle membranes (FIG. 14*d*). The silicon nitride is deposited by the same LPCVD process used to deposit the initial silicon nitride coating on the substrate wafer. The silicon dioxide is deposited by low temperature oxidation (LTO) process at a temperature of 478° C. and with gas flows of 65 sccm for silane ($SiH_4$) and 130 sccm for oxygen.

(6) Removal of back surface nitride film. The nozzle membrane material is removed from the side of the wafer opposite to that of the inverted pyramids by using Freon RIE process (FIG. 14*e*). The processing conditions are similar to those used for initial patterning of the substrate wafer. The expected etch rate for LTO film removal under the freon RIE process is 21.1 nm $min.^{-1}$ A 500 nm thick LTO film is removed in 23 min and 42 s.

(7) Back surface etch (DRIE conditions). The nozzle tips are exposed and the orifices are opened by etching the entire back surface of the wafer in the PlasmaTherm SLR-770 DRIE (FIG. 15*f*). The details of the DRIE process parameters used for this etching step are given in TABLE 4.

TABLE 4

DRIE process parameters

| DRIE step | Deposition | Etching |
|---|---|---|
| Process time | 5 s | 7 s |
| SF6 flow rate | — | 100 sccm |
| C4F8 flow rate | 80 sccm | — |
| Ar flow rate | 40 sccm | 40 sccm |
| Electrode power | — | 8 W |
| Coil power | 850 W | 850 W |

Results and discussion. This section represents experimental work to demonstrate the feasibility of the outlined process in producing arrays of nozzles and confirms the theoretically predicted nozzle geometry. Additionally the process resolution or uncertainty is investigated and the ensuing results reported.

Figure 16:
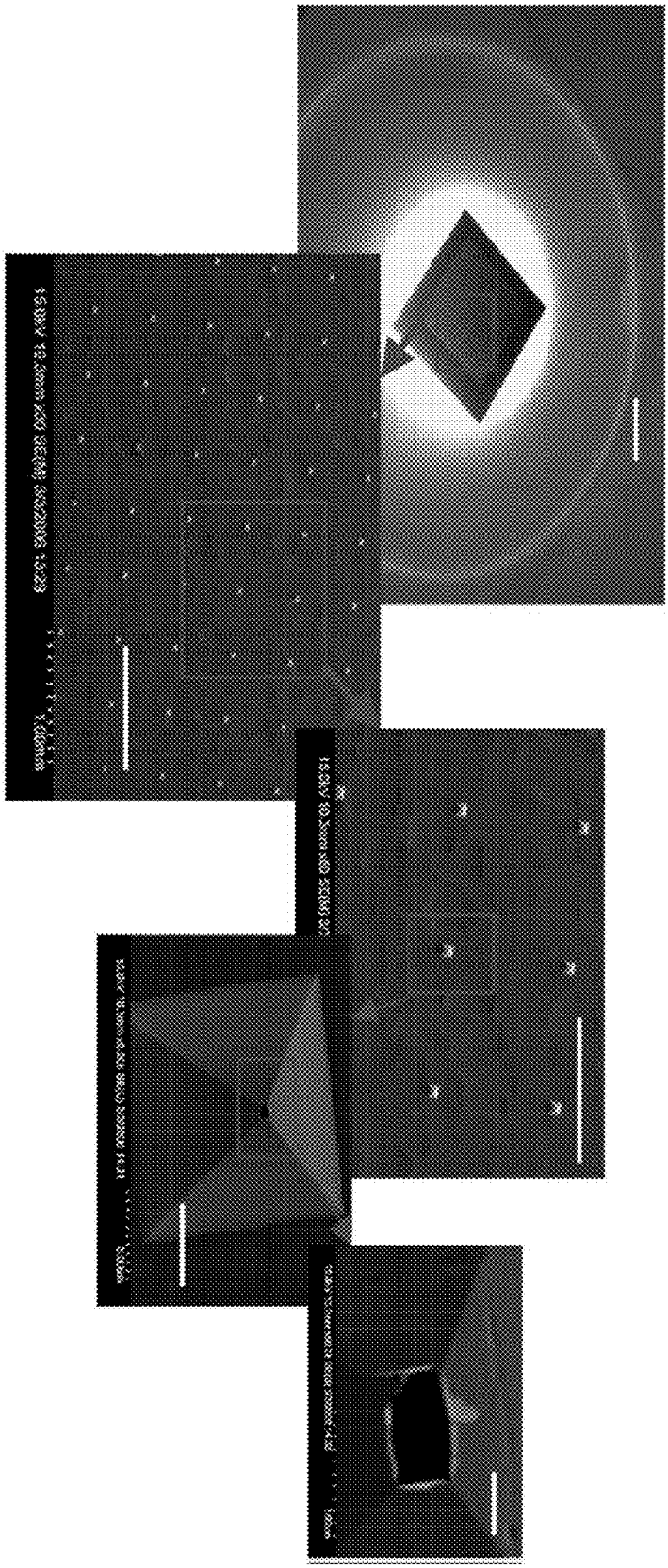

To demonstrate the feasibility of the proposed process, a nozzle array with 2500 nozzles in an area of 1 inch by 1 inch is fabricated. The center-to-center distance between the nozzles is 500 μm. This distance can be reduced further by decreasing the distance between the square mask openings and by using a thinner substrate wafer (a 500 μm wafer is used in these experiments). An orientation pre-etch in KOH is carried out on the substrate wafer to enable the alignment between the mask and the wafer crystal planes. This step is crucial in controlling the orifice aspect ratio as the KOH etch that forms the pyramidal pits is dependent upon the crystal plane directions. This pre-etch is followed by a KOH etch to form the pyramidal pits. A 500 nm thick LPCVD silicon nitride is deposited to form the nozzle membrane. To open up the nozzles the entire wafer is subjected to the DRIE process. The DRIE process opens up the nozzles to around 500 nm square orifices. Step-by-step zoomed optical and scanning electron micrographs (from Hitachi S-4800 SEM) of the fabricated array are shown in FIG. 16. The finished nozzles and their orifices are coated with a thin film of fluorocarbon polymer, a by-product of the DRIE process. This film can be removed by exposing the nozzle array die to oxygen plasma. The orifice in the right-most picture of FIG. 16 is rectangular, rather than square as predicted due to dimensional errors in the mask. Additionally the edges of the orifice are burred due to the relief of the residual stress in the membrane material, in this case silicon nitride.

Different materials are used as nozzle membranes to demonstrate the differences in the nozzle geometry for different applications. The first sample used 500 nm thick LPCVD silicon nitride as the nozzle membrane. The second sample was coated with 500 nm thick LTO film. The nozzles were opened up in both the samples using the DRIE process. To verify the predicted nozzle protrusion heights and flank angles in TABLE 3 each of two samples was then cross-sectioned using the FIB machining process (using FEI Dual-Beam DB-235). The verification of the theory was done by measuring the heights of the different nozzles and by demonstrating the thinning of the membrane cross-section from the base to the apex of the nozzle.

Figure 17:
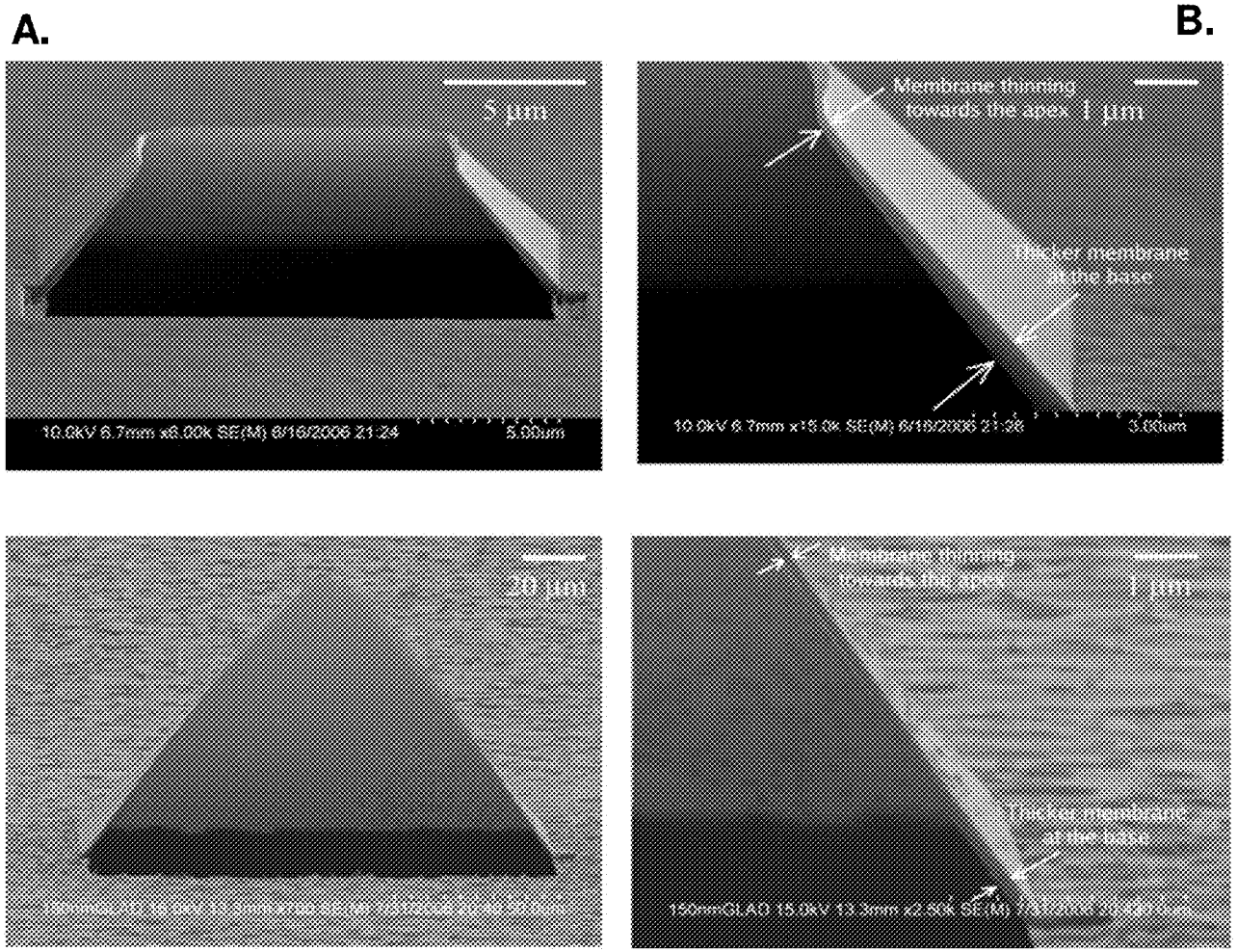
FIG. 17 Nozzle opening by selective etching process: A. cross section of a silicon nitride nozzle (approx. 14 μm nozzle height); B. close-up of the nitride nozzle cross section showing the thinning effect; C. cross section of a silicon dioxide nozzle (approx. 116 μm nozzle height); D. close-up of the dioxide nozzle cross section showing the thinning effect.

The cross-sectional views of the two samples are shown in FIG. 17. The selectivity between silicon dioxide and silicon in the DRIE process is higher than that between silicon nitride and silicon. This in turn translates to a larger silicon dioxide nozzle as compared to the silicon nitride nozzle. These differences in nozzle sizes, due to difference in etch rate selectivity ratios, can be exploited to fabricate nozzles of varying geometry. The nozzle heights correspond quite well to those in TABLE 3. For the silicon nitride nozzle, a nozzle height of around 14 μm is observed that agrees quite well with the theoretical value of 13 μm. For the silicon dioxide nozzle the observed height is approximately 116 μm and the theoretical value is around 103 μm. Additionally, the thickness variation in nozzle membrane from the base to the apex of the nozzle is more pronounced in the case of the nitride nozzle as compared to the oxide nozzle. This effect is as predicted from the flank angle calculations (TABLE 3) from the underlying theory that estimate flank angles of 52.98° and 54.51° for the nitride and oxide nozzle respectively. The closer the flank angle to the KOH etching angle, the less the thinning of the nozzle membrane (for a given distance along the flank).

Figure 18:
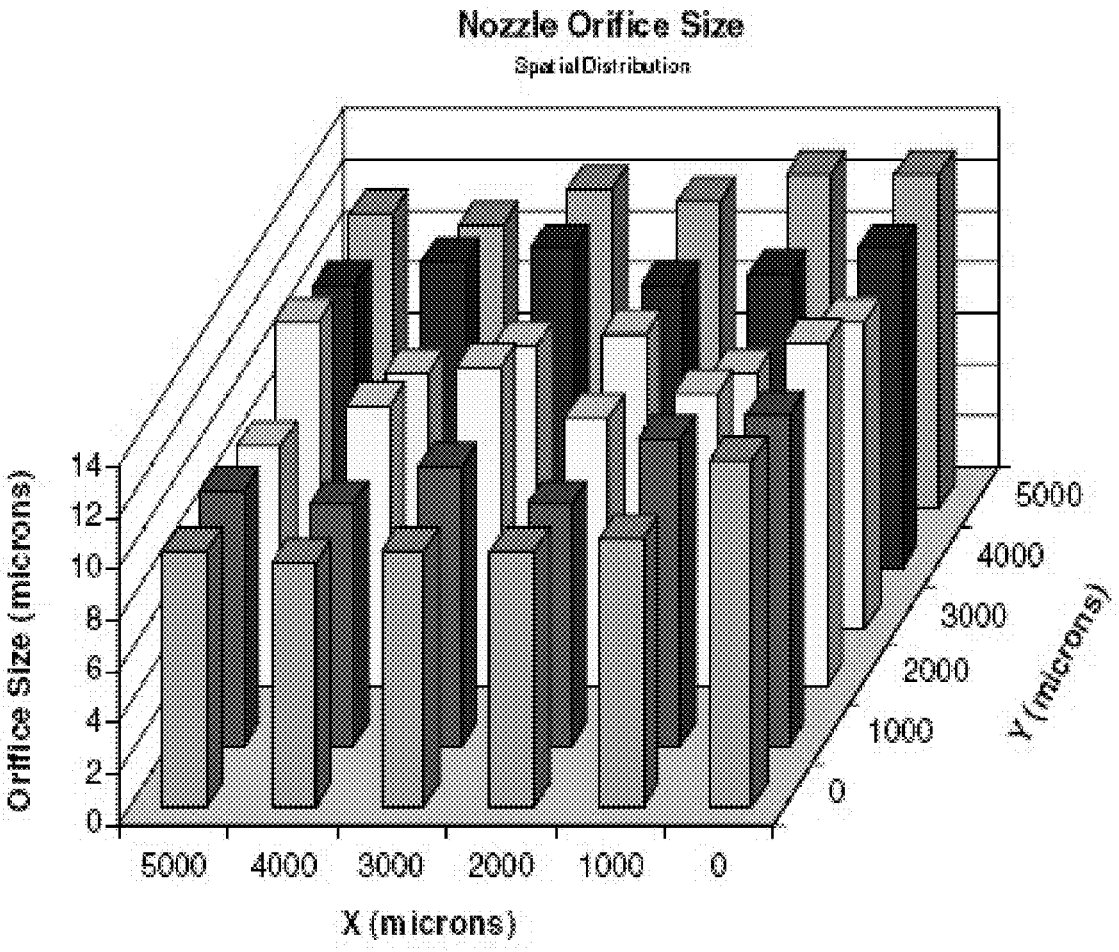
FIG. 18 Spatial distribution of nozzle orifice sizes.

Uniformity of orifice dimensions for nozzles in an array is an important attribute in applications such as contact printing. To estimate the control and uniformity of the process (under conditions typical of a university-based facility) a test die with a 24×24 silicon nitride nozzle array with a pitch of 200 μm and nominal nozzle orifice of 10 μm is fabricated (typical for micro contact printing of a micro array for biological applications). A uniformly distributed sample of 36 nozzles was measured by imaging the orifice size of every sixth nozzle across each row and column. The average orifice size of the sample was 11.3 μm with a standard deviation of 1.2 μm. FIG. 18 shows the variation in nozzle orifice size for each of the 36 nozzles as a function of their location on the die as well as the DRIE etching chamber. These results suggest that with moderate process controls and little precalibration, an acceptable resolution/variability of about 1 μm is possible. This variation in orifice sizes over the array can be attributed to various factors such as non-uniformity of the mask openings that led to variability in the depth of the pyramidal pits, spatial variation in etching rates of the DRIE equipment, variation in the thickness of the nitride film and variation of the wafer thickness. Specific characterization of each process step for a particular fabrication run would reduce variability. Additionally, the use of updated DRIE equipment with tighter etch control and substrate wafers with extremely low TTV would generate nozzle arrays with more regular orifice sizes.

Figure 19:
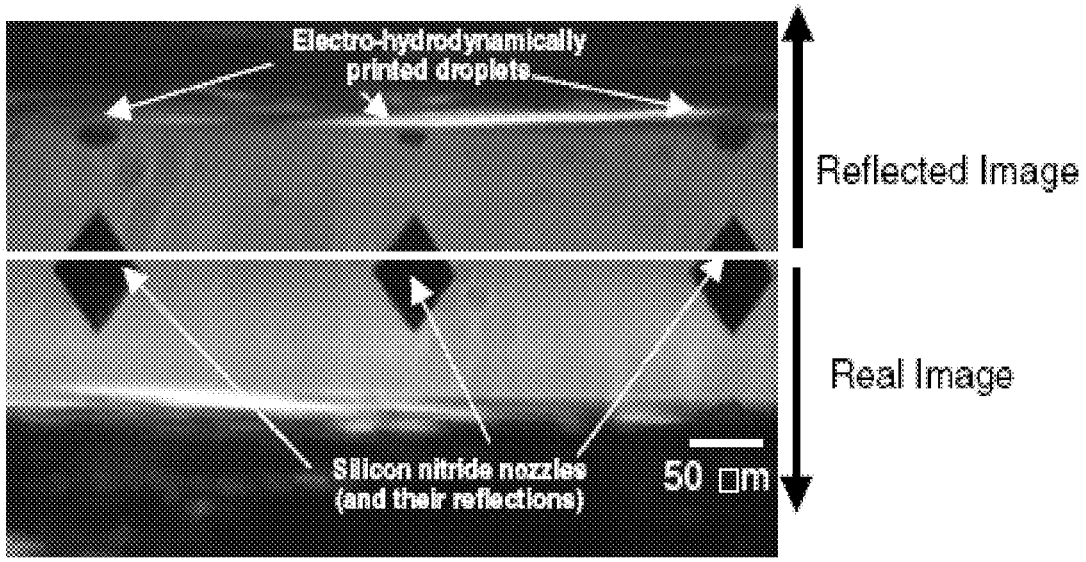
FIG. 19 Using the nozzle array for in-parallel electrohydrodynamic printing.

FIG. 19 is a micrograph of three silicon nitride nozzles and associated three electrohydrodynamic printed droplets.

This example presents a scalable fabrication procedure for making large-scale nozzle arrays with controllable orifice dimensions and protrudent nozzle geometry. The control over the nozzle geometry is achieved by using a selective etching process. This etching process exploits a combination of geometry and etching rate differences to create a nozzle tip and simultaneously open up nozzle orifices suitable for many materials. The variation in etch rate ratios obtained by changing the nozzle membrane material as well as the plasma composition can be used to make nozzles of varying protrudent geometries. Orifice dimensions can be decreased down to submicron dimensions using precise etch rate control of the DRIE (and other similar etching) process. The nozzle array fabrication procedure can generate arrays over a large area. The resulting arrays can be very dense. The substrate thickness places an upper limit on the maximum density that can be achieved without sacrificing the structural integrity of the array. However, by exploiting the 'floor cleaning' step of the SCREAM process [20] the nozzle density of the array can be further increased. The envisioned applications for the nozzles are quite varied in nature and range from multi-nozzle electrochemical deposition [21], electro-hydrodynamic printing (FIG. 19) and in-parallel direct writing.

[1] Cheung K, Kubow T and Lee L P 2002 2nd Ann. Int. Conf. on Microtechnologies in Medicine and Biology (Madison, Wash., USA) pp 71-5
[2] http://arrayit.com/Products/Printing/
[3] Jung M Y, Lyo I W, Kim D W and Choi S S 2000 J. Vac. Sci. Technol. A 18 1333-7
[4] Han W, Jafari M A, Danforth S C and Safari A 2002 J. Manuf. Sci. Eng. 124 462-72
[5] Morris T E, Murphy M C and Acharya S 2000 Proc. SPIE 4174 58-65
[6] Tang K, Lin Y, Matson D W, Kim T and Smith R D 2001 Anal. Chem. 73 1658-63
[7] Bassous E, Taub H H and Kuhn L 1977 Appl. Phys. Lett. 31 135-7
[8] Yuan S, Zhou Z, Wang G and Liu C 2003 Micoelectron. Eng. 66 767-72
[9] Kuoni A, Boillat M and de Rooji N F 2003 12th Int. Conf. on Solid State Sensors, Actuators and Microsystems (Boston, Mass.) vol 1 pp 372-5
[10] Anagnostopoulos C N, Chwalek J M, Delametter C N, Hawkins G A, Jeanmarie D L, Lebens J A, Lopez A and Trauernicht D P 2003 12th Int. Conf. on Solid State Sensors, Actuators and Microsystems (Boston, Mass.) vol 1 pp 368-71
[11] Smith J T, Viglianti B L and Reichert W M 2002 Langmuir 18 6289-93
[12] Farooqui M M and Evans A G R 1992 J. Microelectromech. Syst. 1 86-8
[13] Smith L, Soderbarg A and Bjorkengren U 1993 Sensors Actuators A 43 311-6
[14] Wang S, Zeng C, Lai S, Juang Y, Yang Y and Lee J L 2005 Adv. Mater. 17 1182-6
[15] Lewis J A and Gratson G A 2004 Mater. Today 7 32-9
[16] Bean K E 1978 IEEE Trans. Electron Devices 25 1185-93
[17] Williams K R and Muller R S 1996 J. Microelectromech. Syst. 5 256-69
[18] Williams K R, Gupta K and Wasilik M 2003 J. Microelectromech. Syst. 12 761-78
[19] www.latech.edu/tech/engr/bme/gale classes/biomems/dry%20etching.pdf
[20] MacDonald N C 1996 Microelectron. Eng. 32 49-73
[21] Suryavanshi A P and Yu M 2006 Appl. Phys. Lett. 88 083103-3 930

Figure 20:
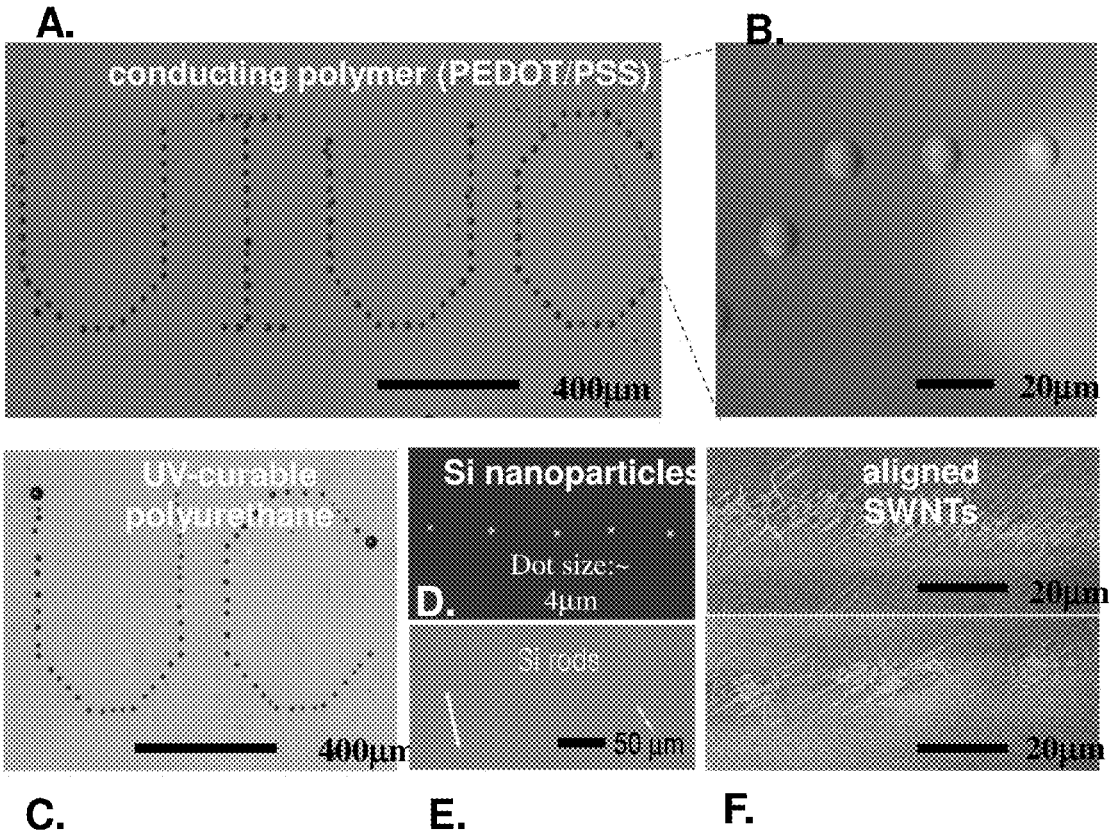
FIG. 20 Panels A-F are images of printed features using 30 μm ID nozzles. The printed dots have diameters that are less than or equal to 10 μm.
Figure 21:
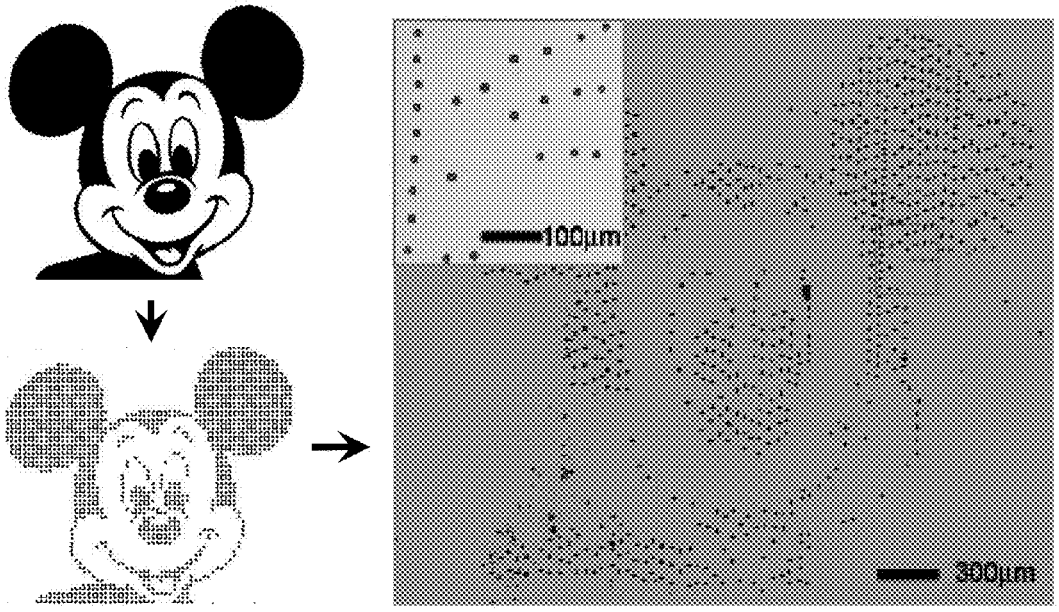
FIG. 21 Illustrates that complex features may be e-jet printed, in this case having an average printed dot diameter (±SD) of 11±1.6 μm using a 30 μm ID nozzle.

FIG. 20 summarizes printing results using a variety of printing fluids and inks, each providing high-resolution printing. The ejection orifice has a diameter that is about 30 μm in diameter, resulting in printed dot sizes that are less than about 10 μm. FIG. 20A shows a printed conducting polymer (PEDOT/PSS) and 20B a close-up view of the printed dots of A. FIG. 20C shows a UV-curable polyurethane printed feature. FIGS. 20D and E show printed Si nanoparticles and rods, respectively. In 20F aligned SWNTs are printed onto the substrate surface. A more complex printed shape is shown in FIG. 21, from a 30 μm nozzle, with a resultant 11 μm average diameter printed dot.

Figure 22:
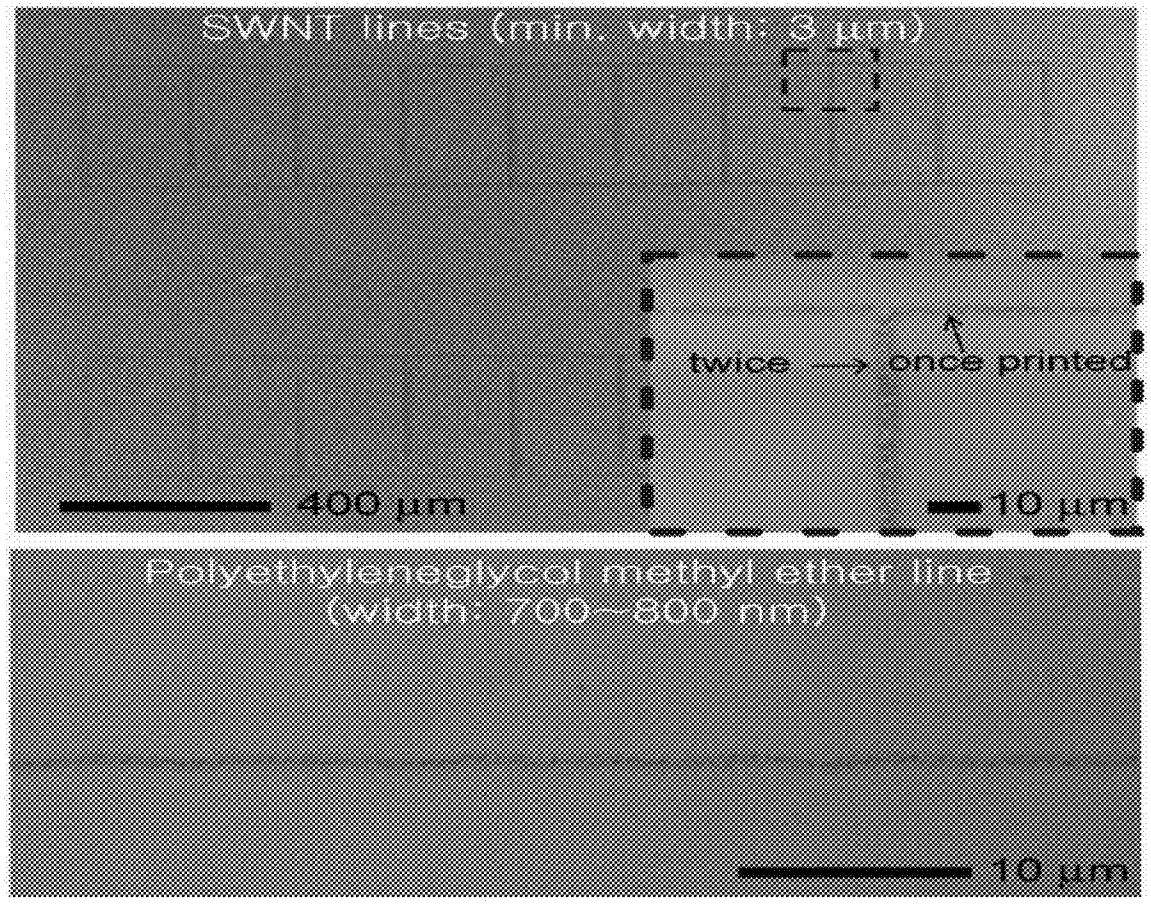
FIG. 22 demonstrates the e-jet systems and related printing methods are capable of high resolution line printing. In this example the lines comprise SWNT lines having a minimum width of 3 μm. The inset is a close-up view illustrating that the lines may be repeatedly and reliably reprinted to generate thicker SWNT lines. The bottom panel shows even higher resolution is possible, down to the sub-micron range. In this example polyethyleneglycol methyl ether lines having a width between about 700-800 nm are generated.

FIG. 22 shows printed SWNT lines having a minimum width of 3 μm. The scale bar in the upper panel is 400 μm. The inset is a close-up view of the printed SWNT lines, with the scale bar indicating 10 μm. The bottom panel is a printed line feature that is polyethyleneglycol methyl ether.

Example 6

Multiple Substrate Electrodes

Figure 23:
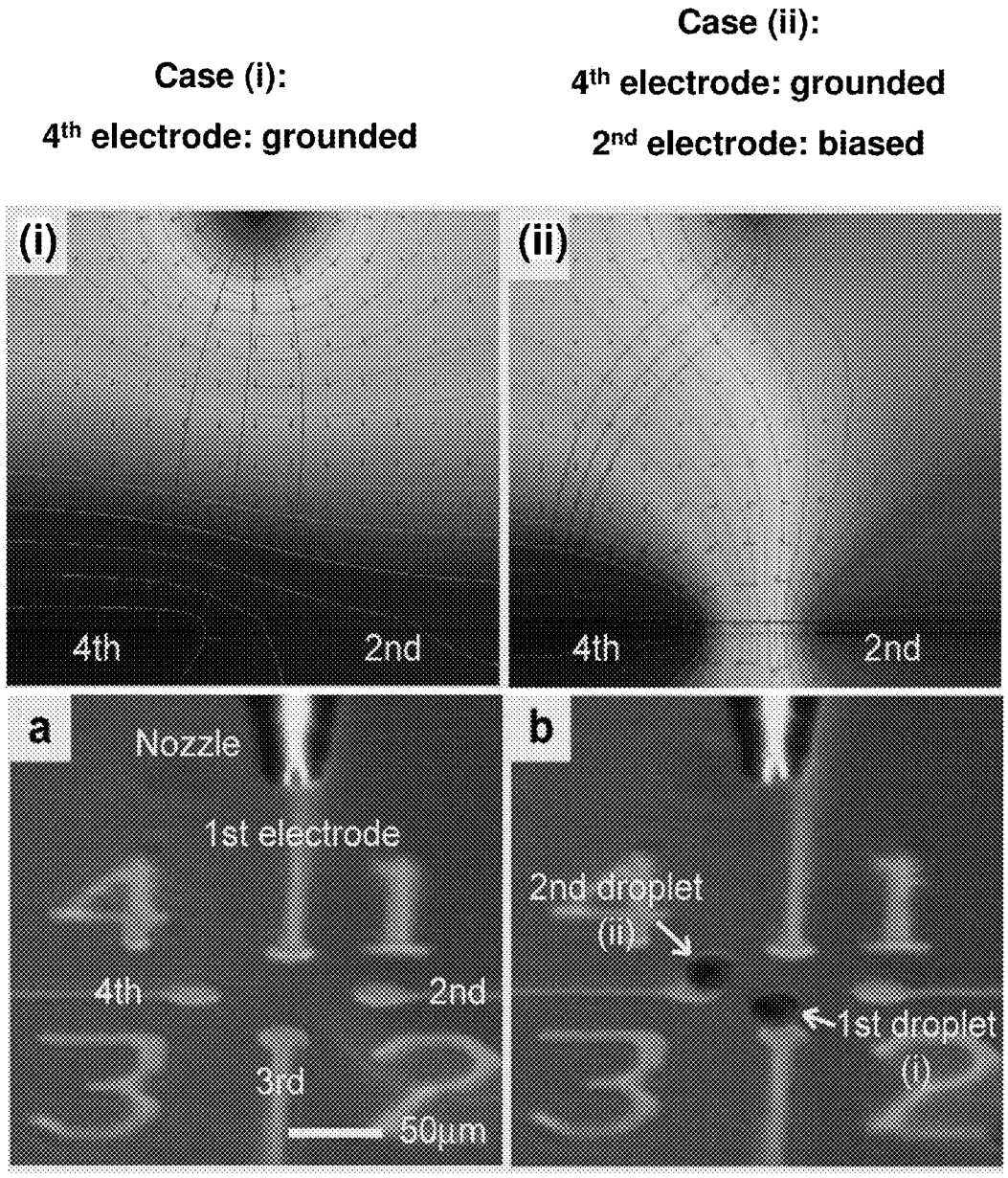
FIG. 23 is the computed electric field in response to multiple electrode activation to the substrate. In panel (i) the fourth electrode is grounded. In panel (ii) the 2nd electrode is biased, thereby altering the electric field. Panel (a) is a micrograph of the substrate surface prior to printing and (b) is after printing under condition (i) and condition (ii) (where the 2nd electrode is energized). Panel (b) shows that the deposition location of the e-jet printed dot can be controlled by effecting a change in the electric field.

Further placement control is achieved by manipulating or varying the electric field between the ejection orifice and surface to-be-printed. FIG. 23 provides a perspective view of a nozzle and a substrate surface having four electrodes. There are two cases corresponding to: (i) $4^{th}$ electrode grounded; and (ii) $4^{th}$ electrode grounded and $2^{nd}$ electrode biased. The top two panels of FIG. 23 show the computed electric field. The bottom left panel shows the positions of the four electrodes and nozzle. The bottom right panel shows the position of the printed droplets. In case (i) the printed droplet is centered beneath the nozzle ejection orifice, whereas in case (ii), under the influence of a second charged electrode, the droplet position is off-center. Additional independently addressable electrodes provides capability to further control placement of printed features.

Example 7

Printing Resists and Circuits

Figure 24:
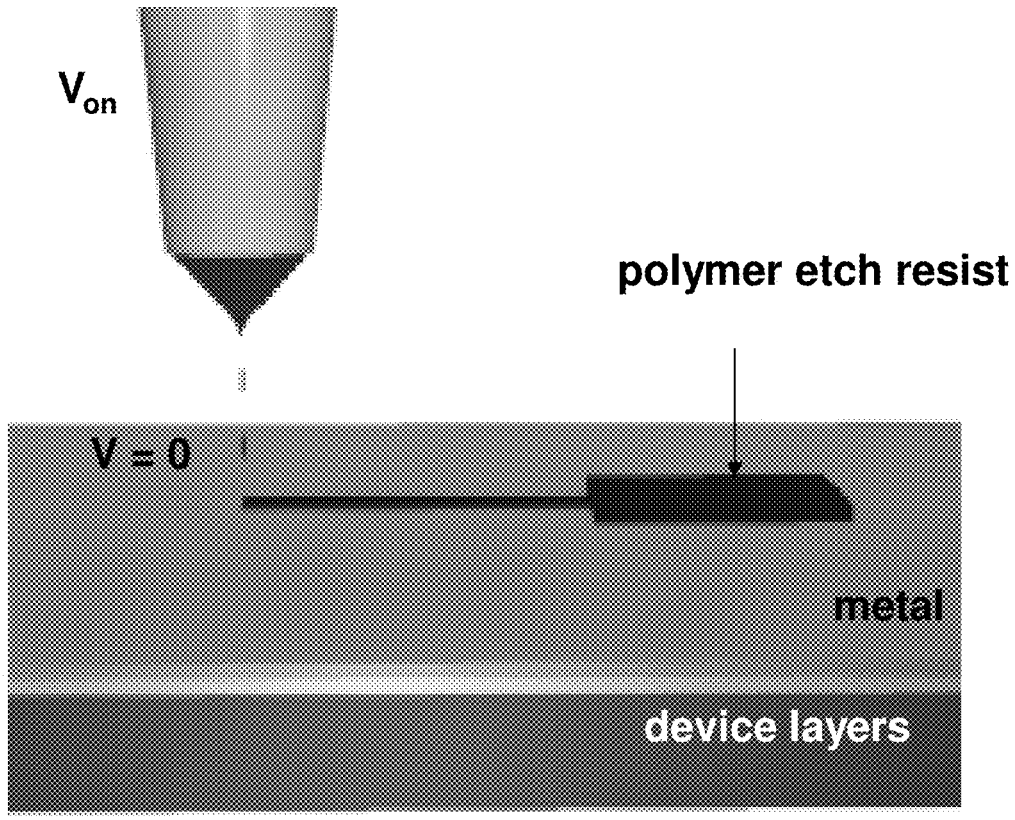
FIG. 24 schematically illustrates a system for complex electrode printing for circuits, where a polymer etch resist is printed on a substrate surface. The etch resist subsequently protects the correspondingly covered portion from subsequent etching steps, and is removed to reveal an underlying feature on a device layer, as shown in FIG. 25. The present illustration shows that the system is capable of patterning ink lines having a width of 2±0.4 μm without additional substrate wetting or relief assist features.

FIG. 24 schematically illustrates a system for complex electrode printing for circuits, where a polymer etch resist is printed on a substrate surface. The etch resist subsequently protects the correspondingly covered portion from subsequent etching steps, and is removed to reveal an underlying feature on a device layer, as shown in FIG. 25. The present illustration shows that the system is capable of patterning ink lines having a width of 2±0.4 μm without additional substrate wetting or relief assist features. For comparison, conventional inkjet printing is not capable of reliably printing lines with widths less than about 20 μm. The schematic illustrated in FIG. 24 is particularly useful for making functional devices or device components by subsequent surface-processing steps known in the art. For example, FIG. 25 (see also FIG. 9) shows the e-jet deposited resist is useful in making a variety of electronic devices and device components, such as the exemplified 5-ring oscillator shown in the bottom panel.

Example 8

Printing Biological Inks

Figure 26:
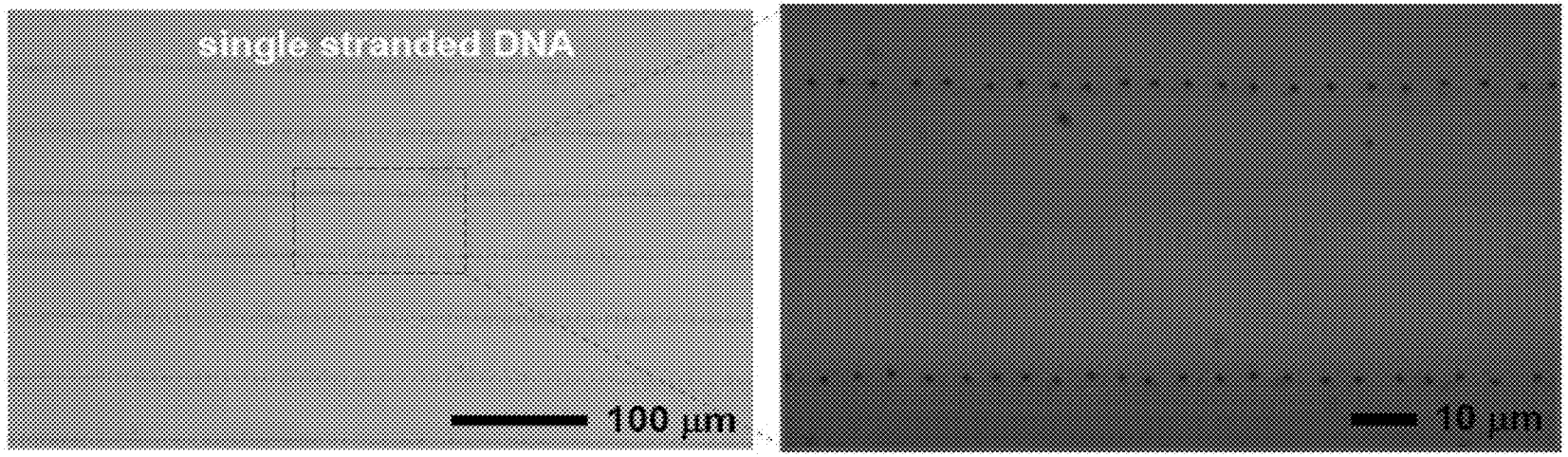
FIG. 26 illustrates printing of a biological ink comprising an aqueous suspension of DNA (1 uM single stranded DNA in an aqueous buffer (50 mM NaCl/MES with 10 wt % glycerin). A shows DNA printed in lines (scale bar 100 μm). B is a close up view as indicated by the dashed lines (scale bar 10 um).

In addition to printing inorganic features or precursor features, the devices and systems are capable of printing organic features. For example, FIG. 26 shows an array of single stranded DNA printed to a substrate surface. The DNA is printed in a series of parallel lines. In a similar manner, other biological materials may be printed including, but not limited to, proteins, RNA, polynucleotides, polypeptides, cells, antibodies. One advantage of this e-jet system is that any type of pattern is readily printed.

Example 9

Multiple Nozzle e-Jet Printhead with Microfluidic Channels

Figure 27:
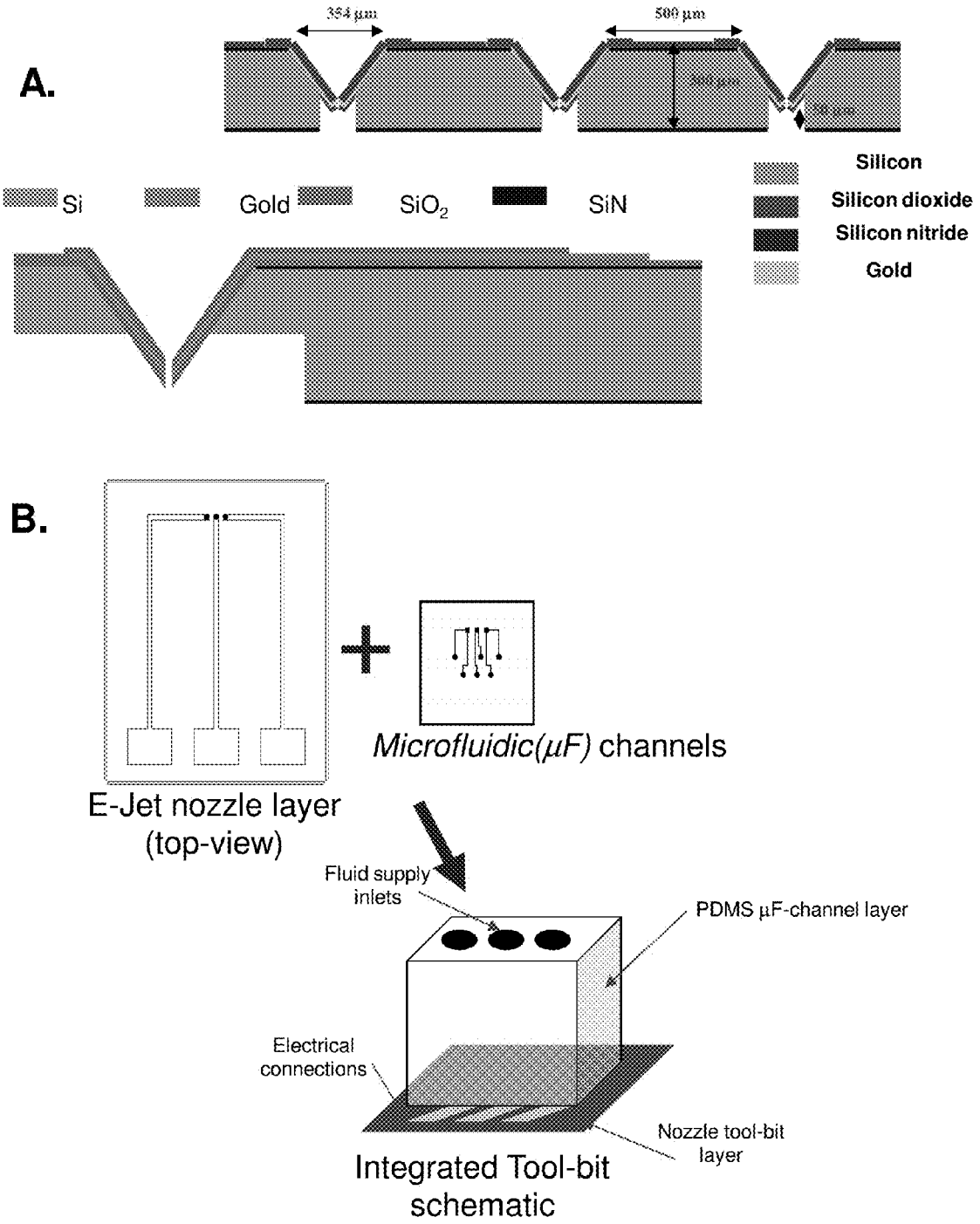
FIG. 27 E-Jet printhead with microfluidic channels to provide individually-addressable nozzles. A cross-section showing three nozzles in a silicon substrate. The nozzle is coated with a silicon dioxide layer and has a gold layer for establishing electrical contact with a power supply. B The top panel is a top-view of the E-jet nozzle layer and microfluidic channels. Typical microfluidic channels have a cross-section that is 50 μm×100 μm. The bottom panel illustrates the channels may be disposed within a PDMS material, with one end in fluid communication with fluid printing reservoirs, and the other end in fluid communication with the nozzles. C is a photograph of an integrated toolbit layer having nozzles operably connected to a microfluidic layer transport system.
Figure 27:
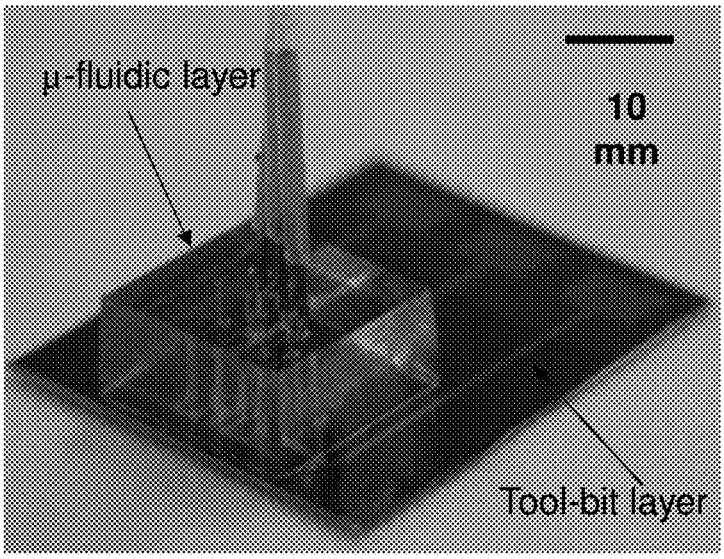

FIG. 27 is a schematic illustration of an e-jet printhead with microfluidic channels to provide individually-addressable nozzles. Each nozzle is capable of being connected to a reservoir of a distinct printing fluid and is optionally connected to an individual voltage-generating source. An "individually addressable nozzle" refers to the nozzle having independent control of one or both of printing fluid and electric charge, so that fluid is capable of being printed out of a nozzle independent of the status of another nozzle. Microfluidic channel refers to at least one dimension of the channel having a dimension on the order of microns, for example, a microfluidic channel having a cross-section that is 50 μm×100 μm. The bottom panel illustrates the channels may be disposed within a PDMS material, as known in the art, with one end in fluid communication with fluid printing reservoirs, and the other end in fluid communication with the nozzles. Such an integrated printhead provides ease of fluid communication with one or more printing fluids as well as ease of electrical contact with a voltage generating source vie electrical connections.

Example 10

High-Resolution Printing Via Small Nozzle Orifice or Substrate Assist Features

Figure 28:
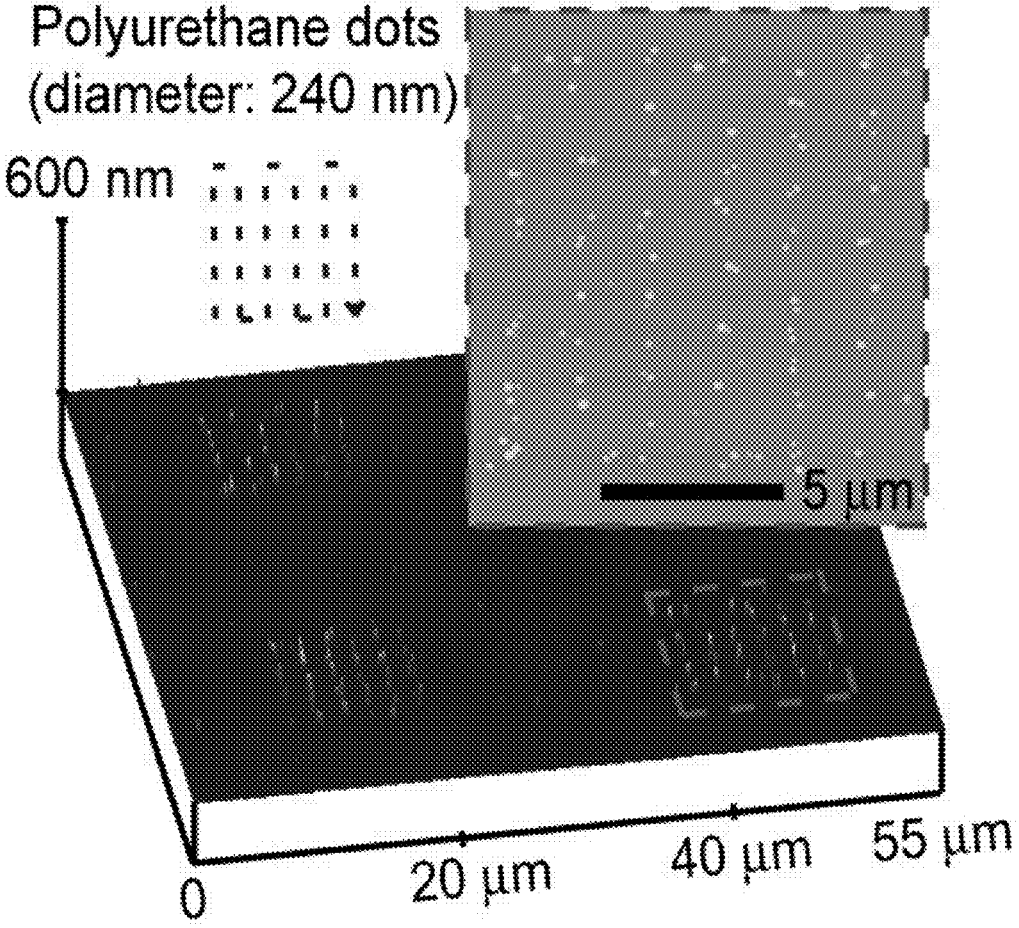
FIG. 28 is a 3D AFM image of aligned arrays of dots with diameters of 240±50 nm, formed using the polyurethane and a 300 nm ID nozzle. Blue dashed lines show the scan direction of the nozzle, and the inset in right-top presents a magnified AFM image of the printed dot array.

FIGS. 28-31 provide examples of a variety of optional systems and methods for accessing nanometer-resolution features. FIG. 28 is an image of printed dots having sub-micron resolution (e.g., diameter of 240 nm) achieved by printing with a 300 nm inner diameter nozzle. The inset is a magnified view (scale bar 5 μm) showing good alignment of the printed nanofeatures.

Figure 29:
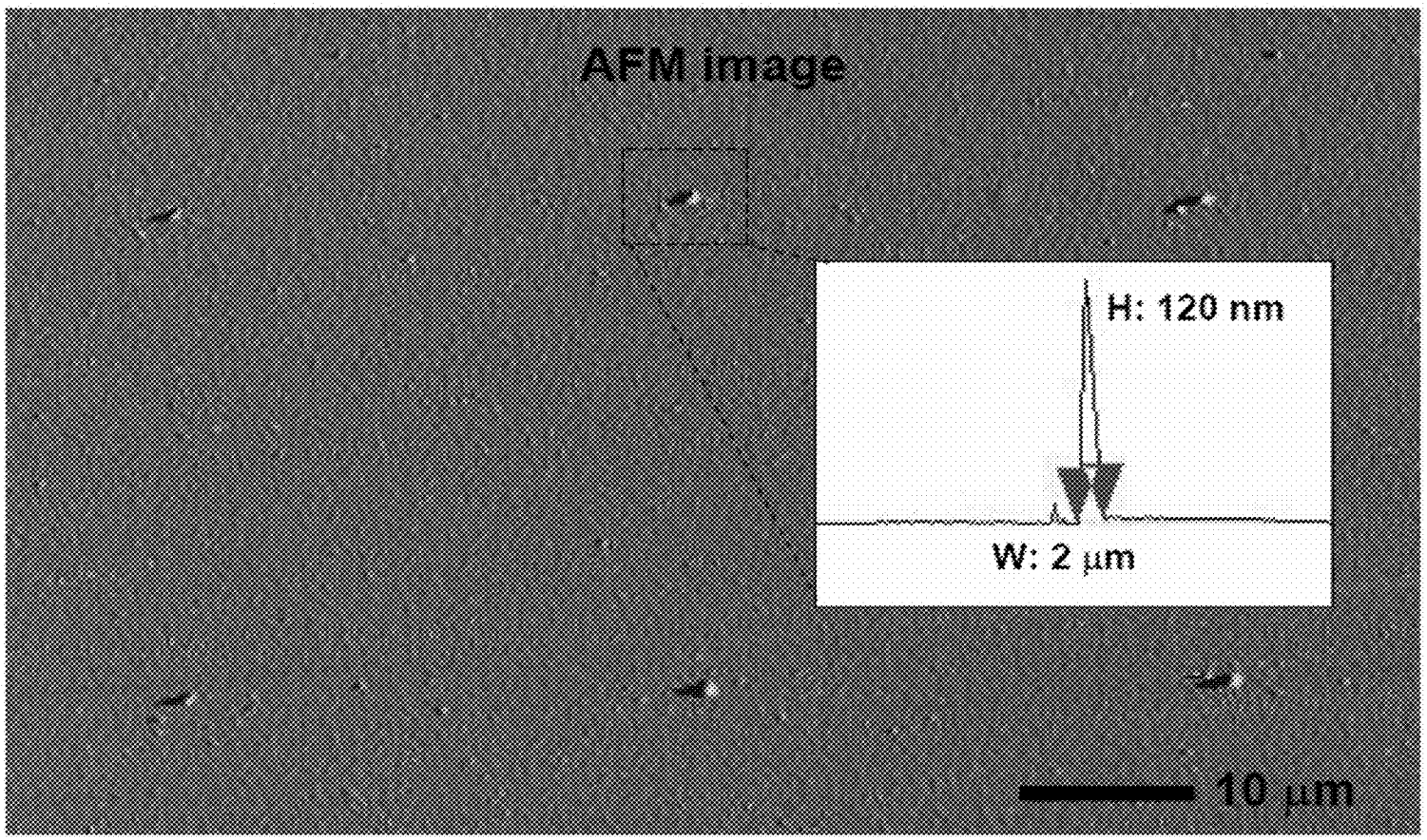
FIG. 29 is an AFM image of printed BSA (Bovine Serum Albumin) protein dots, having a diameter of about 2 μm.

An example of a printed feature that is a protein is shown in FIG. 29, where BSA is deposited on the surface in the form of protein microdot. This example indicates the systems and methods of the present invention can be used to print biological material (e.g., printing fluid comprising a solution of biological features or material) in any type of pattern or shape, and therefore is amenable for incorporation into any number of biological devices such as detectors, chips, flow assays, etc.

Figure 30:
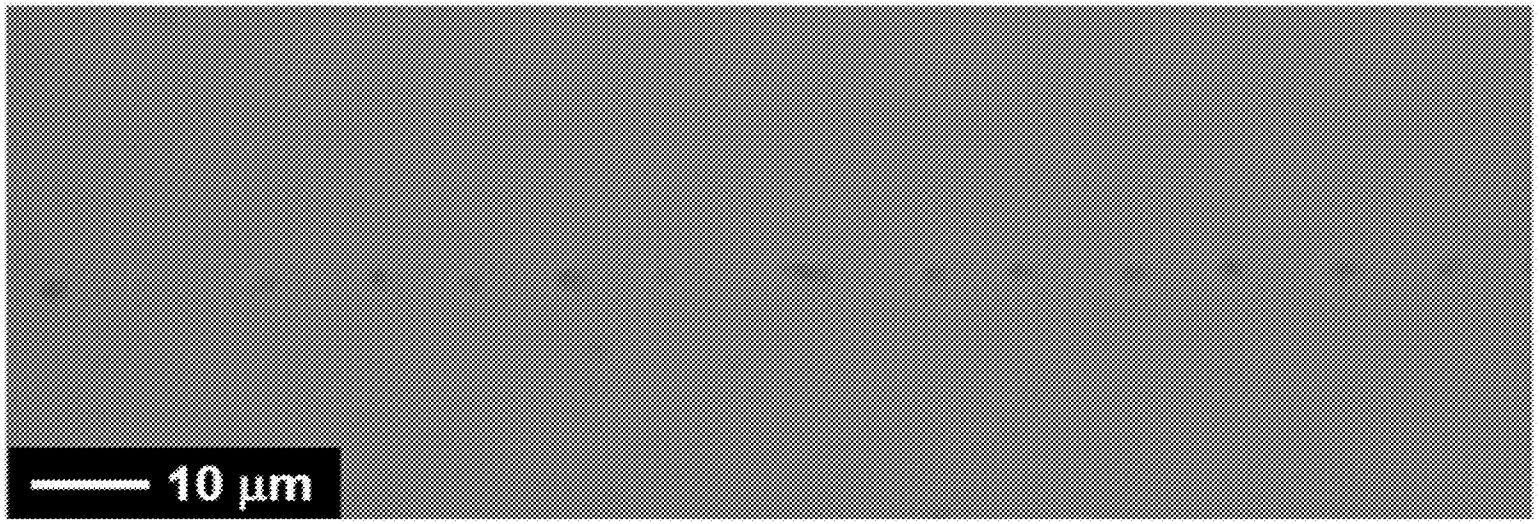
FIG. 30 is an optical micrograph of printed amorphous carbon nanoparticles

The systems and methods presented herein are capable of printing nanofeatures or microfeatures. FIG. 30 shows a microfeature that comprises printed amorphous carbon nanoparticles.

Figure 31:
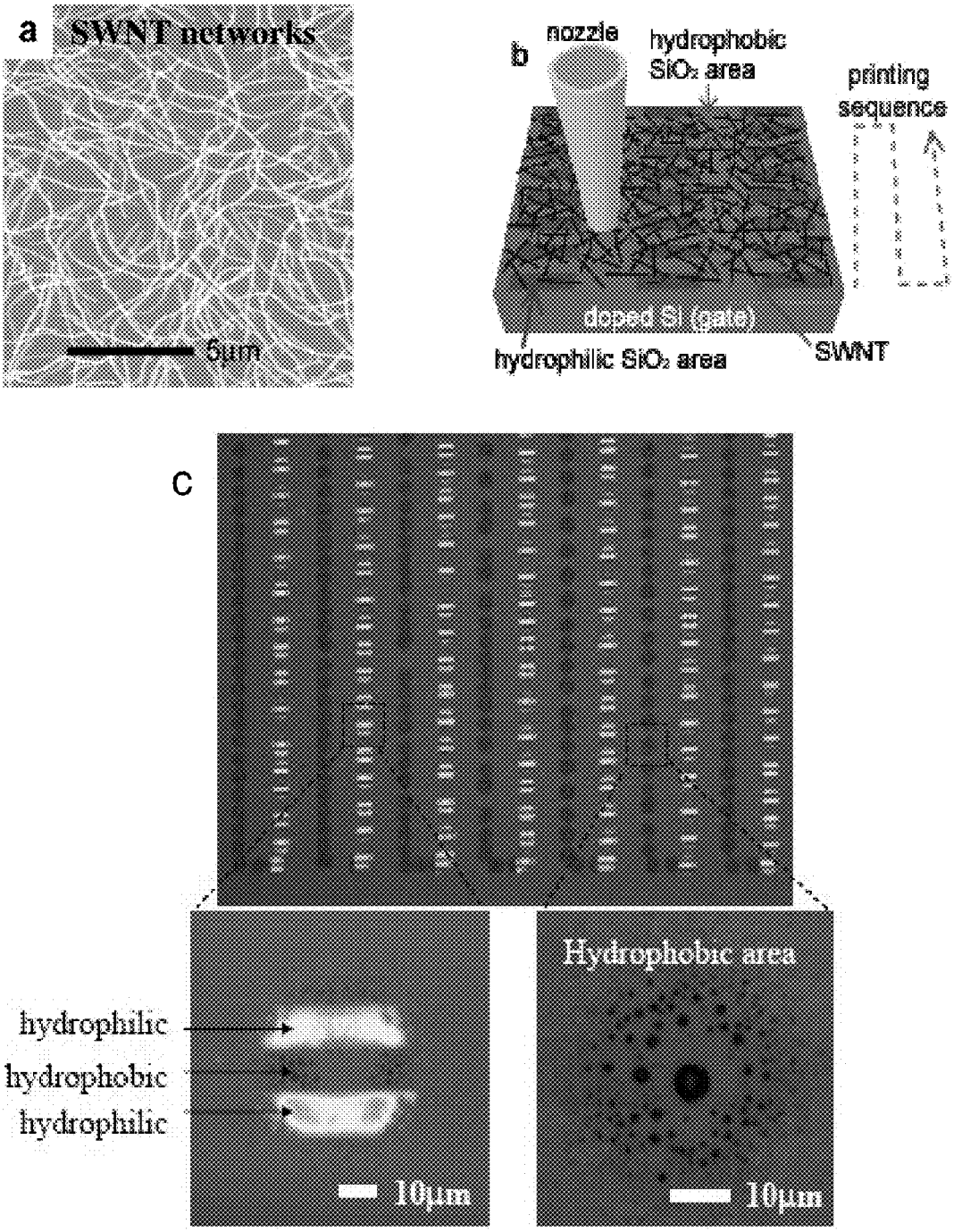
FIG. 31 Bottom panel (c) are optical micrographs of printed silver nanoparticles on hydrophilic and hydrophobic surface patterns on a substrate. The aqueous suspension of silver nanoparticles were wet and spread on hydrophilic areas while the printed solution dewet on hydrophobic areas. The top left panel (a) illustrates a printed SWNT network and top right panel (b) a schematic illustration patterned with hydrophobic and hydrophilic regions and the printing direction of the nozzle.

Providing a substrate having a substrate assist feature is provides an additional mechanism for accessing printing methods and systems with high placement accuracy. FIG. 31 illustrates such a system where the substrate assist feature comprises patterns of hydrophobic and hydrophilic regions, as indicated by the inset panels. In this example, an aqueous suspension of silver nanoparticles spread on regions corresponding to hydrophilic areas, whereas the printed solution does not wet the hydrophobic areas. Accordingly, patterning a substrate surface with this sort of assist feature, or alternative features such as electric charge, surface activation, or physical barriers, provides a means for constraining printing fluid deposition.

Example 11

Printing on Electrode-Less Substrates and Oscillating-Field Printing

Figure 32:
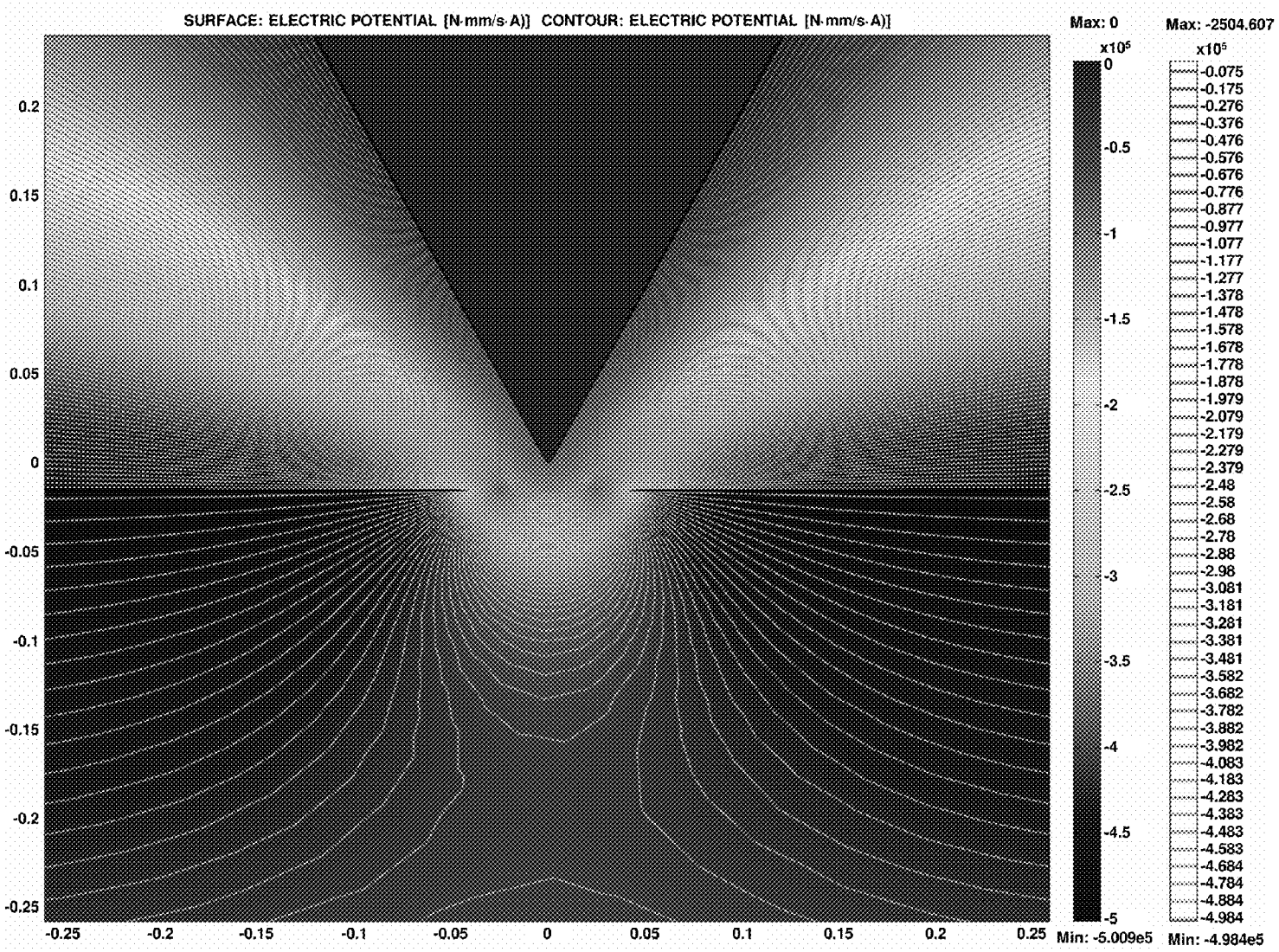
FIG. 32 is the computation of the electric potential and the equipotential lines for a nozzle with both the electrode and the counter-electrode embedded in its structure. In this example the electrode is held at a ground potential and a potential is applied to the counter-electrode.
Figure 33:
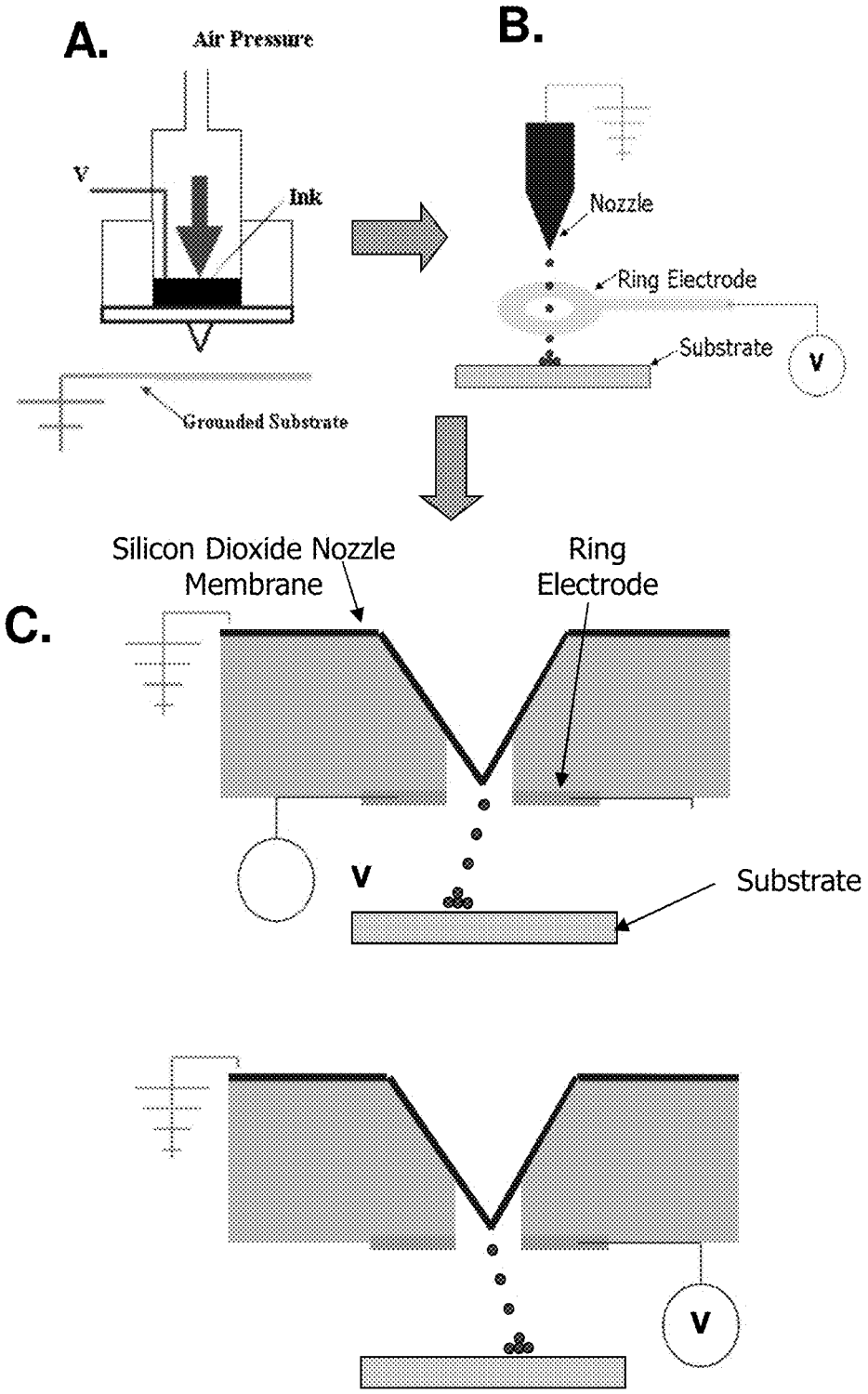
FIG. 33 summarizes a number of different inkjet printing schemes. A is a conventional ink jet printer where the fluid is displaced in response to a non-electrical force and ejected out of the nozzle. B is an ejet system having two electrodes, where the biased electrode is a ring electrode positioned between the substrate and nozzle (e.g., a "nonintegrated-electrode nozzle"). C is an ejet system with an "integrated-electrode nozzle", with both electrodes integrated with the nozzle. In this example, the counter electrode on the bottom surface of the nozzle is comprises two distinct electrodes and by varying which electrode is charged, the corresponding printing direction is varied (compare bottom two panels).

Incorporating an electrode and counter-electrode into the nozzle is advantageous for a number of reasons. First, integrated-electrode nozzles provide a configuration where there is no need to provide an electrode in electrical communication with a substrate or support. This provides an ability to print on non-conducting substrates or dielectrics as well as providing additional printing flexibility. FIG. 32 is a numerical experiment showing the electric field generated by a nozzle having integrated electrode and counter-electrode pair and indicates such a geometry is capable of providing a focused electric field between the nozzle and substrate. FIG. 33 provides a summary of the basic configuration of such a system, as well illustrating some differences in the basic configuration of inkjet printing (FIG. 33A), ejet printing with a nonintegrated electrode nozzle (FIG. 33B) and ejet printing with an integrated-electrode nozzle (FIG. 33C).

Figure 34:
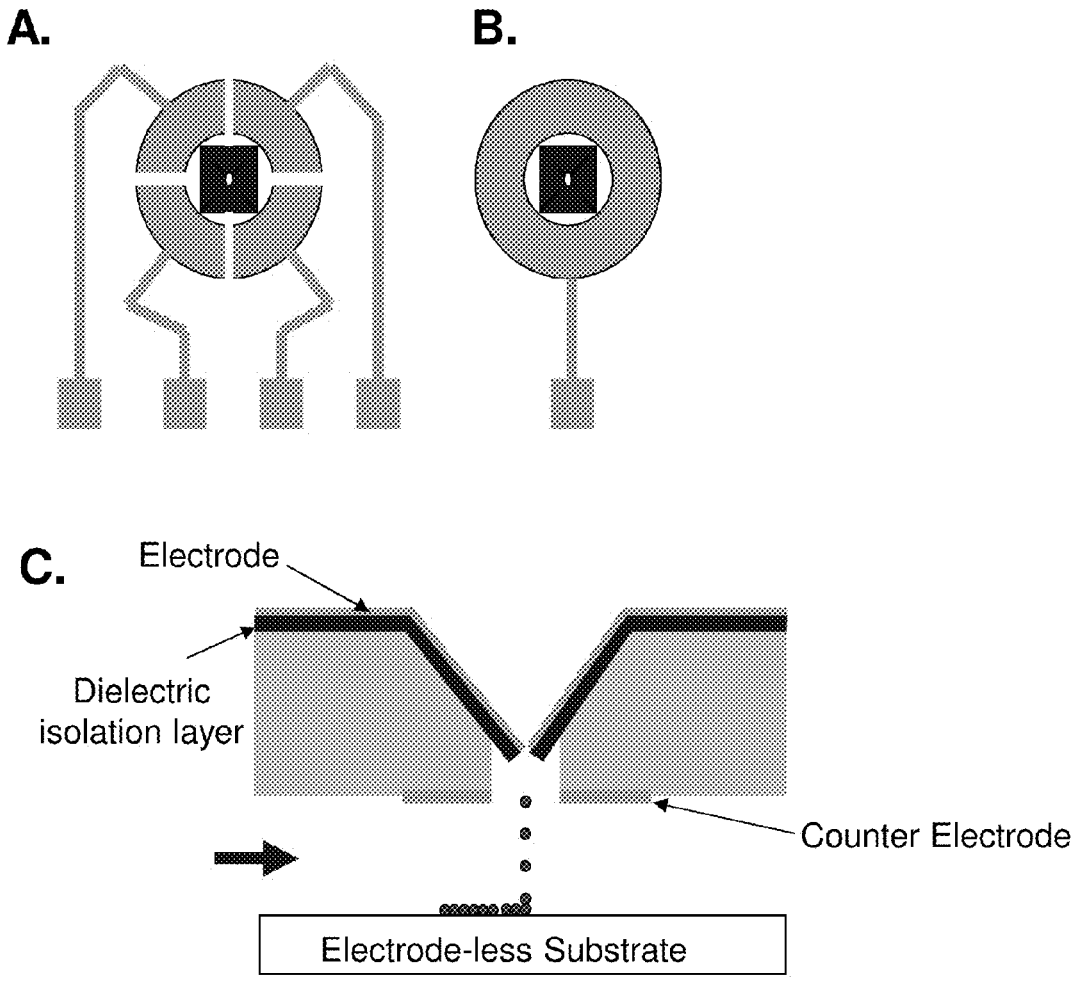
FIG. 34 shows the schematic of the nozzle structure with both the electrode and the counter-electrode embedded in the nozzle structure. Different designs of counter-electrodes are presented. In A the counter electrode comprises four independently addressable electrodes, positioned to form a ring similar to B, where the counter electrode is a single ring electrode. C is a side view of the ring electrode system, where a uniform ring electric field results in substantially perpendicular printing direction. In this embodiment, an electrode connected to the substrate is not required.

Second, printing trajectory or direction can be readily and precisely controlled by providing an inhomogeneous electric field to the counter-electrode ring, such as by segmenting the ring into a plurality of individually addressable electrodes (FIG. 33C, 34, 35). The ability to independently vary the voltage on each segment of the ring provides an independent means for printing direction and droplet placement.

Figure 36:
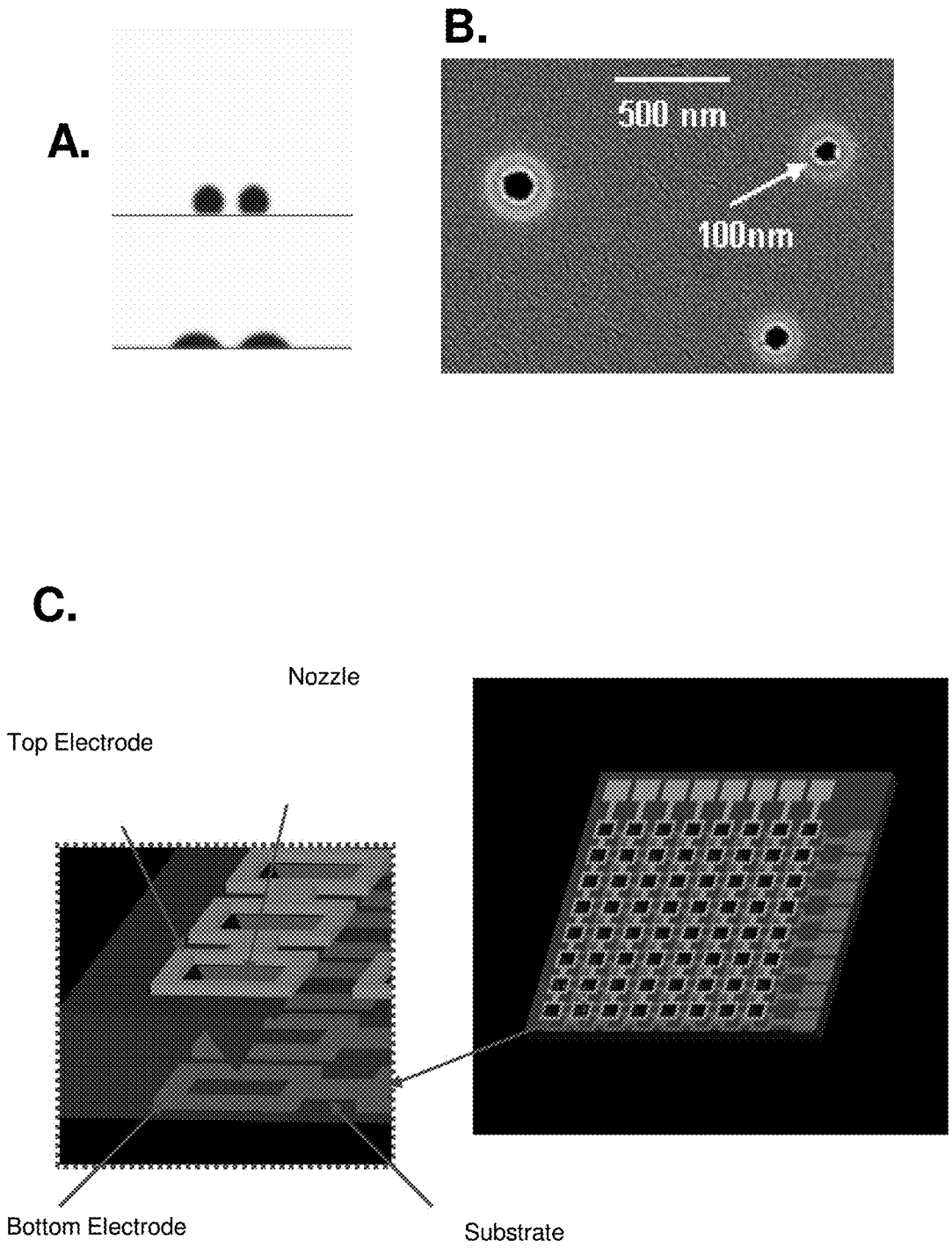
FIG. 36 Panel A is a schematic illustration of a problem in attaining high-resolution ejet printing where the droplets can coalesce. B is an SEM indicating high-resolution (in the nm range) is achieved by electrode oscillation, thereby generating reliable droplet size in the 100 nm or less range. C shows an integrated printhead that is a VLSI microfluidic device with multiplexed electrodes in a toolbit layer and an electrodeless substrate from E-jetting.

In addition, a plurality of individually-addressable electrodes provides a means for oscillating the electric field along a printing direction. This is an important means for accessing very high-resolution printing on the order of microns or nanometers. Typically, ejet printing suffers from a problem related to after droplets contact the substrate, they tend to aggregate with adjacent droplets (see FIG. 36A). By switching the electric potential polarity between, for example a pair of leading electrodes and a pair of lagging electrodes, the droplet oscillates with the electric field oscillation along the direction of printing. Such oscillation is a means for controlling the droplet deposition rate to ensure droplets do not coalesce and reduce printing resolution. In addition, droplet oscillation also provides a distinct printing regime, wherein droplets fan out in the direction of printing resulting in smaller dimension droplets. FIG. 36B provides an example of such oscillatory electric field printing that provides access to printed droplets about 100 nm in diameter. FIG. 36C is a schematic diagram of an integrated printhead having a plurality of nozzles and corresponding integrated-electrodes to provide electrodeless substrate E-jetting. The integrated print head can be further transformed from a lab based process to a manufacturing process by operationally connecting a number of features such as current feedback and positional-tracking. Such feedback and/or process signals provide a closed-loop control feature amenable to automated manufacturing processes. In addition, software decision tools for process planning are governed by computational modeling results to give the platform an ability to print with multiple materials and selectively switch the nozzles to fabricate complicated nanoscale patterns.

We claim:

1. A method of depositing a feature onto a substrate surface comprising the steps of:

providing an electrohydrodynamic printing system comprising:

a nozzle having an ejection orifice for dispensing a printing fluid, wherein said ejection orifice has an ejection area that is less than 700 $\mu m^2$;

a substrate having a surface facing said nozzle;

a voltage source for applying an electric charge to said nozzle to cause said printing fluid to be controllably deposited on said substrate surface;

providing said printing fluid to said nozzle; and applying an electrical charge to said printing fluid in said nozzle thereby establishing an electrostatic force capable of ejecting said printing fluid from said nozzle onto said surface to generate a feature on said substrate in a balanced mode that oscillates between a positive and a negative electric potential to reduce a net charge of printing fluid to said substrate compared to printing without oscillation between the positive and negative electric potential, and said method has a print resolution that is between 100 nm and 10 μm.

2. A method of depositing a printing fluid onto a substrate surface comprising the steps of:

providing a nozzle containing printing fluid, wherein said nozzle has an ejection orifice area selected from a range that is between 0.12 $\mu m^2$ and 700 $\mu m^2$;

providing a substrate surface to be printed;

placing said substrate in fluid communication with said nozzle, wherein said substrate surface is separated from said nozzle by a separation distance; and applying an electric charge to said nozzle to establish an electrostatic force to said printing fluid in said nozzle, thereby controllably ejecting said printing fluid from said ejection orifice onto said substrate surface, wherein said applying electric charge is by a balanced mode that oscillates between a positive and a negative electric potential to reduce a net charge of printing fluid to said substrate compared to printing without oscillation between the positive and negative electric potential, and said method has a print resolution that is between 100 nm and 10 μm.

3. The method of claim 2, wherein the electric charge is applied intermittently.

4. The method of claim 2, further comprising adding a surfactant to said printing fluid to decrease evaporation and surface tension.

5. The method of claim 2, wherein said nozzle has a nozzle outer surface and an ejection orifice outer edge, the method further comprising coating at least a portion of said ejection orifice outer edge with a hydrophobic material to prevent wicking of printing material to said nozzle outer surface.

6. The method of claim 2, wherein said printing fluid deposited on said substrate surface is used in an electronic or biological device.

7. The method of claim 2 further comprising providing a substrate assist feature on said substrate surface prior to or during depositing said feature.

8. The method of claim 7, wherein said substrate assist feature comprises:

a three-dimensional relief, recess or relief and recess feature pattern that provides a barrier to flow of printing fluid;

a pattern of hydrophobic, hydrophilic or hydrophobic and hydrophilic regions; or a pattern of electric charge on said substrate surface.

9. The method of claim 2, wherein said controllably ejecting printing fluid comprises controlling a printing direction by providing a plurality of individually addressable counter-electrodes integrated with said nozzle to thereby control said printing direction.

10. The method of claim 2, wherein the printing fluid comprises a suspension of nanoparticles, microparticles, nanoparticles and microparticles, or biological material.

11. The method of claim 2, wherein the printing fluid comprises biological material selected from the group consisting of cells, proteins, enzymes, DNA, RNA, antibody, and antigen.

12. The method of claim 2, further comprising the step of: generating a feature from said printing fluid on said substrate, wherein said feature is selected from the group consisting of a nanostructure, a microstructure, an electrode, a circuit, a biological material, a resist material and an electric device component.

13. A method of depositing a feature onto a substrate surface comprising the steps of:

providing an electrohydrodynamic printing system comprising:

a nozzle having: an ejection orifice for dispensing a printing fluid; an inner-facing surface capable of holding a printing fluid; and an outer-facing surface that faces a substrate to be printed, wherein said ejection orifice has an ejection area that is less than 700 $\mu m^2$;

an electrode that coats at least a portion of the inner-facing surface;

a counter-electrode connected to said outer-facing surface;

a substrate having a surface facing said nozzle; and a voltage source for applying an electric charge to said electrode or counter-electrode to cause printing fluid in said nozzle to be controllably deposited on said substrate surface providing a substrate having a surface facing said nozzle;

providing said printing fluid to said nozzle; and applying an electrical charge to said electrode or counter-electrode, thereby establishing an electrostatic force capable of ejecting said printing fluid from said nozzle onto said surface to generate a feature on said substrate.

14. The method of claim 13, wherein said substrate surface is not electrically conductive.

15. The method of claim 13, further comprising the step of providing an inhomogeneous electric field to the counter-electrode, thereby controlling a printing direction and printed fluid placement.

16. The method of claim 13, wherein the counter-electrode comprises a plurality of independently addressable electrodes.

* * * * *